US005708940A

United States Patent [19]

Hosaka et al.

[11] Patent Number: 5,708,940

[45] Date of Patent: Jan. 13, 1998

[54] ELECTROSTATIC RECORDING APPARATUS PROVIDING AN ELECTRIC FIELD ADJACENT A DEVELOPER ROLLER

[75] Inventors: Yasuo Hosaka; Hitoshi Nagato, both of Tokyo; Hideyuki Nakao, Kawasaki, all of Japan

[73] Assignee: Kabushiki Kaisha Toshiba, Kawasaki, Japan

[21] Appl. No.: 473,782

[22] Filed: Jun. 6, 1995

Related U.S. Application Data

[62] Division of Ser. No. 208,719, Mar. 11, 1994.

[30] Foreign Application Priority Data

| | | | |
|---|---|---|---|
| Mar. 12, 1993 | [JP] | Japan | 5-052041 |
| Jun. 30, 1993 | [JP] | Japan | 5-161298 |
| Sep. 20, 1993 | [JP] | Japan | 5-233830 |
| Dec. 28, 1993 | [JP] | Japan | 5-351167 |

[51] Int. Cl.[6] ..... G03G 15/06

[52] U.S. Cl. ..... 399/266; 399/291

[58] Field of Search ..... 355/245, 259, 355/261, 265; 118/647, 651, 653

[56] References Cited

U.S. PATENT DOCUMENTS

| | | | |
|---|---|---|---|
| 4,282,303 | 8/1981 | Bergen | 118/651 |
| 4,515,106 | 5/1985 | Kohyama | 118/651 |
| 4,647,179 | 3/1987 | Schmidlin | 355/265 X |
| 5,323,214 | 6/1994 | Kai | 355/245 |
| 5,517,287 | 5/1996 | Rodriguez et al. | 355/259 |

FOREIGN PATENT DOCUMENTS

| | | |
|---|---|---|
| 5-224516 | 9/1993 | Japan . |
| 5-224523 | 9/1993 | Japan . |

*Primary Examiner*—William J. Royer

*Attorney, Agent, or Firm*—Oblon, Spivak, McClelland, Maier & Neustadt, P.C.

[57] ABSTRACT

An electrostatic recording apparatus including a recording medium which forms a latent image of a recording picture and then forms the recording picture, a charger which uniformly charges the recording medium, an imaging unit which forms an electrostatic latent image onto the uniformly charged recording medium, a developer which develops the electrostatic image formed on the recording medium and forms the recording picture, the developer including a development roller, and an electric field generator arranged near the developer to generate an electric field orthogonal to a rotating direction of the development roller.

7 Claims, 28 Drawing Sheets

ELECTROSTATIC RECORDING APPARATUS PROVIDING AN ELECTRIC FIELD ADJACENT A DEVELOPER ROLLER

This is a Division of application Ser. No. 08/208,719 filed on Mar. 11, 1994.

BACKGROUND OF THE INVENTION

1. Field of the Invention

The present invention relates to an electrostatic recording apparatus.

2. Discussion of Background

There are, as a system for developing an electrostatic latent image formed on a photosensitive drum of an electrophotograph or an electrostatic image drum of an electrostatic recording apparatus, a two-component development system using two-component development agent having magnetic carrier and powder toner, a magnetic one-component development system using magnetic toner, a nonmagnetic one-component development system using only nonmagnetic powder toner and a liquid development system.

The liquid development system is adapted for a color recording having fine toner and high picture quality. In addition, the liquid development system can develop a low-voltage electrostatic latent image at 200 V or lower. However, the liquid development system needs high insulated kerosene used for jet fuel as a carrier for imparting charge to the toner, the high insulating kerosene is used only for special purposes such as a plotter due to danger and offensive odor, and is not used for a general purpose printer or copying machine in an office.

The magnetic one-component development system can develop low electrostatic contrast similar to the liquid development system, and additionally conveys toner by a magnetic element in the toner, and hence has a simple structure for a development device. However, since the magnetic one-component development system uses intensity of polarization of toner generated by an electrostatic image at the time of developing, it is not adapted for a system for reverse development of a region having no charge like a laser printer. Since the magnetic one-component development system has a conductive magnetic element in the toner, a toner image formed on a recording medium cannot be electrostatically transferred to a normal sheet. Further, since the magnetic one-component development system has an opaque black magnetic element, it is not adapted for coloring.

The nonmagnetic one-component development system is a system improved as compared with the above-described development systems at the stage of a practical component development system a contact development system in which a surface of a development roller is coated with toner and contacted with a recording medium, and a non-contact development system in which an image drum is not contacted with a development roller.

The contact development system in which the development roller is contacted with a photosensitive drum causes an electrostatic latent image on a recording medium to be varied according to a frictional discharging between the development roller and the recording medium, a white background having a low electrostatic contrast is easily fogged, and image noise is readily generated. Therefore, the contact development system removes the fog by a high development bias voltage being 400 V or higher, removes image noise by forming a high electrostatic contrast and developing the image up to saturated density. As a result, the contact development system is adapted for binary recording by gradation recording.

As described above, the contact development system necessitates to form a high contrast electrostatic latent image on the image drum, and an orbit of charge is bent due to optical carriers in the image drum generated by a laser light or the like, when a high electrostatic latent image is formed. Thus, an electrostatic pixel enlarges, and hence picture quality is lowered. Further, a large mechanical load is applied in the case of contact of the development roller with the image drum to generate a feeding irregularity of the image drum, thereby causing an irregularity in image density to occur.

Since the nonmagnetic one-component development for developing an image by flying toner between a development roller and a recording medium flies the toner with higher electrostatic power than physical adherence generated between the toner and the development roller, a high DC bias voltage of about 500 V and a high AC bias voltage of 1 kVpp or more are superposed and applied to the development roller.

Since the non-contact development system has no frictional charge between the development roller and the image drum and develops the image by reciprocatingly flying toner between the development roller and the image drum by applying the DC bias voltage and the AC bias voltage, it is preferable without problem of the contact development system.

Since the non-contact development system can develop low electrostatic images at 200 V or lower, an interference between the electrostatic latent image and optical carrier in the image drum generated by irradiating it with a light can be reduced to prevent an extension of the electrostatic pixel, thereby high picture quality can be achieved.

Since a high voltage is applied between the development roller and the recording medium in the non-contact development system in which the DC bias voltage and the AC bias voltage are added and applied to the development roller, a spark discharge is generated between the both at a highland where low discharge is easily generated at a dried low atmospheric pressure not to be able to develop the image.

In the one component development system transferring this multilayer toner, moisture among toner is reduced and no moisture adherence force among toner effects. As a result, the critical bias voltage of flying toner is varied, and picture quality varied and unstable developing by toner scattering occurred.

The two-component development system employs a powder development system for developing an electrostatic latent image of 400 V or higher by mixing magnetic carrier and insulation toner and applying a charge to toner by means of frictional charging of both. The two component development system can obtain stable picture quality and is most generally used for a copying machine, a laser printer, [and further] a digital color printer and the like. However, the two-component development system needs replacement of carrier for applying charge to the toner at several thousand numbers of recording sheets and additionally has a development device of a large size for mixing the carrier and the toner.

A conventional electrostatic development apparatus will be explained with reference to FIGS. 1 and 2.

FIG. 1 is an arrangement view of a non-contact one-component development device, a recording drum and a bias power source of a conventional electrostatic developing apparatus.

FIG. 2 is a view showing the state of flying toner from a development roller to a recording drum.

The toner 11 in the development device 10 is applied by charge by means of friction with charging blade 12, and several charged toner layers are formed on the development roller 15 on a metal surface so roughed in the degree of particle size of the toner 11. Since a distance between the development roller 15 and the recording drum 20 affects an influence to image density, it is normally held accurately in the degree of 200 μm.

The development roller 15 and the recording drum 20 are respectively moved at an equal speed in directions of arrows D1 and D2. The development roller 15 is applied by a DC bias and an AC bias from a DC bias source 31 and an AC bias source 35, respectively. The fogging toner of a white area of a surface potential of −600 V on the recording drum 20 given by precharging is reversely flown by the DC bias voltage of −400 V and the AC bias voltage of 1.5 kVpp and a frequency of 2 kHz thereby [to] preventing fogging. The toner 11 flown to the recording medium in which surface charge of an image area is reduced remains thereat and is developed.

FIG. 3 is a view showing characteristics of the nonmagnetic one-component development system of the case where the AC bias voltage is varied, where an abscissa axis is an electrostatic contrast, and a value in which a DC bias voltage is subtracted from a potential of the electrostatic latent image, and an ordinate axis is an image density. A curve CO is developing characteristics of the state that the AC bias voltage is not applied, and a high electrostatic contrast of 600 V or higher is required for the development. A curve CG is developing characteristics of the case where the AC bias voltage of 1.5 kVpp is applied, and the electrostatic contrast necessary for developing is 200 V or lower, thereby exhibiting high gamma characteristics.

The gamma characteristics which exhibit gradation characteristics can be controlled by altering the AC bias voltage. However the AC bias voltage is varied, a critical voltage Vc of the development is altered, and alteration of the gradation characteristics of the image by controlling the gamma characteristics is not achieved. The nonmagnetic one-component development system needs a high accuracy to set a position between the development device and the recording drum.

Ozone is generated in the case of charging by charge in an electrostatic developing apparatus in which the above-described electrostatic image is formed. Since the generation of the ozone causes an office environment to be deteriorated, a charger for improving the office environment by reducing an ozone generation amount for a printer has been recently developed. Thus, a roller charging has been vigorously developed. Since a low surface potential is advantageous to obtain a uniform image by this roller charging, a request for a low potential development device for developing an electrostatic image of low voltage of 200 V is taking place.

As described above, the toner 11 is reciprocated between the development roller 15 and the recording drum 20 by the AC bias voltage, adhered to an image area in which charge on the recording drum 20 is erased, and developed. The toner 11 on the development roller 15 is precluded by the DC bias, which has a function of flying the toner 11 in a direction of the recording drum 20.

FIG. 4 is a graph showing a calculated result of developing characteristics when physical adhering strength between the toner 11 and the development roller 15 is varied. In this case, the physical adhering strength is varied from $1\times10^{-8}$ (N) to $1\times10^{-7}$ (N). In FIG. 4, an abscissa axis is an electrostatic contrast, and an ordinate axis is image density.

The physical adhering strength is van der Waals force and an adhering strength by the moisture influenced by environmental conditions. An electric field necessary to fly the toner 11 is large at a curve C1 changing an adhering strength by moisture and increasing a physical adhering strength, and a high electrostatic contrast at 400 V or larger being necessary to a saturated concentration and flying start voltage of toner 11 at 100 V or larger are necessary. When the physical adhering strength due to moisture at the time of high moisture exceeds $1\times10^{-6}$ (N), it is impossible to fly the toner 11 by the electrostatic force. A curve C2 shows the case that the physical adhering strength is low of $1\times10^{-8}$ (N). The physical adhering strength is reduced as indicated by the curve C2 at a highland where the atmospheric pressure is low and dry, and a spark discharge is simultaneously generated between the development roller 15 by the reduction of the atmospheric pressure and the recording medium to cause the development to be impossible. Thus, when the physical adhering strength is reduced by drying, the toner 11 is scattered by a repelling force of the multi-layer toner 11 on the development roller 15, thereby causing a decrease in picture quality and contamination due to toner 11 of the electrostatic developing apparatus.

On the other hand, the contact development system (the electrostatic developing apparatus in which this system is employed is called "contact one-component development device") causes an electrostatic latent image on the recording medium to be varied due to frictional charging between the development roller 15 and the recording medium, a white area of low electrostatic contrast is easily fogged, and picture noise is readily generated. Therefore, a high developing bias voltage is applied to remove the background fog, and a high electrostatic contrast is formed to remove picture noise to develop to saturation density. As a result, this development system is adapted for binary recording by gradation recording.

Another improved contact one-component development device will be explained with reference to FIG. 6. FIG. 6 shows an arrangement of a non-contact one-component development device, a recording drum and a bias power source of a conventional electrostatic developing apparatus. The development roller has a dielectric element 23 in which an infinitesimal area is isolated on the surface of a conductive development roller 15.

A polarization charge is generated on the isolated dielectric element layer by the conductive surface potential given by charge by frictional charging with the toner 11 or the charging blade. As shown in FIG. 6, a strong electric field in the direction of an array shown in FIG. 5 is generated between the charged dielectric element 23 and a peripheral conductive development roller 15, a large quantity of the toner 11 is fixed to the periphery of the dielectric element 23, conveyed, and developed at a high speed.

The solidable ion generator utilizing discharge is used as a charger for uniformly charging an insulating recording medium to be used without noise for a recorder utilizing electrostatic recording of electrophotograph or the like (called "an ion generator" when an ion generator itself is designated). The necessary improvement of a solid ion generator will be explained.

FIG. 7 is a view showing an example of an electrophotographic process of an ion generator 50.

A charging device 50 constituted by the solid ion generator is used to uniformly charge a photosensitive layer 21.

FIG. 8 is a view showing a structure of a conventional solid ion generator 50. A dielectric electrode 52 of a first electrode and an ion generating electrode 53 of a second electrode are provided at both sides of a dielectric layer 51 (which may also be called a "dielectric").

An AC voltage 70 having a peak value of 2.5 to 3.0 kVpp is applied between the dielectric electrode 52 and the ion generating electrode 53, discharging is generated in the ion generating slit 54, and ions of both positive and negative polarities are generated.

Ions of single polarity are moved from the ion generator 50 to the photosensitive drum by applying a bias voltage between the ion generating electrode 53 and the photosensitive drum of an object to be charged, thereby charging the photosensitive layer 21.

As one of the problems of the solid ion generator capable of uniformly charging to improve the picture quality, the surface of the dielectric layer 51 is degraded by formation generated by discharging might be gradually weakened to reduce charging capacity. As another of the problems, when the surface of the dielectric 51 is degraded, discharging does not immediately occur even by applying an AC voltage, and it takes a time until a charging current is saturated. If the surface of the dielectric layer 51 is degraded to weaken the discharge, when a temperature of the ion generator 50 itself is raised or a peak value of the AC voltage is raised, the discharging is again strengthened to the necessary degree, but the degradation of the surface of the dielectric 51 is advanced, and the discharge is again weakened.

As described above, the ion generator utilizing discharging generates ozone of detrimental substance by discharging.

In a copying machine or a printer utilizing an electrophotographic process, an ozone filter is disposed in a discharge hole from the recorder to reduce ozone density to be discharged out of the apparatus to a certain reference or less. However, it is necessary to periodically replace the ozone filter at a predetermined period. In the case of a copying machine to be used in an office, a maintenance man periodically replaces it and no problem occurs, but in a printer in which a user must conduct maintenance, replacement is ignored, and it frequently discharges ozone of reference or more.

A method for charging by bringing a roller to be applied by the voltage still has a problem that stability and charging irregularity occur even if ozone amount to be generated is small.

As described above, applicant of the present invention who has discussed improvements in picture quality of an electrophotograph or the like has discovered the fact that, when an electrostatic latent image of 200 V or higher is formed on a photosensitive drum, optical carriers in the photosensitive drum generated by irradiating with a light interferes with the electrostatic latent image and an electrostatic pixel is extended (in an ion deposition recording for forming directly the electrostatic latent image on the insulating recording medium by controlling ions at each pixel, since an interference between the electrostatic latent image and an ion flow occurs, and extension of the pixel occurs, the development device same as above is required). When the electrostatic latent image is set to a low electrostatic contrast of 200 V or lower, the interference is reduced, and a high picture quality is formed. As described above, there are as a system for developing a low electrostatic contrast a liquid development system and a magnetic one-component development system, but the above-described drawbacks exist. Therefore, the applicant has aimed at a ion generator capable of uniformly charging without public pollution, for example, ozone or the like, and non-contact non-magnetic one-component development system which can execute a color development. With the development device, a development of an electrostatic developing apparatus in which a spark discharge does not occur by a low physical adhering strength between toner and a development roller is stabilized to stabilize environment of developing characteristics, a low electrostatic contrast of 200 V or lower allows to develop the image, an extension of the pixel is eliminated to obtain a preferable image without rough even on a low density area is a subject of the present invention. With the ion generator, a development of an electrostatic development apparatus which reduces ozone and has a long-life is a subject of the present invention.

SUMMARY OF THE INVENTION

Accordingly, one object of this invention is to provide a novel electrostatic recording apparatus capable of forming a high quality image using a non-contact one-component developing system using non-magnetic toner and a solid ion generator capable of uniformly charging thereto.

Specifically, the object of the present invention is to provide an electrostatic recording apparatus having the following features:

(1) An apparatus being stable for environmental changes with no spread of pixel and developing smooth and fine in a low concentration area;

(2) An apparatus having no change of a picture quality for environmental changes, eliminating unstable states by discharge or the like at high place with low atmospheric pressure; and (3) A charging device used in the inventive apparatus generates a stable discharge, reducing a time from applying a voltage to saturating discharge current.

An electrostatic recording apparatus according to the first aspect of the present invention is characterized by comprising: a recording medium for forming a latent image of a recording picture and then forming the recording picture; charging means for uniformly charging the recording medium; electrostatic latent image forming means for forming the latent image onto the uniformly charged recording medium; development means for developing the electrostatic image formed on the recording medium and forming the recording picture, the development means including development roller; and electric field generating means arranged near the development means for generating an electric field orthogonal to a rotating direction of the development roller.

In the first aspect, the electric field generating means includes a plurality of first electrodes and a plurality of second electrodes located between the development roller and the recording medium and arranged alternately, and voltage applying means for applying one of different DC bias voltage and different AC bias voltage to the first and second electrodes, respectively. The electric field generating means further includes means for applying a DC bias voltage to the development roller. A distance between the development roller is smaller than a distance between the first and second electrodes.

In the first aspect, the electric field generating means includes a plurality of electrodes contacted to the development roller and arranged between the development roller and the recording medium, the electric field generating means includes a plurality of first electrodes and a plurality of second electrodes located between the development roller and the recording medium and arranged alternately, voltage applying means for applying one of different DC bias voltage and different AC bias voltage to the first and second electrodes, respectively, and means for applying an AC bias voltage to the development roller, and the apparatus further comprises means for forming an dielectric field between the development roller and the recording medium to move a development agent from the development roller to the recording medium and from the recording medium to the development roller.

An electrostatic recording apparatus according to the second aspect of the present invention is characterized by comprising: a recording medium for forming a latent image of a recording picture and then forming the recording picture; charging means for uniformly charging the recording medium; electrostatic latent image forming means for forming the latent image onto the uniformly charged recording medium; development means having a development roller for developing the electrostatic image formed on the recording medium and forming the recording picture, the development roller including first and second electrodes arranged on the development roller via an insulator for the first electrode; and electric field generating means for applying a predetermined bias voltage to the first and second electrodes and generating an electric field parallel to the recording medium.

In the third aspect, a distance between the development roller is smaller than a distance between the first and second electrodes. Further, in the above construction, the following relationship is set among a moving velocity v of the recording medium, the development area L, a peripheral speedy $v_r$ of the development roller, and a period $L_f$ between the electrodes for applying the same bias on the development roller: $(L/v)<(L_f/v_r)$.

Electrostatic apparatus according to the first and second aspects, which form an electrostatic latent image to a recording medium after uniformly charging the recording medium by the charging means, developing the electrostatic latent image and forming a recording image, mechanically peel toners from the development roller after applying toners to the development roller.

First, an electrostatic apparatus according to the first and second aspects, which relate to non-contact one-component development using non-magnetic powder toners, mechanically and electronically peel the toners, which are transferred by the development roller, having different sizes from development roller, eliminate physical adhesion between the toners changed by environment and the development roller, and can stabilize the development to contribute the toners to the development by only an electronic force.

Simultaneously, in spite of the electrostatic contrast, all toners having various sizes can be contributed to the development and an image having a low concentration area can be developed to be smooth and fine. The development with high gamma characteristics capable of low electrostatic contrast development equal to or less than 200 V can be performed. It can prevent spread of a pixel by mutual intervention between a photo-carrier in the photosensitive drum and the electrostatic latent image.

As described above, according to the invention, a bias voltage applied to the photosensitive drum and the developer reduce when a potential of the electrostatic image becomes lower, thereby discharge between the developer and the photosensitive drum in a highland with low air pressure can be prevented and a stable development can be achieved. Since image forming of electrostatic contrast can be achieved, a roller charger and a contact charger with low ozone generation is achieved, thereby office environment can be improved. Charging means [the] aforementioned as above, which controls an ion for each pixel, can be used for high-speed ion deposition directly forming the electrostatic latent image on the insulating recording medium to improve the picture quality reducing the interference between the electrostatic latent image and ion beam.

To prevent a discharge between the recording medium and the development roller caused by the reduction of the atmospheric pressure in a highland, an AC current applied to the development device is set to the range without discharge. In this case, assume that a town, in which a printer and copying machine are used, is near 3,000 m which is an upper limit of altitude, the atmospheric pressure is about 500 mmHg. Assuming that this value is the lower limit of the atmospheric pressure, an AC current voltage is set to satisfy the following equation from an approximation of a straight line of a Paschen's discharge curve.

$$(Vpp/2+Vc)\leqq(4150\times d)+325$$

Further, by preventing the exposure of members having high emission rate of a secondary electron such as metal and oxide on the surface of the development roller, a condition easily generating a discharge is eliminated. The development critical voltage changes when an AC bias voltage is undervoltage and when charge injection to the toner is occurred by high bias voltage. To change gamma characteristics by changing the AC bias voltage, it is necessary to maintain the critical voltage constant. Thus, the AC bias voltage is set to the minimum value capable of reciprocating motion of the toner between the recording medium and the development roller. In this case, a condition capable of reciprocating motion of toner between the development roller and the recording medium without changing the development critical voltage is given by the following equation using the AC bias voltage Vpp, a frequency f, an amount of toner charge Qs and distance d between the development roller and the recording medium:

$$L<(Qs\times Vpp)\ /\ (2\times f).$$

The value obtained from the above equation is uniformly determined when toner charge is set, and actual toner has a distribution of specific charge corresponding to particle size distribution thereof. Therefore, development stability for different AC bias voltage or frequency, or toner having different sizes can be obtained.

The charge injection from the development roller to the toner tends to be generated when the toner including metal in itself such as magnetic toner. Accordingly, an insulating one component development agent is used, and a low resistor such as metal particle tending to generate charge injection from the surface of the development roller to the toner is prevented to expose the surface of the development roller. Thus, stable development and the gamma characteristics determining the tone are controlled.

The electrostatic recording apparatus according to the invention is a non-contact one-component electrostatic recording apparatus using non-magnetic powder toner. The apparatus prevents a discharge between the development roller and the recording medium by detecting the atmospheric pressure and setting the distance between the development roller and the recording medium to a preset value to be able to perform stable development at highland with low atmospheric pressure. Therefore, the apparatus does not require accurate position setting, which is a defect of the non-contact development, between the development roller and the recording drum and can easily set the development device. By using the soft development roller same as the contact development, the distance thereof can extend to the range of slightly contacting them.

The high gamma characteristics can be obtained by changing the AC bias voltage or the frequency thereof, thereby a low electrostatic latent image at 200 V or lower can be stably developed. As a result, image forming can be performed by the roller charging and contact charging with low surface potential and an amount of generated ozone is low, thereby office environment can be improved. Further, in an ion deposition recording, which controls an ion capable of high-speed recording and of expecting high picture quality for each pixel and directly forms an electrostatic latent image on the insulating recording medium, the interference between an electrostatic latent image and the ion beam can be reduced and the printer using powder development with improved picture quality, by being able to develop latent image having low electrostatic contrast. The gamma characteristics of the development is changed by changing the frequency and the voltage of the AC bias voltage applied to the development device, thereby picture quality can be changed by an external device.

The non-contact development has a defect of being unstable at a dry highland. This is why the moisture of the multilayer toner on the development roller is eliminated by the reduction of the temperature and atmospheric pressure at dry highland, the physical adherence force among the toner caused by the moisture, an electrostatic resiliency among the toner becomes larger than the adherence force among the toner and toner is flied, thereby development degradation occurs.

As described above, an environment stability can be obtained, when the layer of toner layer, which coating ratio k of the toner on the development roller is lower than 1, is equal to or less than 1 and an adherence force of the toner on the development roller is mainly determined by electrical image-force of the development roller cause by the toner charge.

The reduction of the amount of the toner transfer causing a toner layer to be equal to or less than 1 is compensated by enlarging peripheral speed ratio of the recording drum velocity to the development roller equal to or higher than 1. That is, a time $T_{ac}$, which the toner reciprocates between the recording drum and the development roller, is set to smaller than a time (S/v), which the toner passes the development area on the development roller by the velocity v (i.e., $T_{ac}<S/v$) to prevent the toner reciprocating by the AC voltage to become multilayer on the development roller. In this manner, a plurality of reciprocating motion of the toner is preformed on the development roller, and the amount of the toner returning to the development roller is averaged to prevent the toner from become multilayer.

The development area S is defined as the distance between the recording medium and the development roller smaller than the distance L obtained by the following equation:

$$L=(Q_s\times Vpp)^{1/2}/(2\times f)$$

where Vpp is the AC bias voltage, f is the frequency thereof and $Q_s$ is the amount of the toner charge.

To loosen the position accuracy to the recording drum which is a second defect of the non-contact development, the applicants study a distance condition between the recording drum and the development roller capable of stably developing with the change of the distance. As a result, when a nearest distance Lm between the recording drum and the development roller satisfies the condition of:

$$Lm<(Q_s\times Vpp)^{1/2}/(2\times f),$$

stable development can be performed. Where Vpp is the AC bias voltage, f is the frequency thereof and $Q_s$ is the amount of the toner charge. According to the invention, the distance between the recording drum and the development roller can be freely selected in the above mentioned range and the development roller is contacted to the recording drum same as the contact development device by using the soft development roller. Further, since the critical voltage of the development is uniformly determined by the DC bias voltage if the condition is satisfied, only the gamma characteristics can be changed by changing the AC bias voltage. In this case, the gamma value becomes smaller when the AC bias voltage becomes larger, then the gamma value is the maximum value when the left side is equal to the right side in the above equation, thereby the development with low contrast can be performed. If the period of the AC bias voltage is substantially equal to the time which the toner flies the critical distance, the gamma characteristics can be changed since moving distance of the toner can be controlled by the period of the frequency by raising the frequency.

In the electrostatic development apparatus according to the invention, the material of the resistance layer of the surface of the development roller has a work function being at least 4 eV. Since the emission rate of the secondary electron is high when the work function is less than 4 eV, a corona discharge is generated between the development roller and the image drum with ease in the place where the atmospheric pressure is low. As the corresponding materials, resin or metal having low resistance such as resistive teflon resin, resin including carbon particle or the like can be used.

The resistance layer becomes having the function of the insulating layer by enlarging the time constant to be larger than the period of the AC bias voltage applied to the development roller and the passage time of the development roller to the development area. Charge storage to the resistance layer is prevented and stable development can be performed by reducing the time constant smaller than the required time of one rotation of the development roller.

The thickness of the resistance layer is preferably set to 10 to 100 μm. A mechanical strength becomes weak when the thickness of the resistor layer is less than 10 μm, and the charge storage increases when the thickness thereof is larger than 100 μm.

In the present invention, coating ratio of the development agent on the development roller is determined to be equal to or less than 1. The coating ratio of the development agent being equal to or less than 1 means that the development agent layer being equal to or less than 1 is formed on the development roller. It is not preferable that the coating ratio of the development agent exceeds 1, since the influence of the environment humidity by the resiliency among the development agent is enlarged.

In the present invention, a peripheral speed ratio of the development roller to the image drum is set to larger than 1. A sufficient image density is not obtained when the peripheral speed ratio is smaller than 1.

The present invention is characterized in that the resistor layer including a material in which the work function is at least 4 eV is formed on the development roller, the coating ratio of the development agent on the development roller is smaller than 1, and the peripheral speed ratio of the development roller to the image drum is larger than 1.

Since the resistance layer including the material in which the work function is at least 4 eV suppresses the emission of the secondary electron, a generation of corona discharge is suppressed between the development roller and the image drum. The development agent on the development roller is determined to be equal to or smaller than 1 to prevent degrading the picture quality by flying the development agent onto the development roller. Further, the peripheral speed of the development roller to the image drum is set to larger than 1 to compensate the reduction of the amount of the development agent caused by the coating ratio of the development agent being equal to or smaller than 1.

According to the present invention, which relates to the non-contact non-magnetic one-component development system using non-magnetic development agent, the emission of the secondary electron emitted from the development roller can be reduced and low contrast development can be performed. Therefore, since the DC bias voltage applied to the development roller can be set to a small value, the generation of the discharge between the development roller and the image drum is suppressed in the highland with low atmospheric pressure to achieve the stable development. Further, high gama characteristics can be obtained in one-component development to stably develop the low electrostatic latent image at 200 V or lower and the spread of the pixel generated by the interference the electrostatic latent image on the image drum and the carrier generated by the light irradiation in the photosensitive drum of the image drum. Accordingly, the development agent having a small size can contribute to the development with the low electrostatic contrast to improve the picture quality.

The material of the resistance layer is selected to be a material in which a time constant is larger than the period of the AC bias voltage applied to the development roller and the passage time of the development roller to the development area, and is smaller than the required time of one rotation of the development roller, thereby reducing image-force of the development roller which is the adherence force of the development agent to the development roller to easily fly the development agent from the development roller to the image drum. As a result, since the development agent having small size flies to the low electrostatic contrast image area to obtain a smooth image having tone characteristics at the low density area.

The above conditions are achieved by the following equation:

$$\epsilon_p \times (D_p+R)^2 < \epsilon_t \times (D_d+R)^2$$

where, R is the diameter of the development agent, $D_d$ is the thickness of the resistance layer of the development roller, $\epsilon_t$ is the dielectric constant of the resistance layer, $D_p$ is the thickness of the photosensitive drum of the image drum, and $\epsilon_p$ is the dielectric constant of the photosensitive drum.

When the AC bias is applied to the development roller having the above resistance layer, the development agent uniformly contributes to the development regardless of the particle size thereof to obtain smooth and stable tone image.

The invention gives the condition stably developing the electrostatic latent image at 200 V or lower using non-contact non-magnetic one-component development system. This condition can be also adapted to the contact development.

As described above, in non-magnetic one-component electrostatic recording apparatus, the resistance layer including the material which work function is at least 4 eV is formed on the surface of the development roller, the development agent on the development roller is determined to be equal to or smaller than 1 and the peripheral speed of the development roller to the image drum is set to be larger than 1. Therefore, the apparatus of the invention can be favorably used at a highland with low atmospheric pressure, develop the electrostatic image with the low electrostatic contrast, and achieve the image forming having favorable tone characteristics in the low density area and the high picture quality without the spread of the pixel.

Since the image forming can be performed in low electrostatic contrast, the roller charging and the contact charging, which generate a small amount of ozone, can be used thereby improving the office environment. If the inventive apparatus is used to the ion deposition recording, which controls the ion for pixel and directly forms the electrostatic latent image onto the insulating image drum, capable of high-speed recording, the interference between the electrostatic latent image and the ion beam can be reduced and the picture quality can be improved.

The electrostatic recording apparatus can adjust the strength of the electric field in the area of a slit of the ion generator by dividing the dielectric electrode, which is the first electrode in the area opposite surface of the slit of the ion generator of the solid ion generator being used as the charging device, to a plurality of the dielectric electrodes. The discharge from the center section of the slit of the ion generator contributing to the charging current can be strengthened without strengthening the discharge near the junction of an ion generating electrode and the surface of the dielectric member which enormously affects the degradation by the discharge. Therefore, the stability of the ion generator can be improved.

The discharge current for unit area of the slit of the ion generator and the variation of the electric physical value can be reduced by making the slit of the ion generator wider than a predetermined width. In this case, a time until degrading the stability of the discharge is made longer.

As described above, since the present invention makes the discharge of the center section stronger, the temperature of the center section of the slit of the ion generator can easily be raised and the time after applying the AC bias voltage until saturating the charging current is shortened.

The electric field near the ion generating electrode can be weakened while keeping the electric field strength of the center section of the slit of the ion generator by eliminating the overlap between the dielectric electrode and the ion generating electrode. Therefore, the stability of the ion generator can be improved.

Ozone reaches the saturated state by the two kinds of reactions of formation reaction by the discharge and decomposition reaction by oxidizing the such as nitrogen. Further, the ozone is decomposed by the heat. In the ion generator of the invention, this ozone having saturated concentration also exists at a discharge area. However, since the invention heats the discharge area to a predetermined temperature and adjusts the distance between the ozone generating position and passage hole (slit) to eliminate the ozone, a leakage amount of the ozone to outside of the discharge area is small and high concentrated ozone is not diffused in a whole body of the apparatus. Accordingly, the ion generator capable of charging the charging object without contact, stable and small exhaust ozone concentration can be achieved.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

A more complete appreciation of the invention and many of the attendant advantages thereof will be readily obtained as the same becomes better understood by reference to the following detailed descriptions when considered in connection with the accompanying drawings, wherein.

DESCRIPTION OF THE PREFERRED EMBODIMENTS

Figure 1:
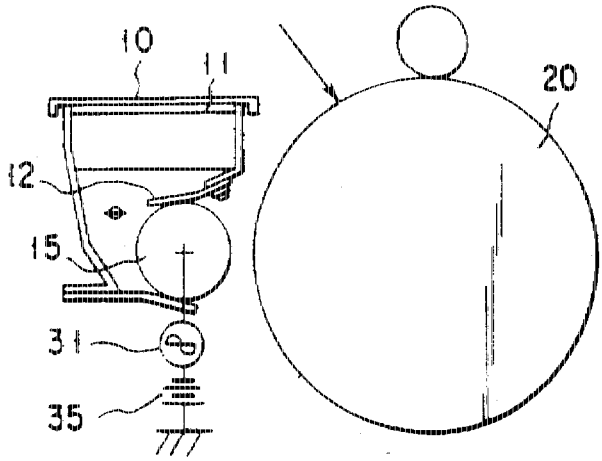
FIG. 1 (PRIOR ART)
FIG. 1 is an arrangement view of a non-contact one-component development device, a recording drum and a bias power source of a conventional electrostatic developing apparatus.
Figure 2:
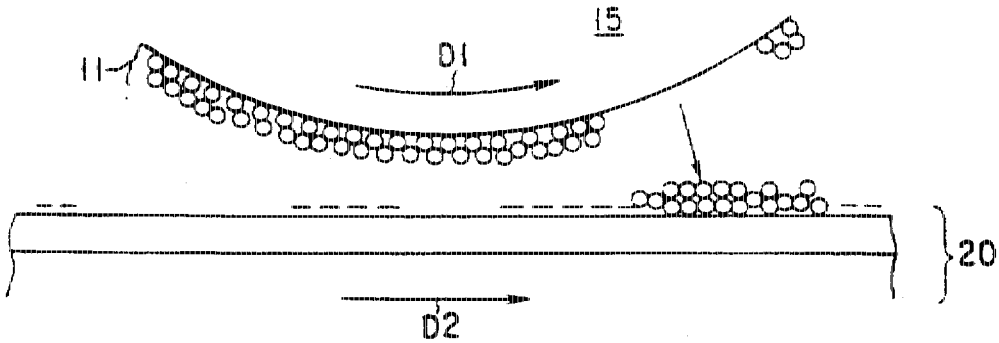
FIG. 2 (PRIOR ART)
FIG. 2 is a view showing a state of flying toner from a development roller to a recording drum.
Figure 3:
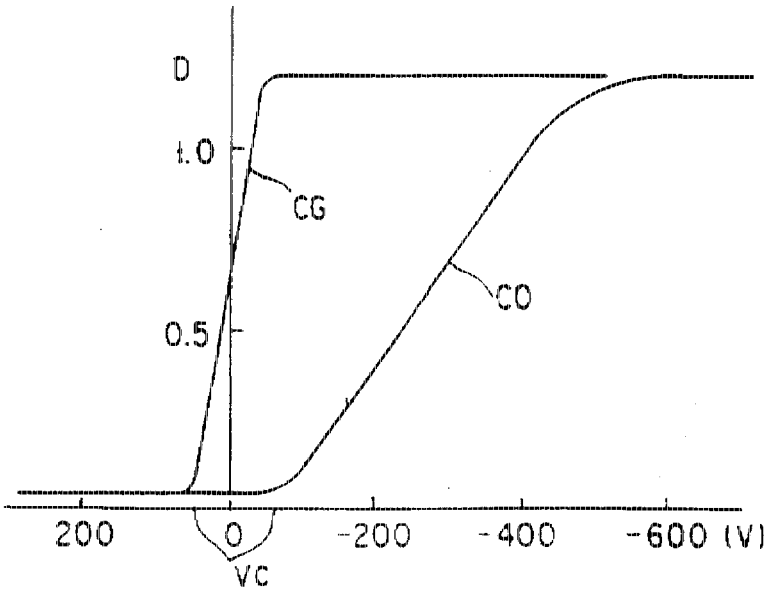
FIG. 3 (PRIOR ART)
FIG. 3 is a diagram showing characteristics of a nonmagnetic one-component development system of the case where an AC bias voltage is altered.
Figure 4:
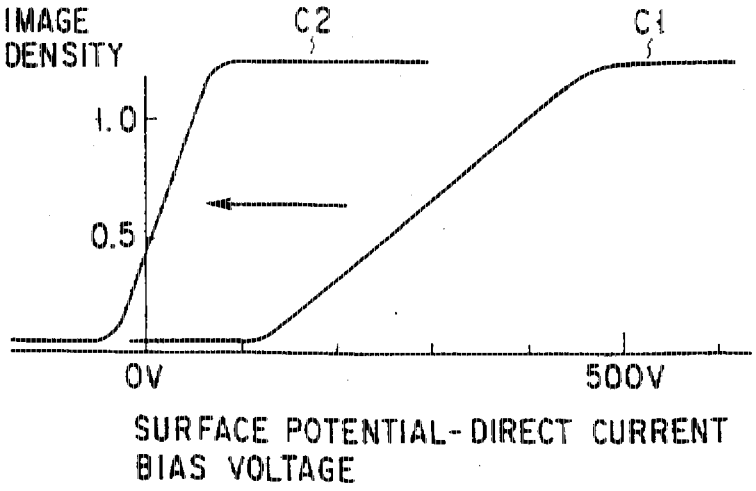
FIG. 4 (PRIOR ART)
FIG. 4 is a graph showing a calculated result of developing characteristic when physical adhering strength between toner and a development roller is varied.
Figure 5:
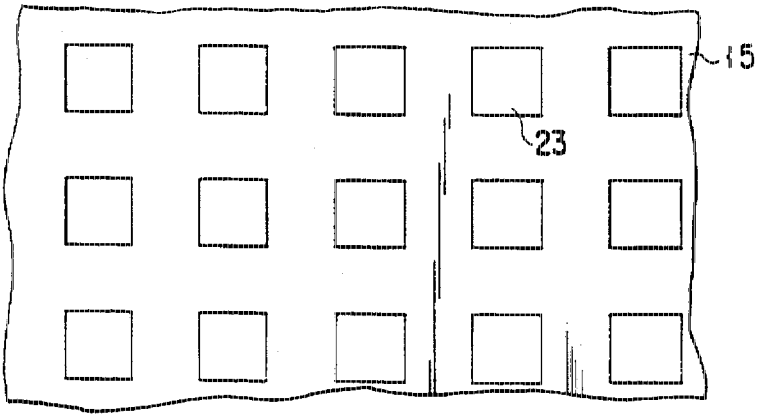
FIG. 5 (PRIOR ART)
FIG. 5 is a view showing a structure of a separated dielectric element provided on a development roller.
Figure 6:
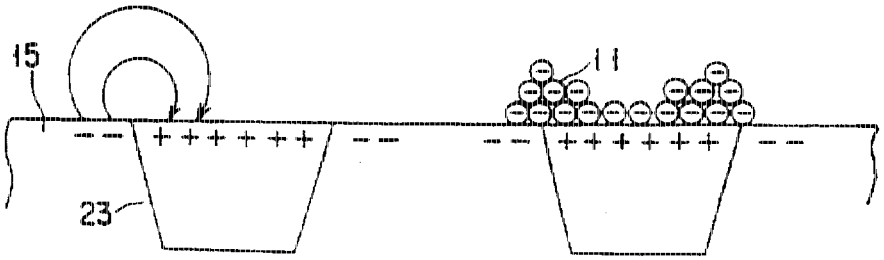
FIG. 6 (PRIOR ART)
FIG. 6 is a view showing a developing operation when the development device shown in FIG. 1 is used.
Figure 7:
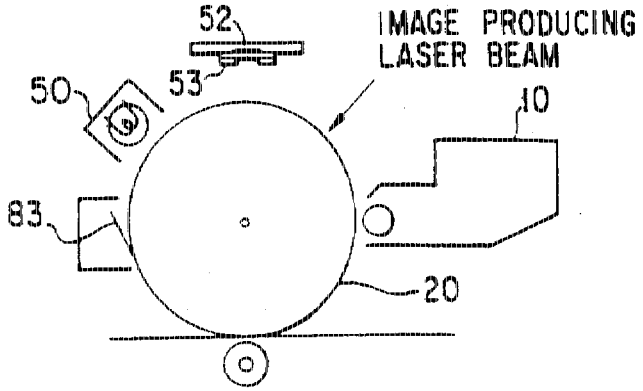
F I G. 7 (PRIOR ART)
FIG. 7 is a view showing an example of an electrophotographic process of an ion generator.
Figure 8:
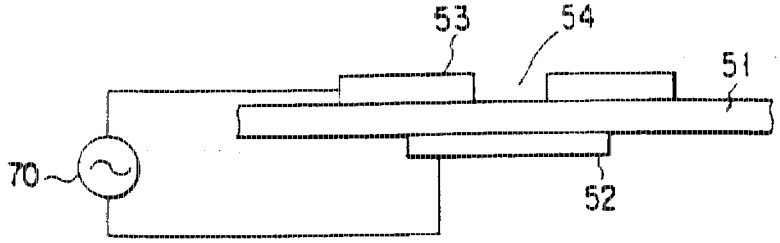
F I G. 8 (PRIOR ART)
FIG. 8 is a view showing a structure of a conventional ion generator.
Figure 9:
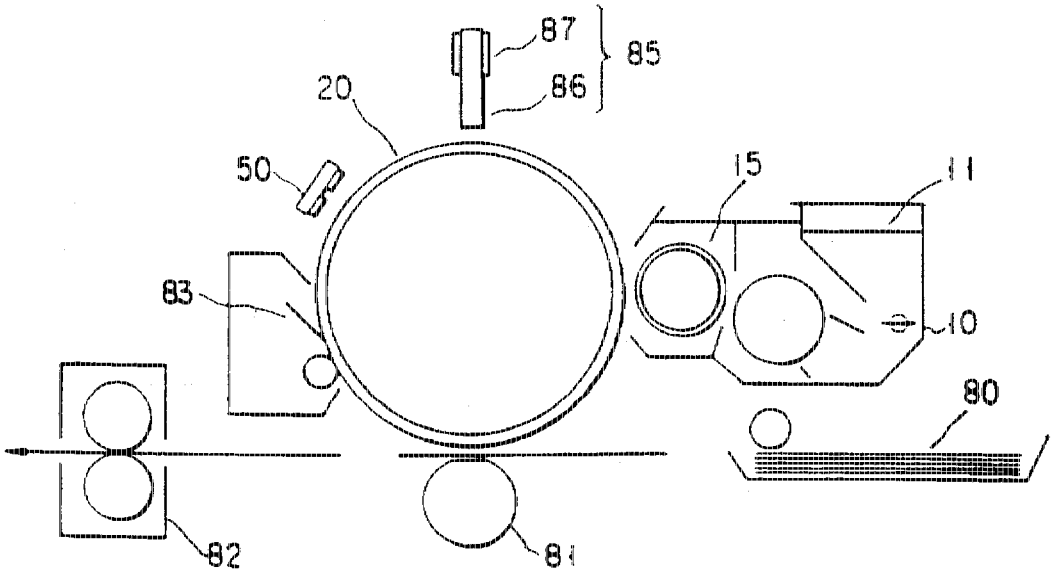
FIG. 9 is a view showing a schematic structure of an electrostatic recording apparatus according to the present invention.

Referring now to the drawings, wherein like reference numerals designate identical or corresponding parts throughout the several views, and more particularly to FIG. 9 thereof, is a view showing a schematic structure of an electrostatic recording apparatus of the present invention.

On a periphery of a rotating recording drum 20 provided with a fluorine resin layer (photo sensitive layer 21) of about 50 μm on a conductive drum are provided a precharging solid ion generator 50 (i.e., a charger 50) to be described in detail later, an ion head 85, a development device 10 having a development roller 15 to be described in detail later, a transfer soft roller 81, and a cleaning blade 83 for cleaning the recording drum 20.

The precharging solid ion generator 50 to be described in detail later uniformly charges (i.e., precharges) the recording drum 20 to about −600 V.

The ion head 85 vanishes charge of the recording drum 20 by discharge ions in the air controlled by a signal voltage to form an inverted electrostatic latent image on the recording drum 20. The ion head 85 has an ion controller 86 having a solid ion generator for generating ions similarly to the case of precharging and a control electrode, and a driving IC 87 for supplying a control voltage to a control electrode.

The electrostatic latent image formed on the recording drum 20 as described above is inverted to be developed by toner 11 on a development roller 15 to be rotated as will be described in detail later, and a toner image is formed on the recording drum 20.

The development roller 15 has a plurality of electrodes (not shown) for applying different voltages to be described in detail later, fixes a large quantity of the toner 11 charged by a horizontal strong electric field between adjacent electrodes, and conveys the toner to a predetermined region to be developed close to the recording drum 20. A high speed developing is performed by the large quantity of toner 11. An electric field of the electrodes on the development roller 15 is vertically formed by the approaching recording drum 20 on the area to be developed. The electrodes apply a voltage to become a positive/negative electric field to precharge voltage of the recording drum 20. The toner 11 on the development roller 15 is reciprocated to the recording drum 20 to collide with the toner 11 on the development roller 15 to thereby reduce physical adhering strength to the development roller 15 and the toner 11. Accordingly, according to the apparatus of the present invention, it can contribute to development with low electrostatic contrast, thereby eliminating a disorder in an image.

The toner image formed on the recording drum 20 is electrostatically transferred by a transfer soft roller 81 to a conveyed recording medium 80 (e.g., normal sheet), the toner image is fixed to the recording medium by a thermal fixing unit 82 to complete recording. On the other hand, a very small amount of toner 11 remaining on the recording drum 20 after transferring wipes off by a cleaning blade 83, and the recording drum 20 is again used for recording.

General descriptions of first to fourth embodiments of an electrostatic recording apparatus according to the present invention will be explained.

The electrostatic recording apparatus according to the first to fourth embodiments of the present invention has coating means for coating the development roller 15 with nonmagnetic toner, and peeling means for peeling the coated toner 11 from the development roller 15 on a region to be developed, peels the toner 11 from the development roller 15 at the time of developing to remove physical adhering strength varied according to an environment, thereby stabilizing an environment of the developing characteristics and improving picture quality.

Different voltages are respectively applied to the peeling means and the development roller, and an electric field for repelling the toner 11 is formed near the peeling means to easily peel the toner 11. Thus, a role of the conventional development roller 15 is executed only as a role of conveying the toner 11, and developing characteristics are determined by a bias voltage to be applied to the peeling means. In order to prevent a spark discharge between photosensitive layer 21 and between the development roller 15 or the peeling means of the toner 11, the development roller 15 or the peeling means is coated with a resistive resin layer to eliminate exposure of metal or oxide having high secondary electron emission rate from the surface.

The toner 11 layer is so coated by a charging blade provided on the development roller 15 as to become one or less toner layer, and environmental change due to scattering of the toner is prevented due to charge repelling force between multilayer toner layers. A resistance layer 19 is provided on a surface of the development roller 15, and so set to a time constant as not to store charge in one rotating period of the development roller 15. This time constant is increased larger than a time for one period of an AC bias voltage or passing the region to be developed to eliminate an image force due to the AC bias voltage. Thus, the image force generated on the development roller 15 by charge of the toner 11 is reduced, and flying of the toner 11 to the recording medium becomes uniform irrespective of the particle size of the toner 11.

When the resistance layer 19 of the development roller 15 is optimized, the toner 11 having small particle size contributes to development with low static voltage contrast to obtain a smooth and fine image on a low density area. The conditions at this time are performed by satisfying the following formula among the particle size R of the toner 11, a thickness $D_i$ of the resistance layer 19 of the development roller 15, permittivity $\epsilon_i$, a thickness $D_p$ of the recording medium and permittivity $\epsilon_p$:

$$\epsilon_p \times (D_p+R)^2 < \epsilon_i \times (D_i+R)^2$$

Thus, when the DC bias and the AC bias are superposed to be applied to the development roller 15, it can contribute to uniform development irrespective of the particle size of the toner 11 to obtain a smooth and stable gradation image. If the development roller 15 is coated with one or less of the toner layer, a speed ratio p of the recording drum 20 to the development roller 15 is so increased larger than 1 as to sufficiently obtain an image density.

This embodiment provides a developing apparatus for stably developing an electrostatic latent image with 200 V or less by using a non-contact one-component development. More specifically, the development roller 15 is coated with the toner 11 by a charging blade, the toner 11 is peeled by peeling means of the toner 11 in contact with the development roller 15 on an area to be developed close to the photosensitive layer 21, the toner 11 is flown between the development roller 15 and the photosensitive layer 21 by the bias voltage applied to the peeling means to be developed.

That is, the development system according to the first embodiment uses a high gamma value of the feature of one-component development, can perform low electrostatic contrast development of 200 V or lower in non-contact, and assures environmental stability. The toner 11 having small particle size on a low density area can contribute to development similarly to the toner 11 having large particle size to improve picture quality by smoothly reproducing gradation characteristics of the low density area.

The general description of this embodiment will be described in detail with reference to the drawings.

Figure 10A:
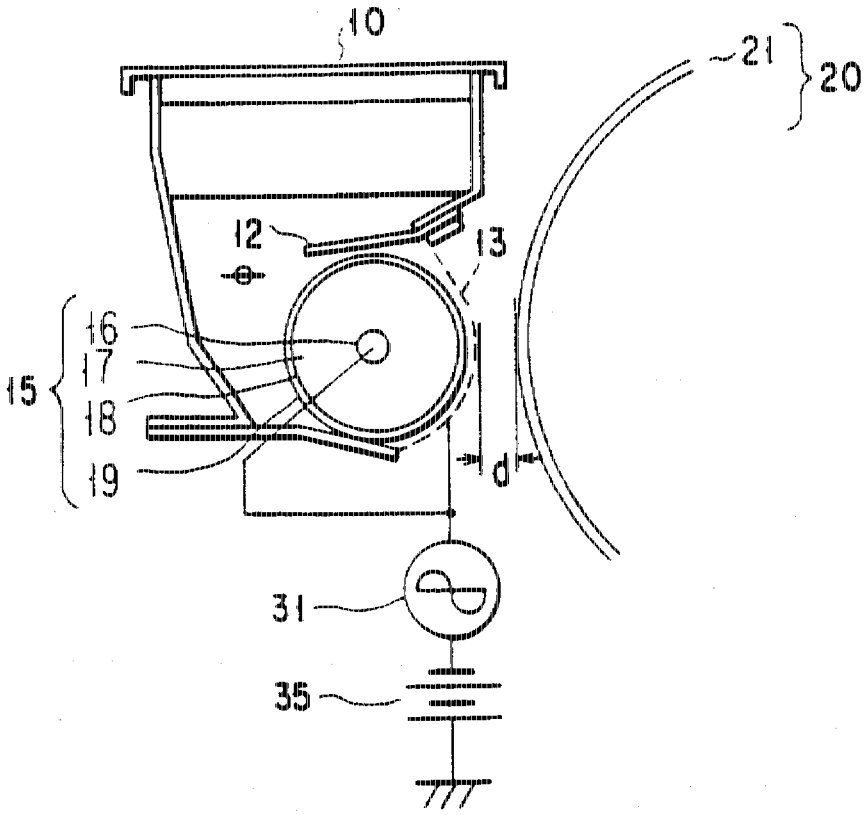
FIG. 10A is a schematic sectional view of a development device and a photosensitive drum.

FIG. 10A is a schematic view showing a relative position between one-component development device 10 and a recording drum 20 according to a first embodiment of the present invention.

The development roller 15 has a formable rubber roller 17 provided around a metallic drive shaft 16, a conductive resin layer 18 covering the roller 17, and a resistive resin layer 19. The conductive resin layer 18 is connected to a driving shaft 16 by conductive rubber (not shown) provided at an end of the development roller 15. The development roller 15 is mounted at a distance d of 100 μm from the recording drum 20 made of a photosensitive layer 21 of a thickness of 25 μm.

The development roller 15 is so uniformly charged and coated with the toner 11 of one or less of toner layers by a charging blade 12 in the development device 10 and coating rate k of the toner 11 is smaller than 1.0. Since the magnetic toner 11 containing magnetic metal or metal oxide is directly discharged from the magnetic toner 11 by a high developing bias voltage, and hence nonmagnetic toner 11 is used for this development system. A peeling wire 13 for peeling the toner 11 on the development roller 15 on the developed area is provided in contact with the development roller 15. As the peeling wire 13, a tungsten wire having a diameter of several tens μm is used, and a DC bias voltage 35 of −550 V and an AC bias voltage 31 of a frequency of 2 kHz and a voltage of 1.5 kVpp are superposed to be applied to the toner 11 conveying development roller 15 and the peeling wire 13. The toner 11 is mechanically peeled by the peeling wire 13 on the development roller 15, and reciprocated between the development roller 15 and the photosensitive layer 21 by the bias voltage to be developed.

A surface potential of the photosensitive layer 21 is set to −600 V by precharging on a white area, and to −400 V by irradiating an image area with a light. When the toner 11 is mechanically peeled from the development roller 15, physical adhering strength varying according to the particle size or the toner 11 or the environment is not operated, and the toner 11 can be controlled only by an electrostatic force.

Figure 10B:
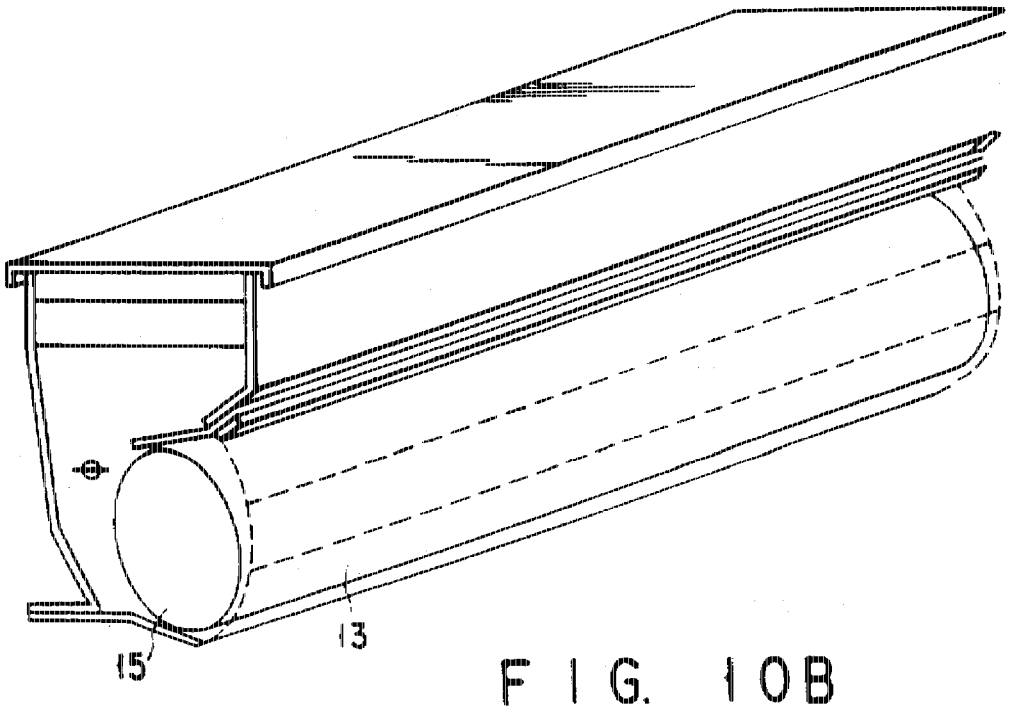
FIG. 10B is a perspective view of a development device of the present invention.

FIG. 10B is a perspective view of the apparatus of the first embodiment. The peeling wire 13 extended obliquely in contact with the development roller 15 mechanically peels the toner 11 on the development roller 15. The peeling wire 13 is formed of a tungsten or other metal wire of several tens μm, or may be formed by obliquely etching slits on a stainless steel plate having a thickness of several tens μm. The peeling wire 13 may be coated with insulating or resistive resin such as epoxy resin. A tension is so applied to both ends of the wire 13 by a spring (not shown) as to be preferably contacted with the development roller 15. The development roller 15 of a conventional non-contact development device 10 is formed of aluminum which has a relatively small work function (up to 4 eV) and can easily emit secondary electrons, and a spark discharge is easily generated between the development roller 15 and the photosensitive layer 21.

The surface of the development roller 15 is coated with ion conductive fluoride resin having a work function up to 8 eV or higher, a secondary electron emission rate of up to 4 or less and a volume resistivity of $10^6$ to $10^8$ Ωcm at a thickness of 10 to 100 μm. This development roller 15 is used to reduce an electron emission amount due to a high electric field between the photosensitive layer 21, and hence a spark discharge can be prevented at a highland where the atmospheric pressure is low and dry. Even when a discharge is generated between the photosensitive layer 21 and the development roller 15, discharged charge is stored on the resistance layer 19 of the development roller 15, potentials of both are immediately equalized to stop discharging.

Figure 10C:
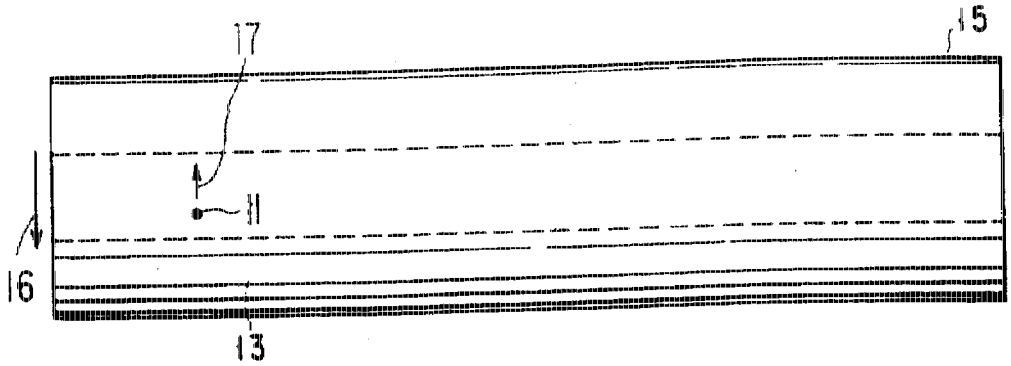
FIG. 10C is a view of peeling toner from peeling wire on a development roller.

FIG. 10C shows a state of peeling of the toner 11 on the development roller 15. As shown in FIG. 10C, the peeling wire 13 peels the toner 11, in a direction of an arrow 17, on the development roller 15, moving in a direction of an arrow 16, and hence the physical adhering strength to the development roller 15 of the toner 11 is not operated. As a result, the toner 11 is moved only by an electrostatic force operated between the photosensitive layer 21 and the peeling wire 13. Accordingly, the toner 11 of the particle size distribution is peeled from the development roller 15, and development is started only by the force of the electric field irrespective of the magnitude of the particle size.

Figure 10D:
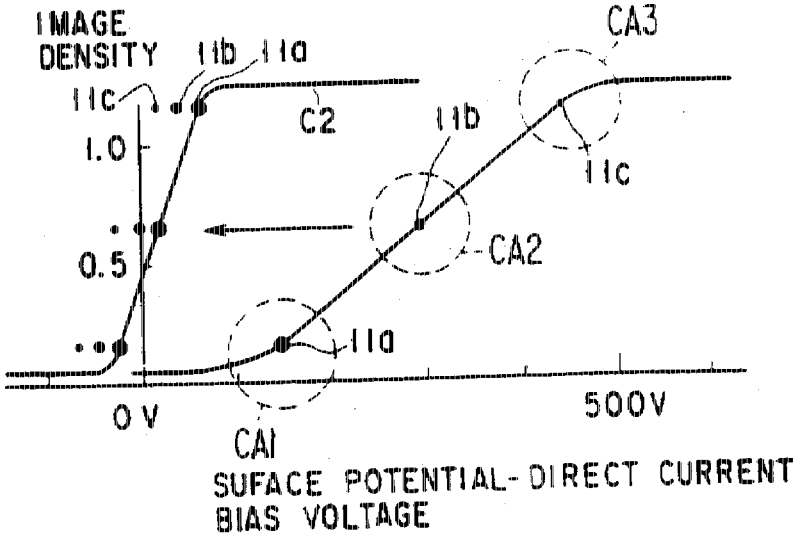
FIGS. 10D and 10E are developing characteristic diagram by the development device of the present invention.
Figure 10E:
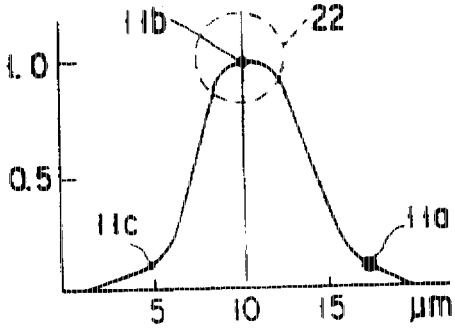

The developing characteristics of the conventional development system is shown by FIGS. 10D and 10E. In the case where the physical adhering strength at the time of high humidity is large on the order of $1\times10^{-7}$ (N), the toner 11*a* having large particle size and large charge amount contributes to development on a low density area CA1 of a low electrostatic contrast, and the toner 11*b* having a maximum distribution 22 contributes to the development on a halftone area CA2.

Further, fine toner 11*c* contributes to development on an area CA3 having a large developing electric field.

As described above, since the toner 11*a* having the large particle size and large density is used to develop the low density area CA1, an image is rough. The physical adhering strength of the toner 11 mechanically peeled from the development roller 15 does not contribute to the development device 10 according to the first embodiment, but becomes developing characteristic of abrupt rise. Since the toners 11*a*, 11*b* and 11*c* having different particle sizes contribute to the development with all electrostatic contrasts, a delicate image without roughness is obtained by the fine toner 11*a* on the low density area CA1.

A second embodiment of the present invention will be described by referring to FIGS. 11A and 11B.

The second embodiment applies different bias voltages to a peeling wire 13 and a development roller 15, forms a local toner moving electric field near the peeling wire 13 on the development roller 15, and facilitates movement of the toner 11. The peeling wire 13 is coated with insulating (or resistive) resin such as epoxy resin or the like to insulate from the development roller 15.

Figure 11A:
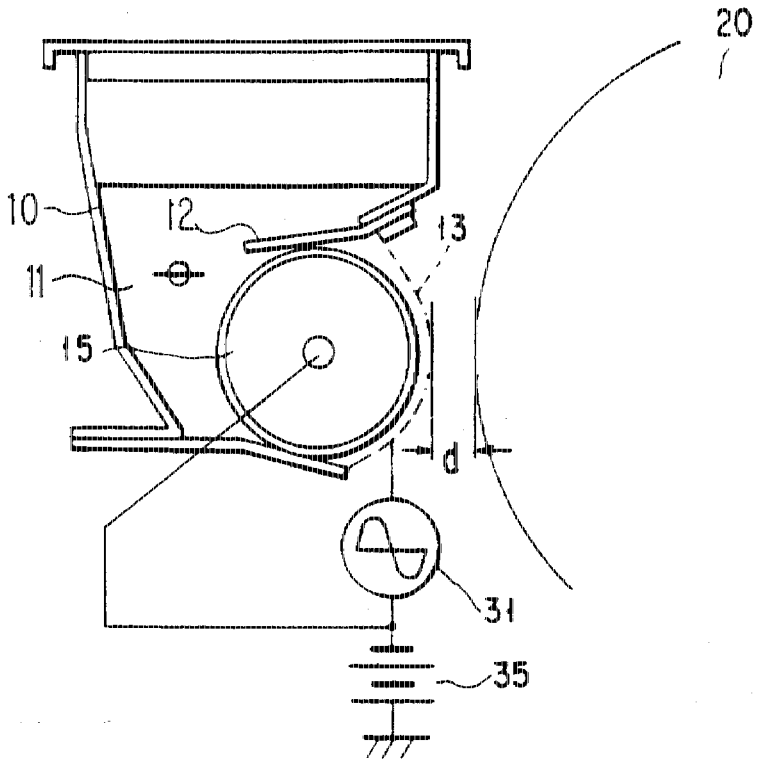
FIG. 11A is a view showing a method for applying a voltage of the development roller and the peeling wire at a relative position between the development device and the photosensitive drum.
Figure 11B:
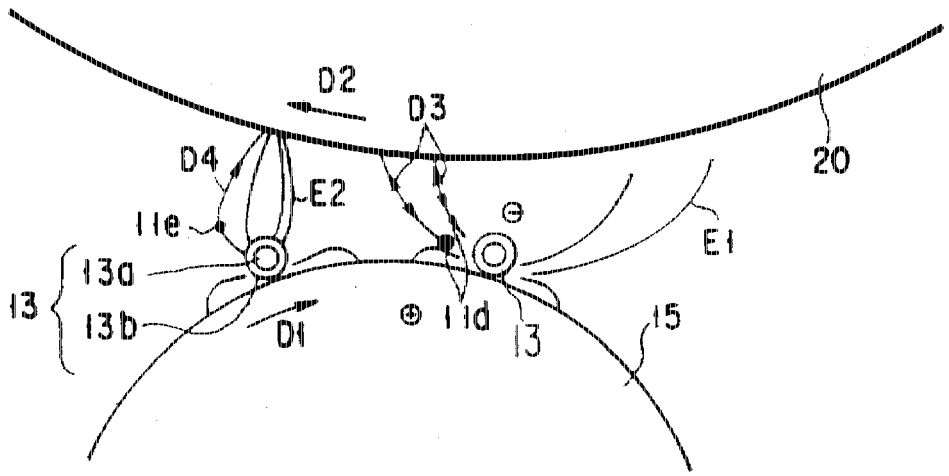
FIG. 11B is a view showing an operation of a second embodiment.

FIG. 11A is a view showing a relative position between a development device 10 and a recording drum 20, and a method for applying a voltage to the development roller 15 and the peeling wire 13. The same reference numerals as those in FIG. 10A are used to indicate the similar or corresponding components, and a detailed description thereof will be omitted.

A voltage of a DC bias power source 35 is applied to the development roller 15, and voltages of a DC bias power source 35 and an AC bias power source 31 are superposed to be applied for moving the toner 11 to the peeling wire 13.

More specifically, the DC bias voltage of −550 V is applied to the development roller 15, and the AC bias voltage of a frequency of 2 kHz and a voltage of 1.5 kVpp is superposed to the DC bias voltage of the development roller 15 and applied to the peeling wire 13. A distance d between the peeling wire 13 and the recording drum 20 is set to about 100 μm.

The operation of the second embodiment will be described by referring to FIG. 11B.

The peeling wire 13 is used by coating it with epoxy resin 13*b* of a thickness of 20 μm to the periphery of a tungsten wire 13*a* of a diameter of several tens μm. When a surface potential of a white area of the photosensitive layer 21 is −600 V by precharging, lines E1 of electric force are generated between the peeling wire 13 and the photosensitive layer 21, toners 11*d* of large and small particle sizes are reciprocated as shown by an arrow D3 along the lines of electric force by an AC electric field near the peeling wire 13, and are not adhered to the photosensitive layer 21. The lines E2 of electric force are generated near the peeling wire 13 on an image area of 200 V of the electrostatic contrast with a surface potential of the photosensitive layer 21 of −400 V, the peeled toner 11*e* is flown in a direction D4 of the photosensitive layer 21, and developed. The lines E1 and E2 of electric force exhibit a variation responsive to the electrostatic latent image, and the AC voltage is applied to the peeling wire 13 to be developed according to the size of the electrostatic latent image, and hence the toner 11 is not adhered to the wire.

As described above, when the low electrostatic contrast development is performed, extension of optical carrier in the photosensitive layer 21 due to interference with the electrostatic latent image can be prevented to improve a picture quality.

A third embodiment of an electrostatic recording apparatus according to the present invention will be described by referring to FIGS. 12A and 12B.

Figure 12A:
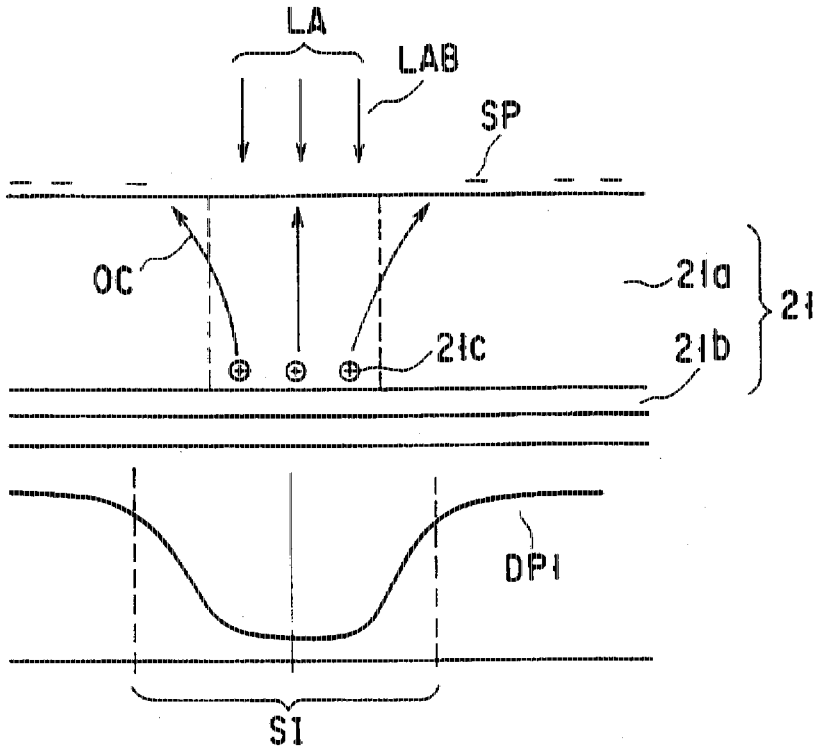
FIGS. 12A and 12B are views for explaining a third embodiment of the present invention.
Figure 12B:
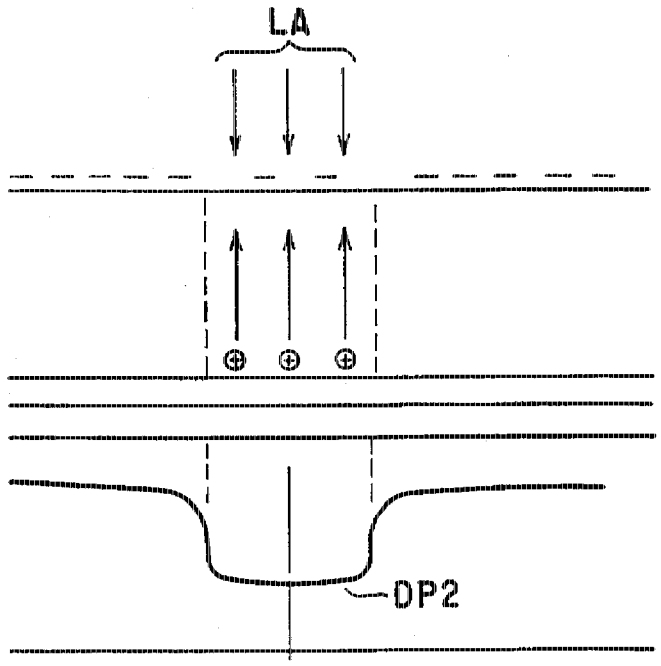

FIG. 12A shows an optical carrier orbit in a photosensitive layer 21 of the case that an electrostatic contrast is high to 400 V or higher. An irradiated light LA passed through a transparent carrier transport layer (CTL) 21*a* of an organic photosensitive layer 21 and generates (+) carrier 21C in response to an optical intensity on a carrier generating layer (CGL) 21*b*, moves by an electric field of (−) charge SP on the surface of the photosensitive layer 21, vanishes the charge, and forms an electrostatic latent image.

The orbit OC of the carrier is bent by the interference between a repelling force of spatial charge of the carriers 21*c* themselves and the electric field of the electrostatic latent image, the electrostatic latent image is increased from a light emitted area SI, and a potential distribution DP1 on the photosensitive layer 21 is extended. When an intensity of irradiating light is reduced to ½ or less of conventional value and optical carrier is reduced, mutual interference due to spatial charge is decreased, the electrostatic contrast is reduced to 200 V or less, and mutual interference between the optical carrier and the electrostatic latent image is diminished.

As described above, as shown in FIG. 12B, the orbit OC of the optical carrier in the photosensitive layer 21 is not bent by the low electrostatic contrast, and the surface potential DP2 of the light irradiated area SI is lowered to prevent the extension of the electrostatic pixel. The non-magnetic one-component development system is adapted for the development system for developing this low electrostatic latent image with sufficient density and contributing to the development by the fine toner 11 on the low density area.

Formation of an image sets a surface potential of the photosensitive layer 21 to −600 V by precharging, sets the DC bias voltage of the development roller 15 to −550 V, superposes the AC bias voltage of a frequency of 2 kHz and a voltage of 1.5 kVpp to the DC bias voltage of −550 V to be applied to the peeling wire 13 and the development roller 15, and reciprocates to move the toner 11 between the photosensitive layer 21 and the peeling wire 13. The coating rate of the toner 11 on the development roller 15 is set to 0.68, which is smaller than 1.0, and in order to compensate for the image density, the recording drum 20 is rotated at a speed of the development roller 15 of 15 cm/sec., which is faster that the peripheral speed of the recording drum 20 of 10 cm/sec. The image is developed under the conditions by using the toner 11 of 6 μC/g of charge amount to obtain the same developing curve C2, shown in FIG. 10*d*, as that of the first embodiment.

As described above, a potential difference between the surface potential of the photosensitive layer 21 and the development roller 15 can be lowered with the low electrostatic contrast, and discharge between the photosensitive layer 21 and the development device 10 at a highland can be suppressed. The above-described developing method is effective for the ion depositing recording for forming an electrostatic latent image by controlling ions together with dots to reduce an interference between an ion flow and the electrostatic latent image, thereby improving a picture quality.

A fourth embodiment of the present invention of a bias voltage to be applied to a development roller 15 and a peeling wire 13 will be described by referring to FIGS. 13A to 13D.

Figure 13A:
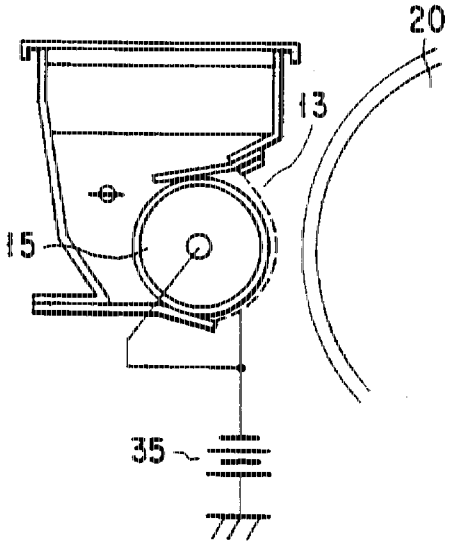
FIGS. 13A to 13D are views showing a method for applying a bias to the development device according to a fourth embodiment of the present invention.

FIG. 13A is a view showing a first applying method for applying a DC bias voltage 35 of −550 V to a peeling wire 13 and a development roller 15.

A surface potential of a recording medium is set to −600 V on a white area by precharging, attenuated to −400 V on a black area by irradiating it with a light, and an electrostatic contrast is set to 200 V. With such low electrostatic contrast, there is no interference between optical carrier and an electrostatic latent image in the photosensitive layer 21, and there is no extension of an electrostatic pixel due to bending of the carrier orbit. The (−) toner 11 on the development roller 15 is mechanically peeled irrespective of the particle size of the toner 11, and is used for an inverted development. The peeled toner has no physical adhering strength to the peeling wire 13, but is developed only with an electrostatic force, and the development stable for the environment is performed. The toners 11 of large and small particle sizes peeled mechanically contribute to the development, thereby to obtain a smooth and delicate fine image.

Figure 13B:
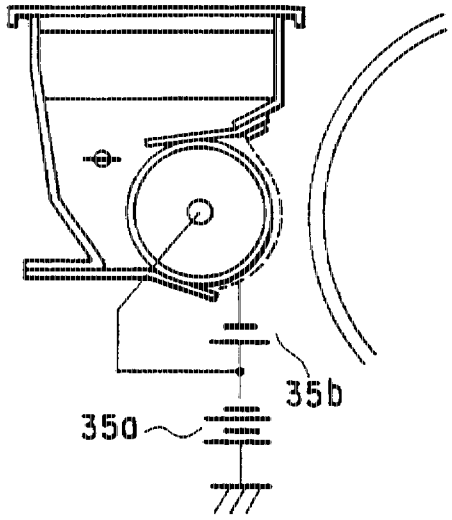

FIG. 13B is a view showing a second applying method for applying a DC bias for repelling the toner 11 on the development roller 15 to the peeling wire 13.

The DC bias voltage 35*a* of −400 V is applied to the development roller 15 for mainly conveying the toner 11, and the DC bias voltage 35*b* of −150 V is superposed to be applied to the peeling wire 13. The white area of the photosensitive layer 21 is set to a surface potential of −600 V by precharging, and the black area is set to −400 V by irradiating it with a light, and the electrostatic contrast is 200 V of no extension of the electrostatic latent image. The development is conducted by a developing bias of −550 V to be determined by the peeling wire 13. The (−) toner 11 mechanically peeledby the peeling wire 13 of the development device 10 is repelled to the development roller 15 by the high bias voltage of the peeling wire 13, the movement of the toner 11 is facilitated to be used for inverting development.

As described above, the peeled toner does not have the physical adhering strength, is controlled only by an electrostatic force between the peeling wire 13 and the photosensitive layer 21, thereby performing the development stable for the environment. At this time, the fine toner 11 also contributes to the development to obtain a smooth and delicate fine image. When the distance between the peeling wires 13 is set shorter than a distance to the photosensitive layer 21, the bias voltage to be operated for developing becomes the peeling wire voltage of −550 V. In the rough case, the developing bias voltage to be operated or the development is lowered as compared with −550 V of the peeling wire voltage, and the voltage of the development roller 15 is regulated to be larger than −400 V.

Figure 13C:
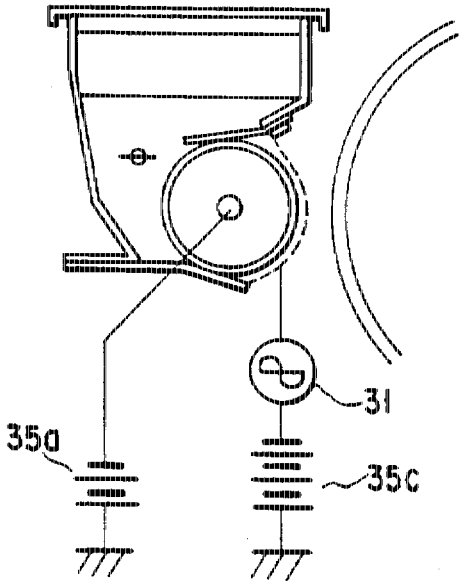

FIG. 13C is a view showing a third applying method for applying the DC bias voltage 35*a* of −400 V to the development roller 15, and superposing the DC bias voltage 35C of −550 V higher than the developing roller 15 to the AC bias voltage 31 of a frequency of 2 kHz and a voltage of 1.5 kVpp for vibrating the toner 11 to be applied to the peeling wire 13. The inverting development (−) toner 11 on the development roller 15 is mechanically peeled from the development roller 15 by the peeling wire 13, simultaneously vibratedby the AC voltage of the peeling wire 13, and simultaneously reciprocated to the photosensitive layer 21 for development.

Figure 13D:
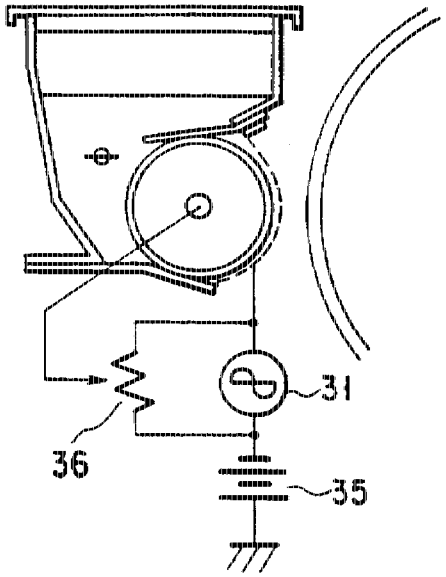

FIG. 13D is a view showing a fourth applying method for applying a voltage obtained by superposing the DC voltage 35 of −550 V to the AC voltage 31 of a frequency of 2 kHz and a voltage of 1.5 kVpp to the peeling wire 13, superposing the AC voltage of 1 kVpp lower than the peeling wire 13 to the peeling wire by voltage regulating means 36 to be applied. The inverting development (−) toner 11 is mechanically peeled from the development roller 15 by the peeling wire 13, simultaneously reciprocated to the photosensitive layer 21 while vibrating on the development roller 15 by the AC voltage for developing.

Figure 14:
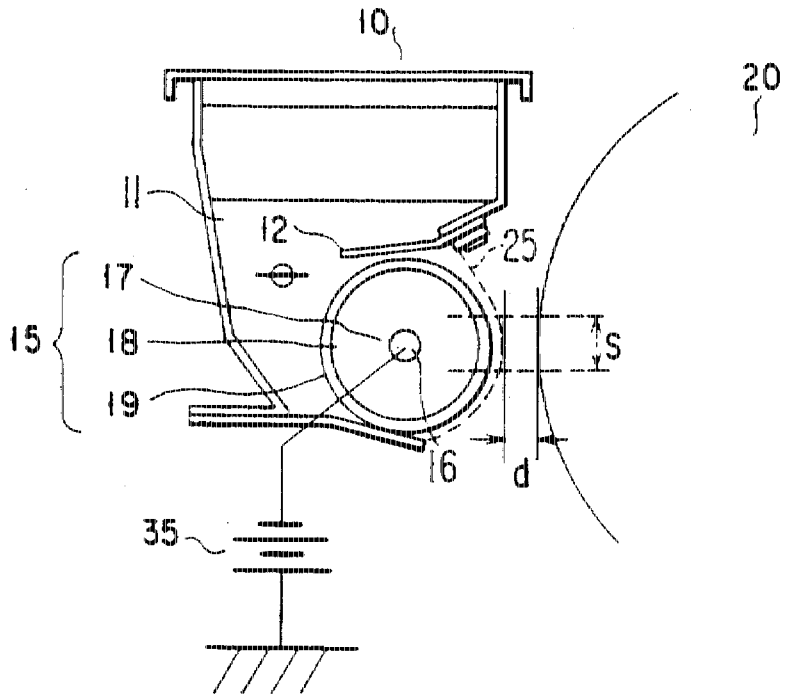
FIG. 14 is a view of a structure of a development device according to a fifth embodiment of the present invention.

A fifth embodiment of the present invention will be described by referring to FIG. 14. FIG. 14 is a schematic view showing a relative position between the one-component development device 10 and a recording medium drum 20 of the present invention.

The development roller 15 has a formable rubber roller 17 provided around a metallic driving shaft 16, a conductive resin layer 18, and a resistive resin layer 19 covering the roller 17. The conductive resin layer 18 is electrically connected to the drive shaft 16 with conductive rubber (not shown) provided at an end of the development roller 15. A recording medium drum having a recording medium of a thickness of 25 μm and a development roller 15 isolated at a distance d of 200 μm exist. The development roller 15 is coated with one or less toner layers having a converging rate k of the toner 11 smaller than 1.0 by a charging blade 12 in the development device 10. The DC bias is applied by the DC bias power source 35 to the development roller 15.

Figure 15:
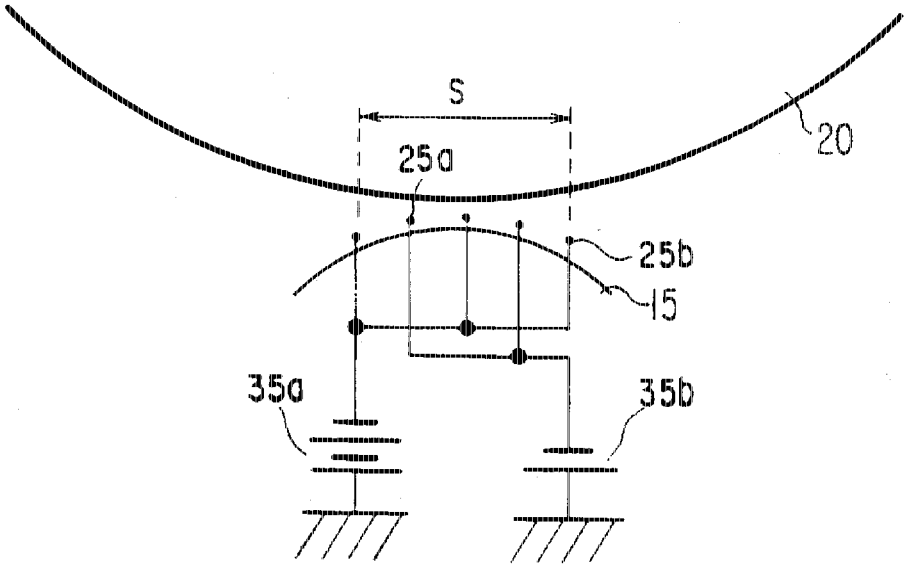
FIG. 15 is a schematic sectional view of a development device and a recording medium.

The bias voltage to be applied to the metal wire 25*a* and 25*b* will be described by referring to FIG. 15.

Metal wires 25*a* and 25*b* to which the bias voltage of the different first and second bias voltage sources 35*a* and 35*b* are alternately applied are provided in parallel with the development roller 15 on an area S to be developed (also shown in FIG. 14). When the toner 11 is moved on the development roller 15 by an electric field parallel to the development roller 15 generated between the metal wires 25*a* and 25*b*, physical adhering strength of moisture is reduced by reducing a contact area between the toner 11 and the development roller 15 or peeling from the development roller 15. As a result, the toner 11 is easily moved in a direction of the recording medium only by an electric field due to the electrostatic latent image of the recording medium 20 and the development roller 15. The metal wires 25*a* and 25*b* employ tungsten wires of a diameter of several tens μm.

An electrostatic force to be operated at the toner 11 will be described by referring to FIGS. 16A and 16B. FIG. 17 shows a potential between the recording medium 20 having the electrostatic latent image, the development roller 15 and the metal wires 25*a* and 25*b*.

The recording medium is set at a surface potential to −600 V by precharging, and an image area S is set to 200 V by an electrostatic contrast of −600 V. The DC bias voltage of −550 V is applied to the development roller 15, and DC voltages of −280 V and −880 V are applied to metal wires 25*a*, and 25*b* on the development roller 15. As the development roller 15 and the recording medium move, a potential for reciprocating the toner 11 on the development roller 15 between the development roller 15 and the recording medium is operated.

Figure 16A:
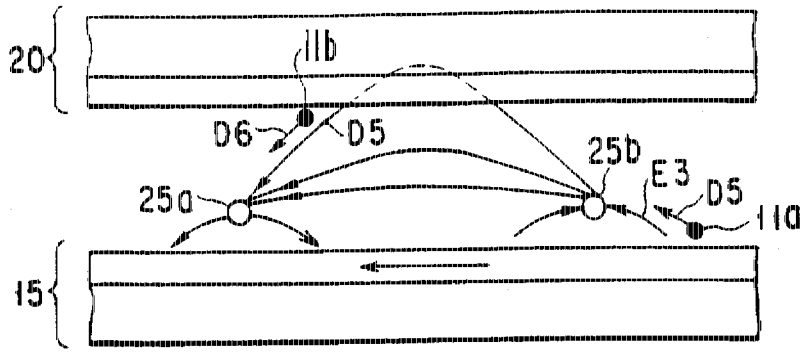
FIGS. 16A and 16B are views showing a state of force between the development roller and the recording medium.
Figure 17:
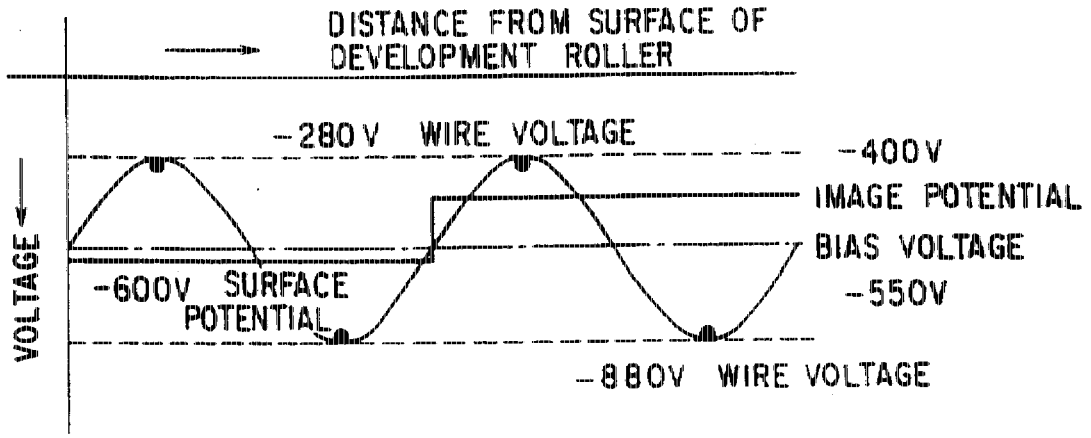
FIG. 17 is a view showing a potential between a recording medium having an electrostatic latent image, a development roller and a metal wire.

FIG. 16A shows movement of the toner 11*a* of the white area of −600 V of a surface potential, the toner 11*a* coating the development roller 15 is moved horizontally and vertically (D5 direction) by lines E3 of electric force generated by a strong electric field generated near the peeling wire 25*b* applied by −880 V, and arrive at the recording medium. The toner 11*b* arriving at the recording medium arrives at the metal wire 25*a* applied by the bias voltage of −280 V as the recording medium is moved, and moved in a direction of the development roller 15 from the recording medium by a reverse electric field by the wire (D6 direction). When the development roller 15 is moved in this manner, the toner 11*b* is reciprocated between the development roller 15 and the recording medium, and developed.

Figure 16B:
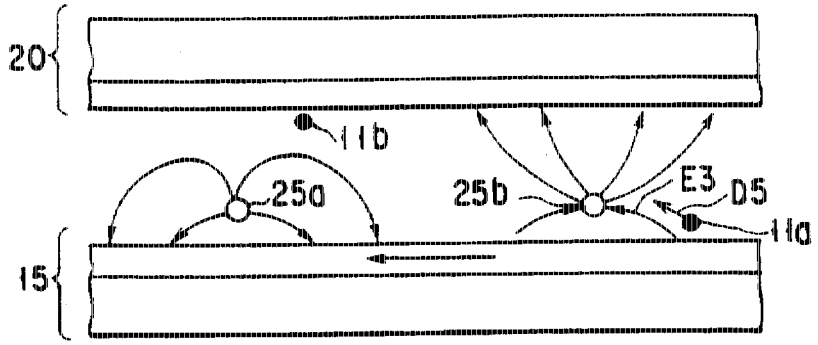

FIG. 16B shows an image area of −400 V of a surface potential on the recording medium.

The toner 11*a* peeled by the strong electric field E3 of the metal wire 25*b* applied by −880 V is moved in a direction of the recording medium of −400 V of the surface potential (D5 direction). Thus, the toner 11*b* moved and adhered to the recording medium is effected by a force in a direction of the development roller 15 by the metal wire 25*a* applied by the voltage of −280 V. However, its electric field is small, and the toner 11*b* remains on the recording medium by the physical adhering strength and the image force of the toner 11*b* to be developed. Thus, the toner 11*a* moved by the electric field of the wire on the development roller 15 is reduced for the physical adhering strength, and only the charge force to be determined by the particle size of the toner 11*a* is operated. The peeling wires 25*a* and 25*b* may be formed of tungsten or other metal of several tens μm or a stainless steel wire of several tens μm. The wires 25*a* and 25*b* may be coated with insulating or resistive resin such as epoxy resin.

Figure 18:
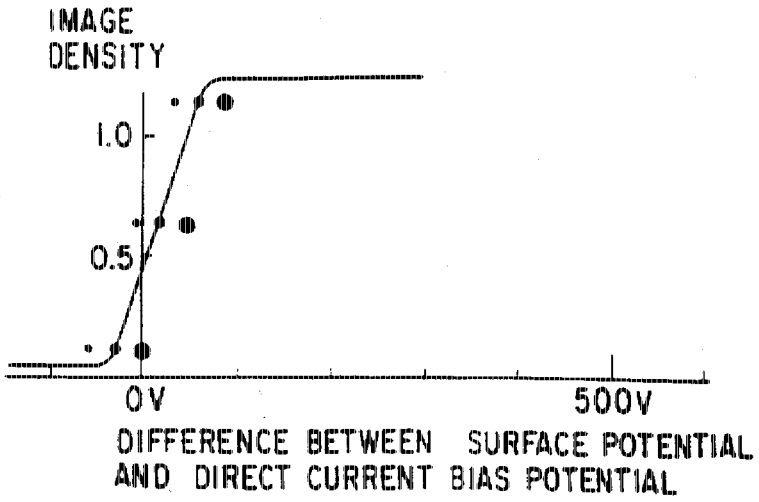
FIG. 18 is developing characteristic diagram.

Since the development roller 15 formed of metal of conventional noncontagious development device 10 has a relatively small work function (up to 4 eV) and can easily emit secondary electrons, a spark discharge is easily generated between the development roller 15 and the recording medium at a highland where the atmospheric pressure is low and dry. When the surface of the development roller 15 is covered 10 to 100 μm with ion conducive fluorine resin having a work function up to 8 eV, a secondary electron emission rate up to 4 or less and volume resistivity of $10^6$ to $10^8$ Ωcm, the spark discharge can be prevented. Even if environmental conditions are deteriorated and discharge is generated, discharged charge is stored in the resistance layer 19 of the development roller 15, and the discharge is immediately stopped. Thus, when the toner 11 is moved only by an electrostatic force between the recording medium and the peeling wire, developing characteristics shown in FIG. 18 are obtained, all the toners 11 having particle size distribution on the development roller 15 are moved only by the electric field, and the toner 11 is not selectively set in the image density by the particle sizes.

A sixth embodiment of the present invention will be described by referring to FIGS. 19A to 19D. The sixth embodiment will be described in terms of conditions for reciprocating the toner 11 effectively between the development roller 15 and the recording medium 20 when different voltages are applied to adjacent metal wires.

Figure 19A:
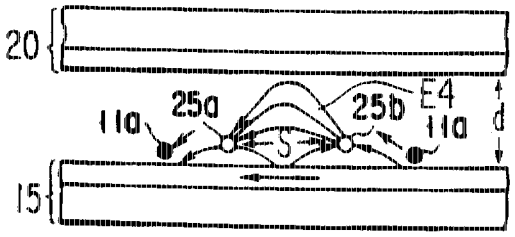
FIGS. 19A to 19D are views for explaining a sixth embodiment of the present invention.
Figure 19B:
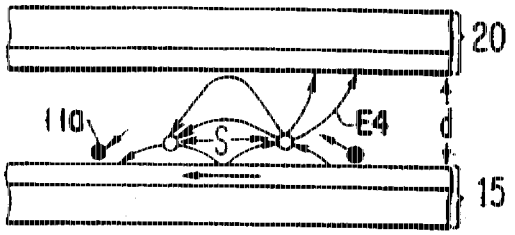

FIGS. 19A and 19B show the case where an interval S (50 μm) between the wires is shorter than a distance d (100 μm) between the development roller 15 and the recording drum 20.

The case where there is no electrostatic latent image on the recording medium and a surface potential is set to −600 V is shown in FIG. 19A. A strong electric field is formed between the metal wire 25*a* and the metal wire 25*b* on the development roller 15 to be applied by different voltages, and the electric field for moving the toner 11 reaching the recording medium from the developing roller 15 does not arrive at the recording medium. Therefore, the toner 11 flown from the development roller 15 by the strong electric field of the metal wire 25*b* applied by −880 V does not arrive at the recording medium, but is returned to the development roller 15 (toner 11 movement shown by E4).

A portion of the toner 11*a* arrives at the recording medium by lines E4 of electric force of the portion arriving at the recording medium from the development roller 15 on an image area of a surface potential of −400 V of the recording medium shown in FIG. 19B, but most toner 11 is returned to the development roller 15, and image density is reduced.

Figure 19C:
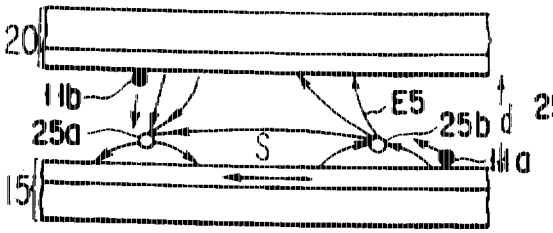
Figure 19D:
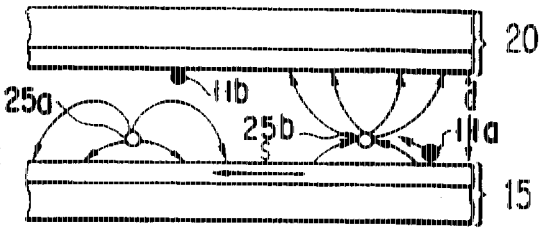

FIGS. 19C and 19D show the case where an interval between the metal wires is 150 μm to be longer than a distance between the development roller 15 and the recording drum 20.

Most of the toner 11*a* on the development roller 15 arrives at the recording medium by lines E5 of electric force by the strong electric field of the metal wire 25*b* applied by the bias voltage of −880 V on a white area shown in FIG. 19C. The toner 11*b* arriving at the recording medium is returned to the development roller 15 by the reverse bias of −280 V applied to the metal wire 25*a*, and no fog is generated on the white area.

The toner 11*a* on the development roller 15 arrives at the recording medium by the electric field of the metal wire 25*b* applied by the forward bias of −880 V on the image area of a surface potential of −400 V of FIG. 19D. The electric field by the metal wire 25*a* of the reverse bias of −280 V is low, and the toner 11*b* of the recording medium is not returned to the development roller 15, but the development is finished. When the distances between the adjacent wires is longer than a distance d between the development roller 15 and the recording drum 20, the electric field is effectively operated at the toner 11 to be developed.

A seventh embodiment of the present invention will be described by referring to FIGS. 20A and 20B.

In the seventh embodiment, a development system for contacting the metal wire with the development roller 15 and forcibly peeling the toner 11 on the development roller 15 will be described.

Figure 20A:
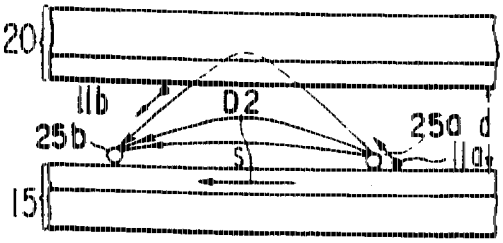
FIGS. 20A and 20B are views for explaining a seventh embodiment of the present invention.

FIG. 20A shows the state that the toner 11 on the development roller 15 is mechanically peeled by the metal wire contacted with the development roller 15 and is moved in a direction of the recording medium by a bias voltage applied to the metal wire. Tensions are applied to both ends of the metal wire by a spring (not shown) to assure the contact with the development roller 15. In order to insulate the resistive resin layer of the development roller 15, the metal wire is coated with insulating or resistive resin layer such as epoxy resin. The toner 11*a* is mechanically contacted with the metal wire 25*a* on the development roller 15 moving in a D1 direction and moved on the development roller 15. The toner 11*a* moved in this manner is reduced for the physical adhering strength with the development roller 15, and easily moved to the recording medium by the surface potential of the white area of −600 V by precharging and the forward bias voltage of the metal wire. When the toner 11*b* moved on the recording medium is moved close to the metal wire 25*b* applied by the bias voltage of −280 V, reversely flown in a direction of the recording medium to prevent fogging.

The toner 11 flown from the development roller 15 is moved in the same manner as that of the fifth embodiment on the image area of −400 V, and developed.

Figure 20B:
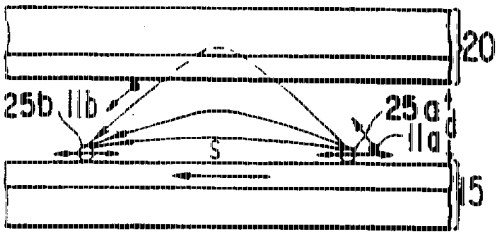

In FIG. 20B, metal wires 25*a*, and 25*b* contacted with the development roller 15 are vibrated by an ultrasonic vibrator (not shown), and the toner 11*a* on the development roller 15 is forcibly peeled from the development roller 15. The peeled toner 11*a* is reduced in the physical adhering strength to the development roller 15, the toner 11*a* on the development roller 15 is moved to the recording medium by the bias voltage of 880 V applied to the metal wire 25*a* on the white area of −600 V to be easily moved in a direction of the recording medium by the bias voltage applied to the metal wire, and the toner 11*b* on the recording medium is returned to the development roller 15 by the bias voltage of −280 V of the adjacent metal wire 25*b*. The white area in which no fog is generated by the cleaning operation is formed. At this time, a reverse bias voltage of −580 V very near the surface potential by precharging is applied to the development roller 15.

The toner 11*a* peeled on the development roller 15 is moved in a direction of the recording medium by an ultrasonic wave of the metal wire by the voltage of −880 V of the forward bias voltage and −400 V of the image area on the image area of 400 V. Since a reverse electric field between the reverse bias voltage of −280 V of the metal wire and the −400 V of the electrostatic latent image is low, the toner 11*a* moved to the recording medium is not returned to the development roller 15, but the development is finished. According to the development system as described above, the development of the low electrostatic contrast and physical adhering strength of the fine toner 11 is released to obtain a wooden fine and smooth image on a low gradation area.

An eighth embodiment of the present invention will be described by referring to FIGS. 21 and 22.

The eighth embodiment is applied to the development roller 15 and the peeling wires 25*a* and 25*b*.

Figure 21:
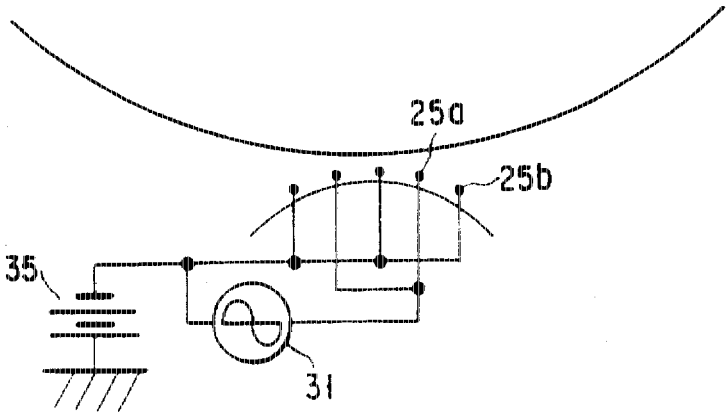
FIGS. 21 and 22 are views for explaining an eighth embodiment of the present invention.

FIG. 21 shows an example in which the same DC bias voltage 35 as −550 V of the development roller 15 is applied to one metal wire 25*b*, and the AC voltage 31 of a frequency of 2 kHz and a voltage of 600 Vpp is superposed to the other metal wire 25*a* to be applied. The toner 11 on the development roller 15 is moved on the development roller 15 by a strong AC electric field between the metal wires 25*a* and 25*b* irrespective of the magnitude of the particle size, the physical adhering strength between both is reduced due to a decrease in a contact area of the toner 11 with the development roller 15, and developed only by an electrostatic force between the recording medium and the development roller 15. Thus, when the physical adhering strength affected by the magnitude of the particle size of the toner 11 is reduced, the development not depending upon the particle size is conducted, and low density image can be smoothly developed with fine wooden pattern. Further, the development stable for the environment is performed due to the reduction in the physical adhering strength depending on the environment with moisture. The AC bias is applied to the above-described metal wire to prevent the toner 11 from being adhered to the wire.

Figure 22:
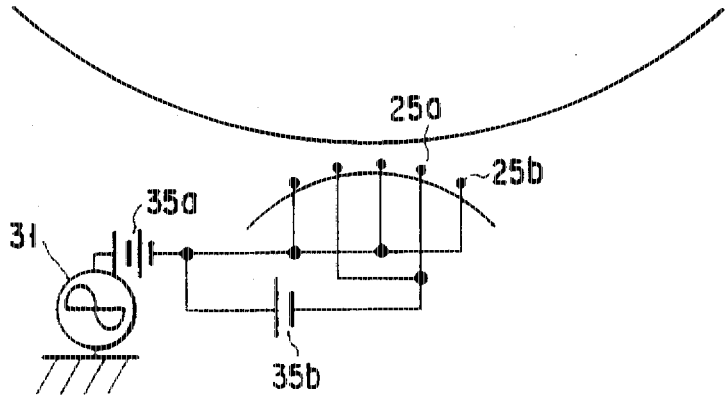

FIG. 22 is a view showing an example in which a bias voltage obtained by superposing the AC voltage 31 of a frequency of 2 kHz and a voltage of −880 Vpp to the DC voltage 35*b* of −280 V to be applied to the development roller 15 and the one metal wire 25*a* and the DC bias 35*a* of −550 V is applied to the other metal wire 25*b*. The toner 11 is moved on the development roller 15 by the DC bias voltage between the metal wires, the toner 11 is reciprocated between the recording medium and the development roller 15 by the AC bias voltage superposed with the DC bias voltage to delicately develop on the low density area stably for the environment.

A ninth embodiment of the present invention will be described by referring to FIG. 23.

Figure 23:
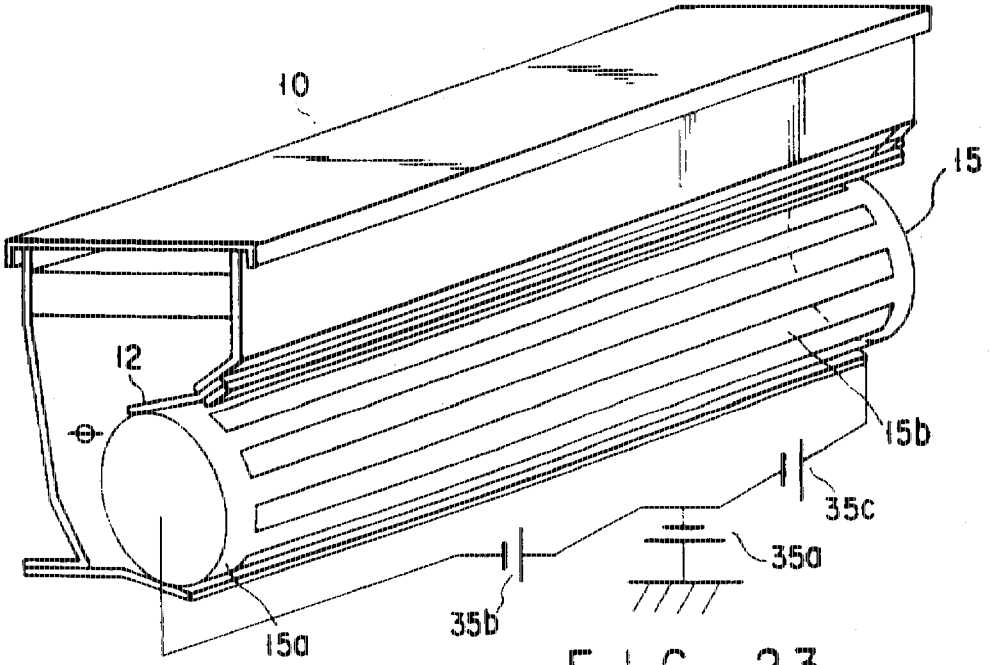
FIG. 23 is a schematic view showing a structure of a development device according to a ninth embodiment of the present invention.

FIG. 23 is a schematic view of a development device 10 according to a ninth embodiment of the present invention. The development roller 15 has a structure in which a metal wire 15*b* insulated by an insulator from a metal roller 15*a* is buried in the metal roller 15*a*. The electrode 15*b* buried in the metal roller 15*a* is electrically conducted with the other end of the development roller 15, and a different bias voltage is applied thereto. The development roller 15 and the surface of the electrode 15*b* are so formed of the same metal material or metal oxide or resin layer as to apply uniform charge to the toner 11 by a frictional charging. A charge is applied to the toner 11 by the charging blade 12 and the development roller 15 is coated with the toner 11. The DC bias voltage 35*a* of about −600 V equal to the surface potential to be applied to the recording medium by precharging, a DC bias voltage 35*b* for moving the toner 11 in a direction of the recording medium to the one electrode, and a reverse polarity bias voltage 35*c* for returning a fog toner on the recording medium to the development roller 15 to the other electrode are applied to the different electrodes on the development roller 15.

Figure 24:
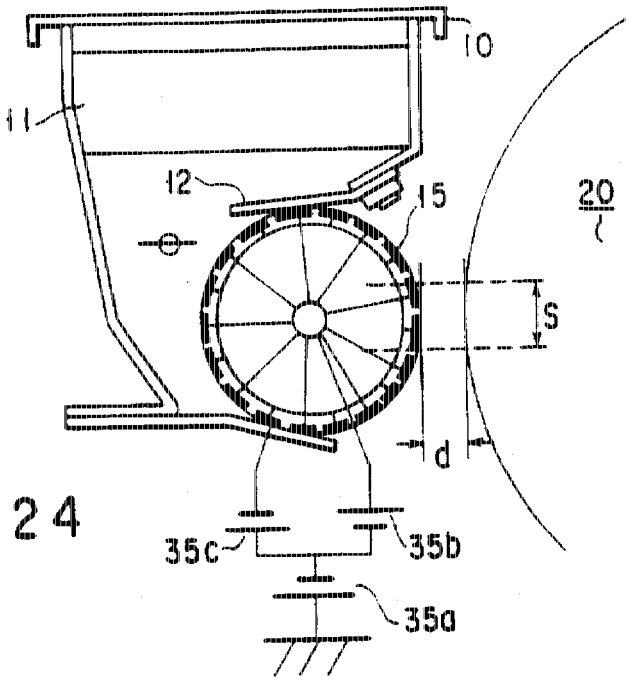
FIG. 24 is a schematic sectional view showing a relative position between a one-component development device and a recording drum.

FIG. 24 is a schematic sectional view showing a relative position between a one-component development device 10 and a recording medium drum 20 according to the recorder of the present invention.

The toner 11 is charged by the charging blade 12 in the development device 10 in which the development roller 15 exists at a distance d of 200 μm to a recording medium drum 20 of a recording medium of a thickness of 25 μm, coated on the development roller 15 and conveyed. Different bias voltages 35*a* to 35*c* are respectively applied to electrodes on the development roller 15. A state of conveying the toner 11 with an electrostatic power for operating the toner 11 will be described by referring to FIGS. 25A to 25C.

Figure 25A:
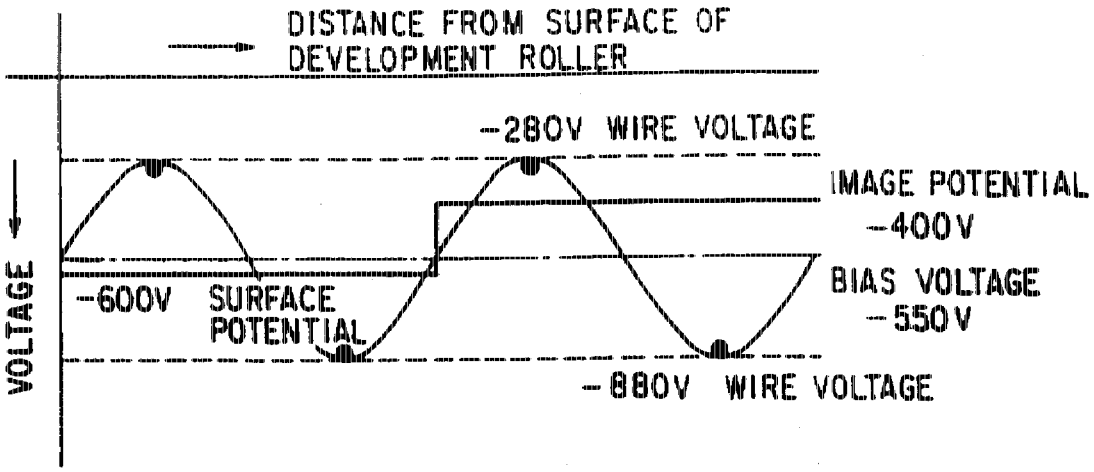
FIGS. 25A to 25C are views of alternate adjacent electrodes connected to apply different bias voltages between adjacent electrodes on the development roller.

FIG. 25A shows the relationship between the and electrode potential on the development roller 15.

A surface potential of −600 V is applied to a non-image area on a recording medium by precharging, and the electrostatic latent image is formed by the surface potential of −400 V on the image area. In order to prevent an interference between the electrostatic latent image and the charge carrier and to eliminate extension of the electrostatic pixel, the electrostatic contrast is set to a low value of 200 V. The DC bias voltage of −300 V for facilitating flying of the toner 11 from the development roller 15 to the recording medium is applied to be superposed to a common bias voltage of −550 V to the one electrode of the development roller 15, and a voltage of −880 V is applied.

In order to remove a fog toner on the non-image area on the recording medium on the other electrode, a voltage of +270 V for forming an electric field of a direction of the development roller 15 is superposed to a common bias voltage. At this time, a plurality of electrodes on the development roller 15 are crossed at the same point on the recording medium on the developed area of the development roller 15 and the recording medium. To this end, the following relationship is set among a moving velocity v of the recording medium, the developing area L, a peripheral speed $v_r$ of the development roller 15, and a period $L_y$ between the electrodes for applying the same bias on the development roller 15:

$$(L/v)<(L_y/v_r)$$

In this manner, the toner 11 is reciprocated between the development roller 15 and the recording medium to obtain a preferable image having no fog. In the case where a recording speed of A4 in size is 10 sheets/min and the developing area is 5 mm, a time (L/v) for passing the developed area becomes 0.1 sec. If the development roller 15 is moved at a peripheral speed of twice as fast as the recording medium, it is necessary to set the period of the electrode to 10 mm or less, at a pitch between the electrodes when the electrodes are disposed at the same pitch to move the electrodes on the development roller 15 of one period applied by different bias voltages on the developed area for the 0.1 sec., and the pitch between the electrodes becomes 5 mm or less if the electrodes are disposed at the same pitch.

Figure 25B:
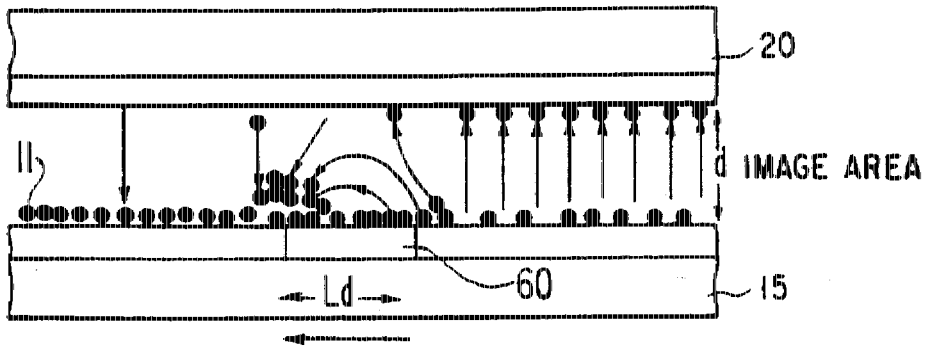
Figure 25C:
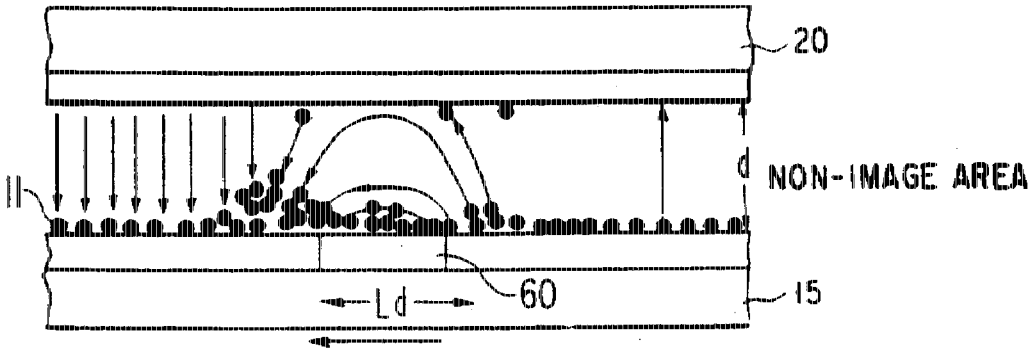

FIG. 25B shows the movement of the toner 11 on the development roller 15 on an image area. A large quantity of charged toner 11 is fixed to the development roller 15 near an insulating film 60 between the electrodes by an edge effect of both the electrodes on the electrodes applied by different bias voltages, and conveyed. In order to eliminate contact of the toner 11 of the multilayer with the development roller 15, it is necessary that the electric field by the edge effect for holding the toner 11 does not reach the recording medium. To this end, the condition is that a distance Ld between the electrodes by the insulating film 60 is shorter than the distance d between the development roller 15 and the recording medium.

The toner 11 on the electrode applied by a bias voltage of −880 V for moving the toner 11 on the development roller 15 in a direction of the recording medium and the toner 11 near the insulating film are flown in a direction of the recording medium by a large potential difference of −480 V between −880 V of the bias voltage and −400 V of the image potential, and developed. Most of the developed toner 11 on the recording medium is not flown to the development roller 15 by a small potential difference of +120 V to −400 V of the image potential on the electrode applied by the bias voltage of −280 V, but is held on the recording medium. Flying of the toner 11 by the small potential difference to be applied by the flying potential of the toner 11 of −280 V is small by the precharging potential of −600 V and the potential difference of −880 V to the toner 11 of the electrode on the development roller 15 applied by the bias voltage of −880 V on the non-image area. Thus, the toner 11 flown to the recording medium is returned to the development roller 15 by a reverse potential of +320 V due to the surface potential difference of the bias voltage of −280 V and −600 V applied to the electrode and no fog is generated.

According to the present invention as described above, a large quantity of toner 11 can be conveyed by the edge effect of the electric field between the adjacent electrodes applied by different voltages, thereby recording at a high speed. Further, the toner 11 electrically fixed by the edge effect has small physical adhering strength, the electrostatic force is released by a reduction in the edge effect at the time of developing, the image is developed only by the static electric field by the electrostatic latent image and the bias voltage, and the electrostatic latent image can be developed by the low electrostatic contrast. An effect of developing the toner 11 and an effect of cleaning unnecessary toner 11 on the recording medium can be obtained by the different bias voltages to the electrodes on the development roller 15, thereby improving picture quality. Further, when a toner supply roller (not shown) for supplying the toner 11 to the development roller 15 is provided in a toner hopper in contact with the development roller 15, the supplying amount of the toner 11 can be stably increased. If this toner supply roller is provided with metal fiber or metal fiber provided with metal oxide and resin layer on the surface, supply of the toner 11 can be further effectively performed.

A tenth embodiment according to a bias voltage to be applied to the development roller 15 and the peeling wire will be described by referring to FIGS. 26 and 27.

Figure 26:
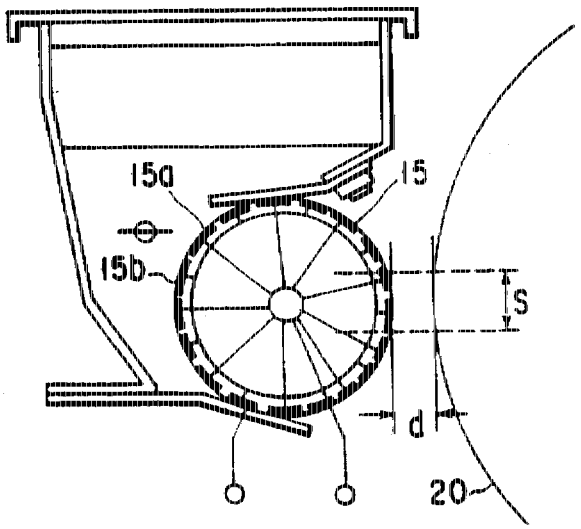
FIG. 26 is a schematic sectional view showing a relative position between a one-component development device and a recording drum.

FIG. 26 is a view in which adjacent electrodes are so alternately connected as to apply different bias voltages between adjacent dielectric electrodes 15*a* and 15*b* on the development roller 15.

Figure 27:
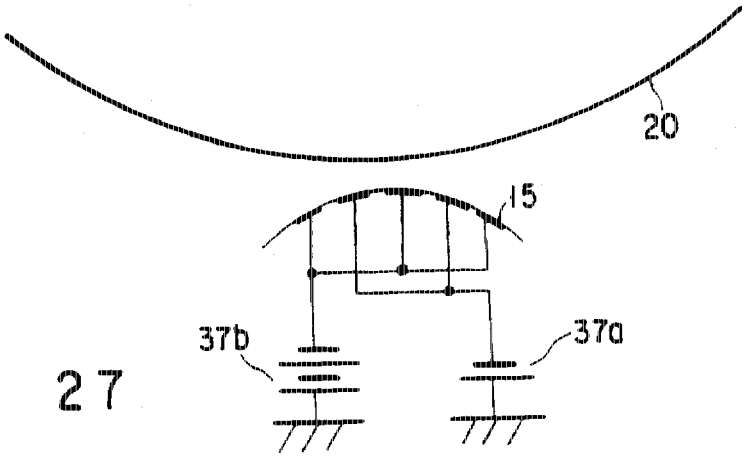
FIG. 27 is a view showing a schematic structure of a tenth embodiment of the present invention.

FIG. 27 is a view showing an example in which different DC biases are applied alternately between the adjacent electrodes. A voltage of −880 V for moving the toner 11 on the development roller 15 in a direction of the recording drum 20 is applied from a first bias power source 37*a*, and −280 V for generating cleaning effect for removing fog toner on the recording drum 20 is applied from a second bias power source 37*b*.

Figure 28A:
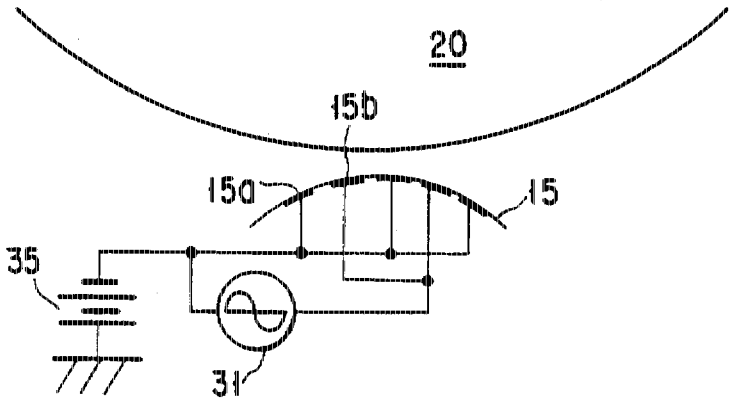
FIGS. 28A and 28B are views showing an example in which special bias voltage and AC voltage are applied to one and the other adjacent electrodes on the development roller.
Figure 28B:
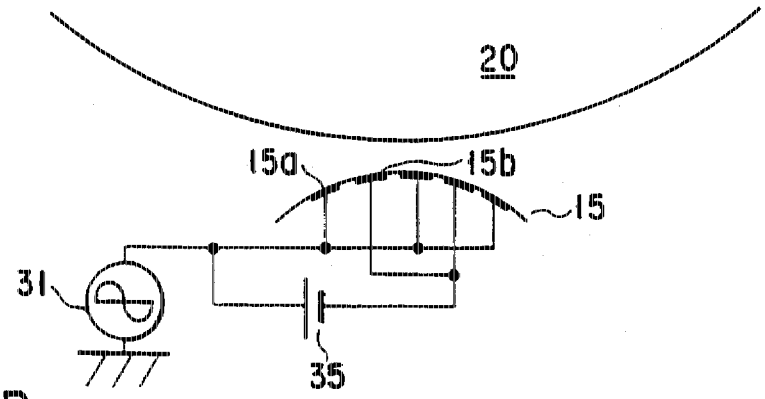

FIGS. 28A and 28B are views showing an example in which a bias voltage 35 of −550 V near a precharging potential on the recording drum 20 is superposed to one adjacent dielectric electrode 15*a* on the development roller 15 and an AC voltage 31 of a frequency of 2 kHz and a voltage of 600 Vpp is superposed to the other dielectric electrode 15*b*.

When the contact area between the toner 11 and the development roller 15 is reduced by moving the toner 11 on the development roller 15 by the AC strong electric field between the adjacent electrodes 15*a* and 15*b* irrespective of the magnitude of the particle size of the toner 11, physical adhering strength between the toner 11 and the development roller 15 is decreased, and developed by an electrostatic force between the recording medium and the development roller 15 to be determined by the DC bias. Thus, the physical adhering strength to be affected by the magnitude of the particle size of the toner 11 is reduced, and developed without depending upon the particle size of the toner 11 to obtain a smooth and delicate image on the low density area. The physical adhering strength depending upon the environment such as moisture is reduced, and the development stable for the environment can be performed. Since the AC bias is applied between the adjacent electrodes, the toner 11 is not adhered between the electrodes, but developed always by new toner 11.

Figure 29:
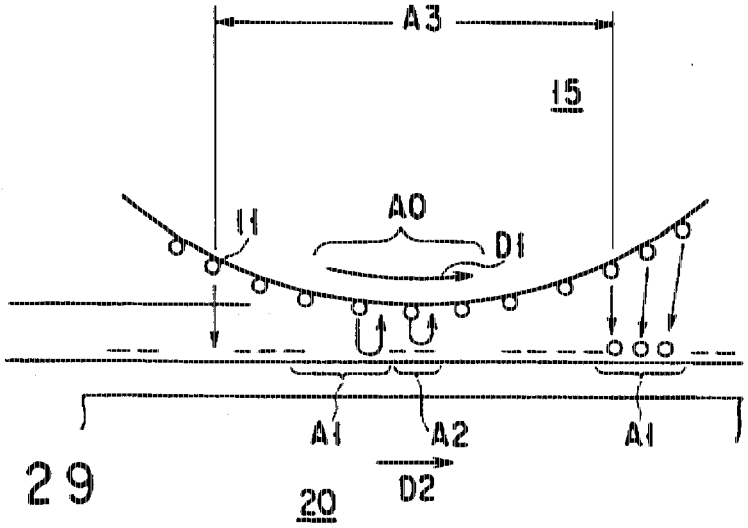
FIG. 29 is a view showing an operation of an electrostatic recording apparatus according to an eleventh embodiment of the present invention.

FIG. 29 is a view showing an operation of the electrostatic developing apparatus according to an eleventh embodiment of the present invention.

The development roller 15 and the recording drum 20 are disposed at a distance of about 100 μm.

A charge is so applied by a charging blade (not shown) in one-component development device that coating rate k of the toner 11 on the development roller 15 is smaller than 1 and the toner 11 is formed in one less layer, and the development roller 15 is with the toner 11. The coating rate k of the toner 11 is a value obtained by dividing the total area of the toner 11 in an arbitrary area on the development roller 15 by its area. The total area of the toner is the multiplication of the area of one particle of the toner 11 by the number of the toner 11 particles. On an area A0 where the development roller 15 and the recording drum 20 are close to each other, the toner 11 is reciprocated by the AC bias voltage between the image area A1 having a low surface potential on the recording drum 20 and a nonimage area A2 having high surface potential. As the development roller 15 is moved as indicated by an arrow D1, flying of the toner 11 is sequentially conducted as explained below.

Flying of the toner 11 is executed in the following order as the development roller 15 and the recording drum 20 approach each other.

On a limit area A3 where the toner 11 separated at the distance between the development roller 15 and the recording drum 20 is flown, the AC bias voltage and the electrostatic contrast (a difference between the electrostatic latent image and the DC bias voltage) are added, and the toner 11 is flown from the development roller 15 in a direction of the recording drum 20. When the development roller 15 and the recording drum 20 are approached, the toner 11 of the image area on the recording drum is returned to the development roller 15.

On the further approached area, the toner 11 of the non-image area A2 having high surface potential on the development roller 15 is flown. Since the flying of the toner 11 to the non-image area A2 does not yet occur in the state that the development roller 15 and the recording drum 20 are approached, the development does not occur. When both are further approached, the toner 11 is flown from the development roller 15 to the non-image area. On the area in which both are most approached, the above developments are all simultaneously excited. That is, the toner 11 is flown reciprocatingly on the non-image area and the image area on the recording drum 20.

As described above, on the area A3 where flying of the toner 11 is limited, the toner 11 is flown from the development roller 15 to the recording drum 20. When the returning operation of the toner 11 from the recording medium adhered with the toner 11 to the development roller 15 is stopped, the quantity of the toner 11 moving to the recording medium becomes a maximum due to the stop of the reciprocation, and developing characteristics are determined according to the distance. When the distance is further increased, the toner 11 remaining on the development roller 15 is moved to the area to be moved to the recording medium direction D2. In order to raise the density of the toner 11 of the image area A1 by the development, i.e., to compensate for the reduction in the image density due to smaller coating rate k of the toner 11 on the development roller 15 than "1", a speed ratio (heretofore merely referred to as "a peripheral speed ratio") p of the moving direction D2 (rotating direction) of the recording drum 20 to the development roller 15 moving at a high speed to the same direction D1 is increased developed with many toner 11 on the development roller 15.

In fact, the coating rate k of the toner 11 on the development roller 15 is set to 0.68, the peripheral speed of the development roller 15 is set to 15 cm/sec., the peripheral speed of the recording drum 20 is set to 10 cm/sec., and the peripheral speed radio p is set to 1.5. At this time, the charge amount of the toner 11 is up to 6 μC/g. The AC bias voltage of a frequency of 2 kHz and a voltage of 1.5 kVpp and the DC bias voltage of −550 V are superposed to the development roller 15. The surface potential of the recording drum 20 is set to −600 V, and the electrostatic contrast of 200 V is formed, and developed.

As described above, if the toner 11 on the development roller 15 is formed on one or less layer, the toner 11 is adhered to the development roller 15 by an electric image force of the toner 11 itself, and a charge repelling force between the toner 11 in the case of the multilayer is eliminated.

Accordingly, influence of the physical adhering strength due to moisture between the toner 11 is small, and a stable image is obtained even at a high and dry place.

In the eleventh embodiment, the AC voltage is used as the means for reciprocating the toner 11 between the development roller 15 and the recording medium. However, another force such as an ultraviolet wave may be used.

Figure 30A:
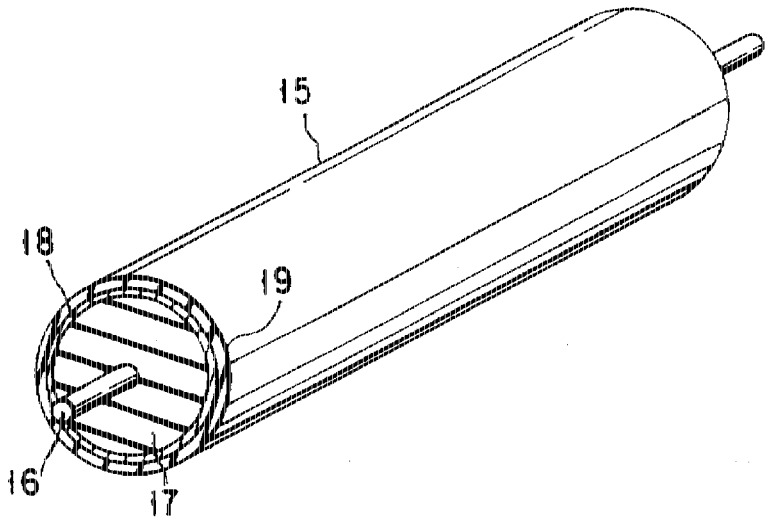
FIGS. 30A to 30C are views showing a structure of a roller to be used for a development roller of an electrostatic recording apparatus according to the eleventh embodiment.
Figure 30B:
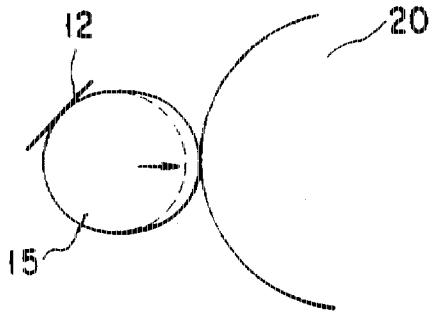
Figure 30C:
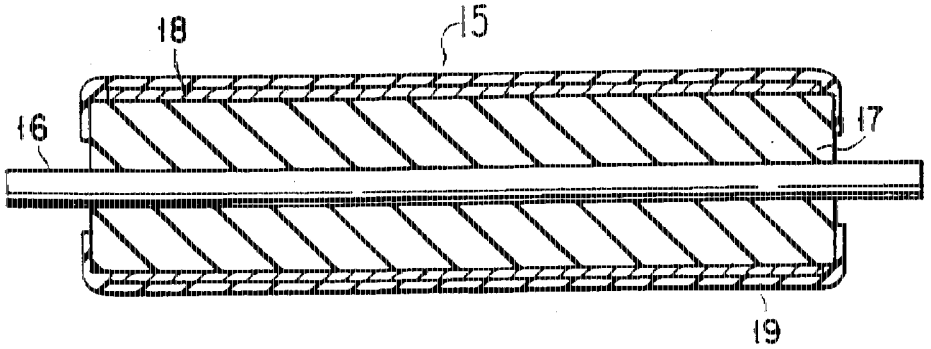

A structure of the roller 15 to be used for the development roller 15 of the developing apparatus of the eleventh embodiment will be described by referring to FIGS. 30A to 30C. FIG. 30A is a sectional view showing a structure of the development roller 15, FIG. 30B is a view showing a state in which the development roller 15 is deformed, and FIG. 30C is a longitudinal sectional view showing a structure of the development roller 15.

The development roller 15 has a conductive rubber roller 17 on a metal driving shaft 16, a conductive resin layer 18 covering the roller 17, and a resistance resin layer 19 covering the layer 18. The development roller 15 of the conventional noncontact developing apparatus is formed of metal such as aluminum.

The discharge is determined according to a work function of the electrode (development roller 15) for discharging and secondary electron emission amount, and readily generated with metal or metal oxide having small work function and large secondary electron emission amount. If the toner 11 contains metal or metal oxide like a magnetic element, the discharge is generated through the toner 11. Therefore, a material except metal having a secondary electron emission rate up to 4 or less and a work function up to 8 eV or more is adapted for the development roller 15. Actually, the surface of the development roller 15 is used with ion conductive fluorine resin having no metal and no metal oxide, and the development roller 15 having a volume resistance of $10^6$ to $10^8$ Ωcm optimum for development is formed. As the toner 11, nonmagnetic toner 11 containing no magnetic material is used.

With the above-described configuration, a discharge voltage is so raised as to be more than a Paschen's discharge curve or more in the case of a metal electrode to increase an allowable range for the sum of the AC bias voltage and the electrostatic contrast.

The conductive rubber roller in the development roller 15 which has a hardness of 30° to 60° having small aging deformation is used. As shown in FIG. 30B, this hardness prevents deformation in a direction of an arrow from a broken line to a solid line of the development roller 15 by the pressure of charging blade 12. In addition, even if the development roller 15 is contacted with the recording medium due to eccentric deviation of the recording medium and the development roller 15, mechanical damage of the recording medium is prevented. With this configuration, discharging is eliminated even at a highland where the atmospheric pressure is low and dry to perform stable non-contact development.

As shown in FIG. 30C, the conductive layer 18 and the resistance layer 19 covering the conductive rubber roller 17 of the development roller 15 are so formed that the conductive layer 18 is shorter than the resistance layer 19 and the resistance layer 19 is bent at both ends of the conductive rubber roller 17, thereby preventing damage of the recording medium by the discharge due to contact of the conductive rubber roller 17 with the recording medium.

Figure 31:
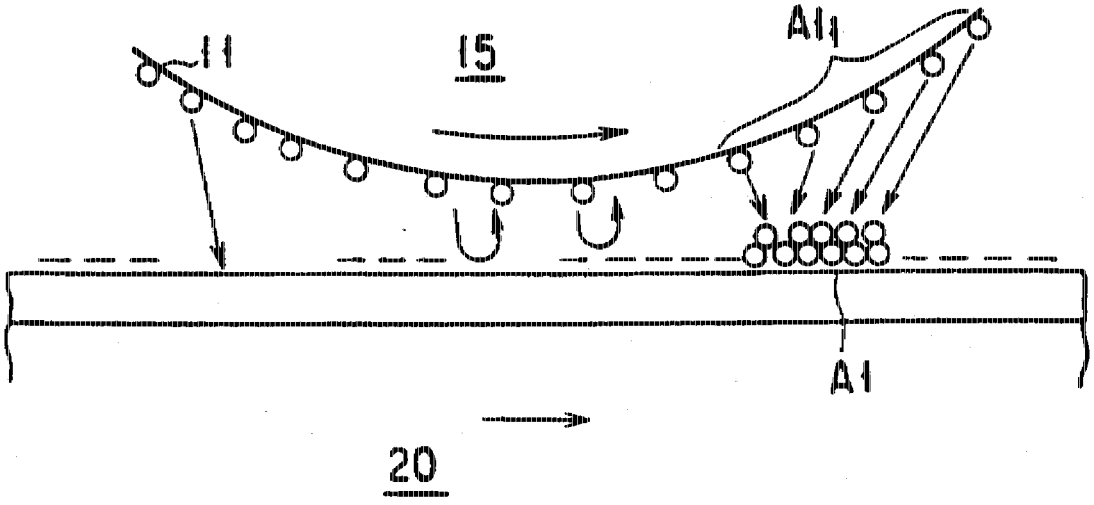
FIG. 31 is a view showing an operation of an electrostatic recording apparatus according to a twelfth embodiment of the present invention.

FIG. 31 is a view showing an operation of the electrostatic recording apparatus according to the twelfth embodiment of the present invention, in which a product of the coating rate k of the toner 11 to the peripheral speed ratio p of the development roller 15 to the recording drum 20 is larger than "1".

In FIG. 31, the peripheral speed of the recording drum 20 is 10 cm/sec., the peripheral speed of the development roller 15 is 30 cm/sec., and the other conditions are the same as those of the eleventh embodiment, and the product of the coating rate k of the toner 11 to the peripheral speed ratio p (k·p) is set to 2. With such a structure, the image area A1 on the recording drum 20 is integrated with the toner 11 of a wide range A11 on the development roller 15 and developed. In this embodiment, the toner 11 is developed in two layers, and hence sufficient image density can be obtained.

Figure 32:
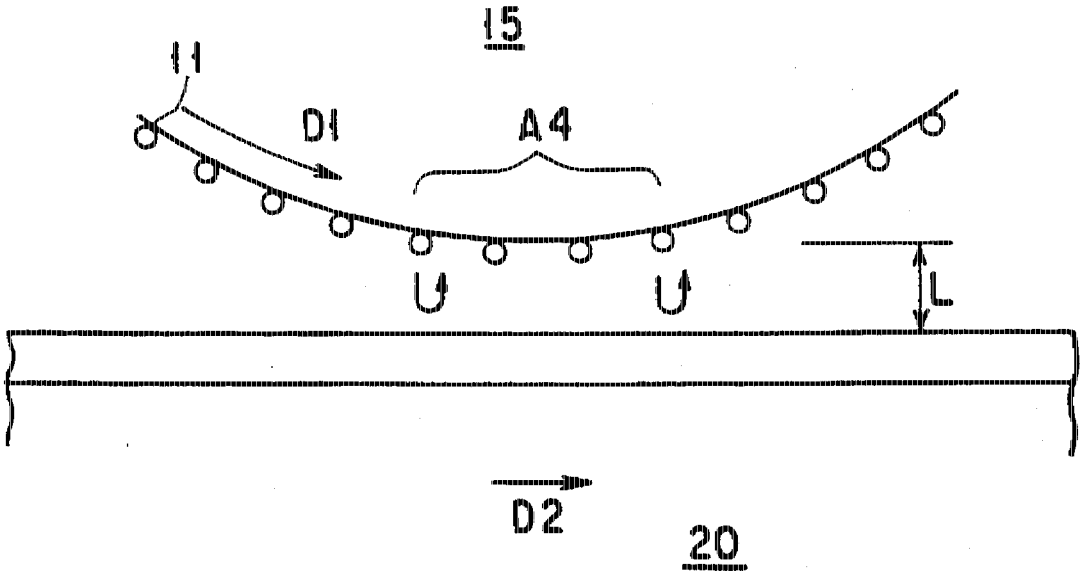
FIG. 32 is a view showing an operation of an electrostatic recording apparatus according to a thirteenth embodiment of the present invention.

FIG. 32 is a view showing an operation of the electrostatic recording apparatus according to a thirteenth embodiment of the present invention.

When the product (k·p) of the coating rate k of the toner 11 to the peripheral speed ratio p is 1 or more, i.e., the time for reciprocating the toner 11 is longer than the time for passing the development roller 15 through the area to be developed as the twelfth embodiment, the reciprocated toner 11 is integrated on the new toner 11 on the development roller 15. When the toner 11 is integrated to form multilayers, the developed image density becomes irregular. Further, the toner 11 is scattered on the development roller 15 having no force for forcibly holding the toner 11 like the recording drum 20 having an electrostatic latent image at a dry highland, and stability of the development is impaired.

Therefore, the time S/v for passing the region A4 (area S) to be developed as reciprocated by the toner 11 by the development roller 15 is set longer than the time $T_{ac}$ for reciprocating the toner 11.

That is, it is set as below.

$$T_{ac}<S/v \quad (1)$$

When the toner 11 is reciprocated many times on the area S to be developed on the development roller 15 under the above condition, the toner 11 is not integrated on the development roller 15, and hence stable development can be executed against variations in the developing density and environment.

The case where the AC voltage is used as means for reciprocating the toner 11 will be described.

When a voltage between peaks is Vpp, the AC bias voltage of the frequency f is applied to the development roller 15, the toner charge amount is $Q_s$, a distance L capable of flying the toner 11 between the development roller 15 and the recording drum 20 is given by the following formula:

$$L=(Q_s \cdot Vpp)^{1/2}/(2 \cdot f) \quad (2)$$

The toner 11 is reciprocated in an area space having a shorter distance between the development roller 15 and the recording drum 20 than the distance L given by the above formula. Then, the time (S/v) for passing the developing roller 15 through the area S at a speed v is reduced smaller than the time $T_{ac}$ (=1/f) for reciprocating the toner 11. The region S is approximately indicated by the following formula by using the distance L for reciprocating the toner 11.

$$S=\{8 \cdot r \cdot (L-Lm) / (1+r/R)\}^{1/2} \quad (3)$$

In the above formula, it is necessary to add the voltage for generating an electric field for overcoming the adhering strength to the development roller 15 by image force of the charge of the toner 11 to the AC bias voltage. This voltage becomes about 1.3 kVpp from other calculation formula if the development roller 15 and the recording medium are separated by 100 μm. In this case, when the AC voltage is 2 kVpp, when it is applied to the actual toner 11 flying, the AC voltage is 700 Vpp when the frequency of the AC voltage is 2 kHz and the specific charge of the toner 11 is 6 μC/g, the distance L for flying the toner 11 is about 670 μm.

When the distance between the development roller 15 and the recording drum 20 is 100 μm, the diameter of the recording drum 20 is large and the radius r of the development roller 15 is 1 cm, the area S to be developed becomes about 6.7 mm. Thus, it is necessary to reduce the peripheral speed v of the development roller 15 to be smaller than up to 13 m/sec under the condition $T_{ac}<(S/v)$ in which the toner 11 is not integrated on the development roller 15. For example, when the coating rate k of the toner 11 is 0.5 and the peripheral speed of the recording drum 20 is 10 cm/sec., the developing toner 11 on the recording drum 20 is set to 4 at the peripheral speed ratio p for forming two or more layers, the peripheral speed v of the development roller 15 becomes 40 cm/sec., which is smaller than up to 13 m/sec., the above-described conditions are satisfied.

If the proximity distance Lm between the development roller 15 and the recording drum 20 is increased, the area S to be developed is reduced as apparent from the formula (3), and the condition of the $T_{ac}<(S/v)$ is not satisfied. Further, the proximity distance Lm is increased by the flying distance L of the toner 11, reciprocation of the toner 11 is eliminated, the toner 11 is moved from the development roller 15 to the recording drum 20 only by the electric field of the electrostatic latent image, the developing electric field becomes insufficient, and hence sufficient development cannot be conducted. Therefore, the proximity distance Lm between the development roller 15 and the recording drum 20 is necessary to be shorter than the distance L for reciprocating the toner 11. In the above example, the proximity distance between the development roller 15 and the recording drum 20 is 100 μm, and since the distance for flying the toner 11 is 670 μm, and thus the condition is satisfied. Both the development roller 15 and the recording drum 20 may be contacted with one another.

Figure 33A:
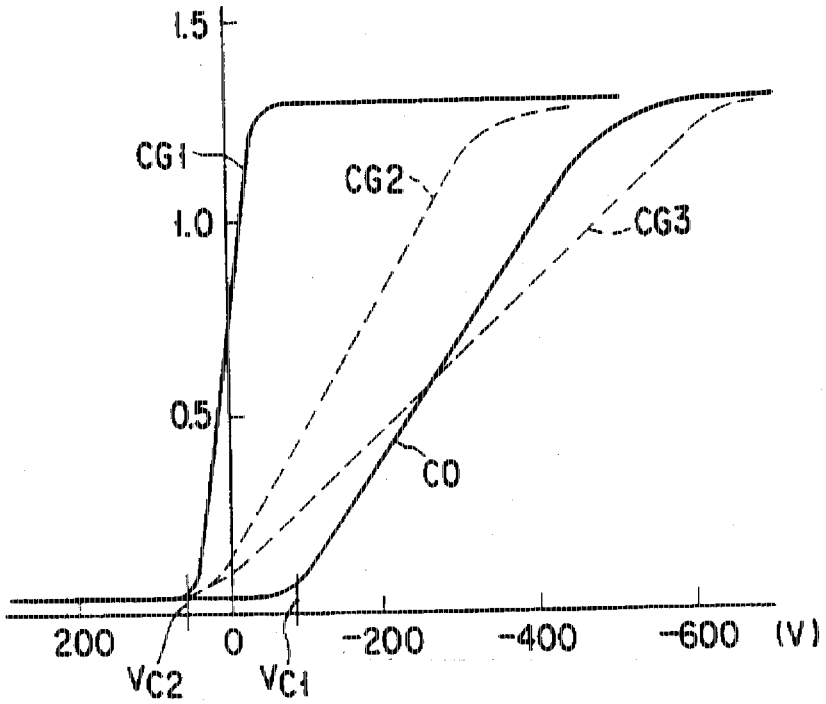
FIGS. 33A and 33B are views showing an example in which gamma characteristics are altered by varying an AC bias voltage.
Figure 33B:
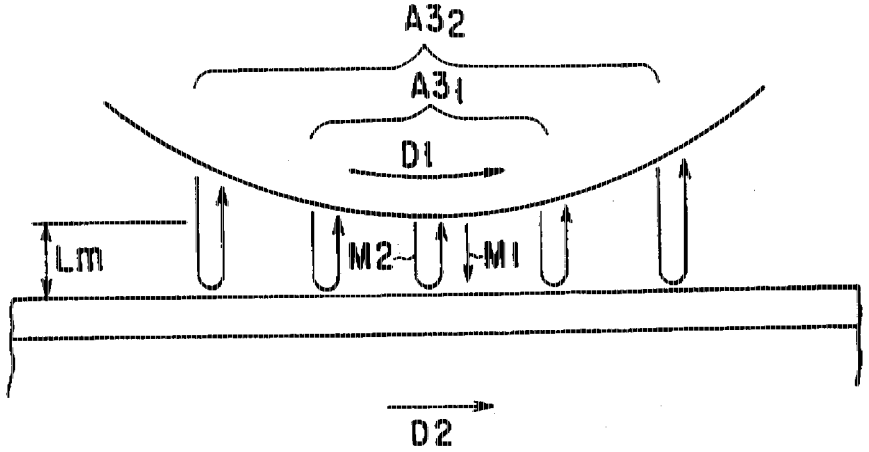

An example in which developing characteristics (gradation characteristics) are altered by varying the AC bias voltage is shown by referring to FIGS. 33A and 33B. When the AC bias voltage Vpp of the frequency f is given, the distance L for reciprocating the toner 11 between the development roller 15 and the recording drum 20 is given by the following formula;

$$L<(Q_s \cdot vpp)=^{1/2}/(2 \cdot f) \quad (4)$$

According to the formula (4), when the Vpp of the AC voltage is varied, the flying distance of the toner 11 can be altered. When the flying distance of the toner 11 is varied, the electric field by the electrostatic contrast to be operated at the toner 11 on the recording drum 20 at the time of developing is varied, and hence gamma characteristics of the development can be controlled.

This analysis result will be described.

FIG. 33A is a diagram of developing characteristics when the electrostatic contrast on the recording drum 20 is on an abscissa axis, the developing density at that time is ordinate axis, and the AC voltage is the parameter. FIG. 33B is an orbit of the toner 11 flying when the AC voltage is varied. The distance Lm between the development roller 15 and the recording drum 20 is set to 100 μm.

A curve CO of FIG. 33A indicates the developing characteristics when the AC voltage Vpp is not applied. As shown by the orbit M1 of the toner 11 of FIG. 33B, the toner 11 on the development roller 15 at this time is flown only by the electric field of the electrostatic latent image, and the development is executed after the high electrostatic contrast is obtained. As a result, the critical voltage $V_{c1}$, of the development for flying the toner 11 adhered by the image force from the development roller 15 becomes a high electrostatic latent image potential. When the AC voltage is applied and the toner 11 is so reciprocated for the proximity distance Lm as indicated by the orbit M2, the image density of the potential of the electrostatic latent image is raised as indicated by the developing curve CG1, a gamma value for indicating the developing characteristics is increased, and the critical voltage $V_{c2}$ of the development is lowered. The AC voltage Vpp at this time substantially coincides with the calculated value (1–3 kVpp) up to 1.5 kVpp. The frequency of the AC voltage is 2 kHz.

The low electrostatic contrast latent image can be developed by the high gamma value as described above, and the surface potential of the recording drum 20 can be lowered, and hence a roller charging for small ozone generation amount can be stably used.

Further, in an ion deposition recording for forming the electrostatic latent image by controlling ions together with dots, a low electrostatic latent image can be used, and hence an interference between the ions and the electrostatic latent image is reduced to improve picture quality. When the AC voltage is increased, the flying area $A3_1$ of the toner 11 is increased. Accordingly, gamma characteristics of the developing curve CG2 are reduced. At this time, the developing critical voltage $V_{c2}$ to be determined according to the magnitude of the electrostatic latent image is not changed. Further, when the AC voltage is raised, the flying area $A3_2$ of the toner 11 is extended, and the gamma value of the developing curve CG3 is further decreased, and the electrostatic contrast necessary for the development becomes 600 V or higher. The AC voltage at this time is 3 kVpp. In this case, the gradation recording is facilitated, and the critical voltage is not changed.

Figure 34:
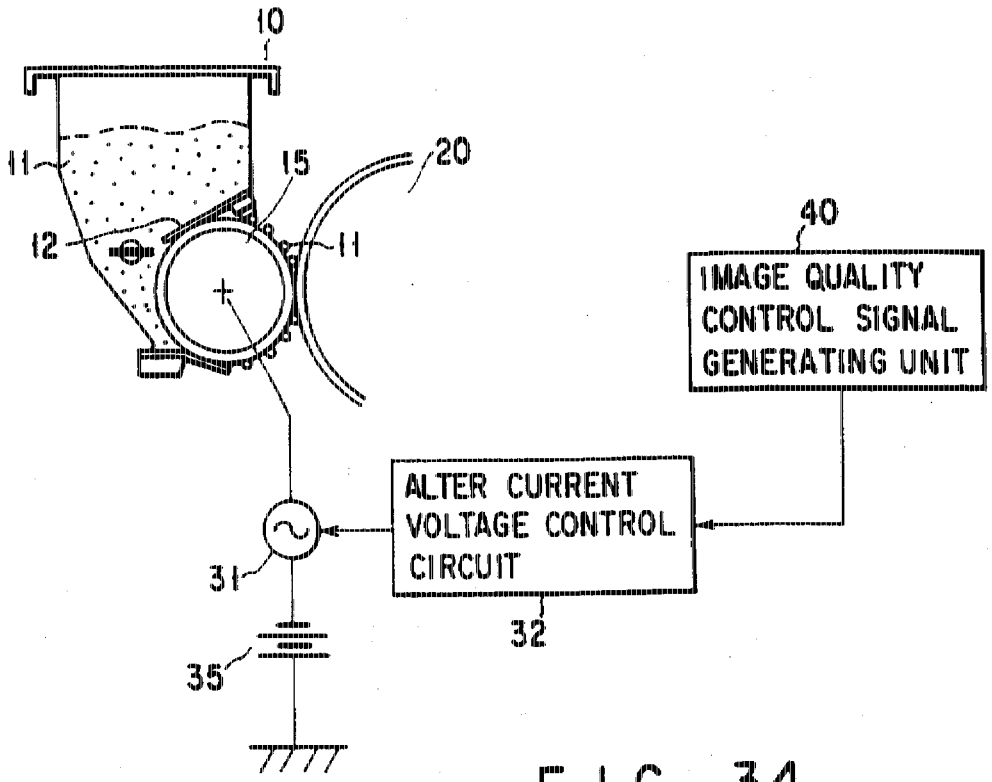
FIG. 34 is a view showing an example of controlling the gamma characteristics by altering the AC bias voltage.

When the AC bias voltage is altered as described above, the developing characteristics (gradation characteristics) can be controlled. This controlling method will be described by referring to FIG. 34.

In a conventional analog copying machine, a digital copying machine for reproducing a half tone, and further a digital color recorder, a request for arbitrarily controlling the picture quality is recently raised. In a laser printer, a laser light amount is controlled by a pulse width control or the like to control a pixel of the electrostatic latent image to control the picture quality. However, as a parameter for controlling the picture quality of an electrophotograph needs, in addition to the electrostatic latent image to be controlled by the laser light, developing characteristics, characteristic control of other constituent element. In this case, an example, in which developing characteristics are controlled by controlling the AC bias voltage of the development device 10 will be described.

A signal for controlling a picture quality is generated from an image quality control signal generating unit 40 for each image or color of a color image by a signal from a printer's user or a CPU (not shown) obtained by processing a scanner signal of a color digital copying machine. An AC voltage controller 32 controls the voltage of the AC bias power source 31 in response to the image quality control signal. The voltage of the AC bias power source 31 is superposed to the voltage of the DC bias power source 35 to be applied to the development roller 15 of the development device 10. The development roller 15 is coated with the toner 11 of 1 or less by the charging blade 12. When a control signal for an image near a binary recording is input, the AC bias voltage is controlled to a voltage of 1.5 kVpp. In the case of soft gradation recording, the AC bias voltage of 1.5 kVpp is controlled. Thus, gamma characteristics for determining the developing characteristics is externally controlled to freely control the picture equality on the recording drum 20. Particularly, in the case of the color recording, the characteristics of the toner 11 are different for the respective colors, and the AC bias voltages of the color development device 10 are set to optimum values, thereby obtaining a color image of high quality.

Figure 35:
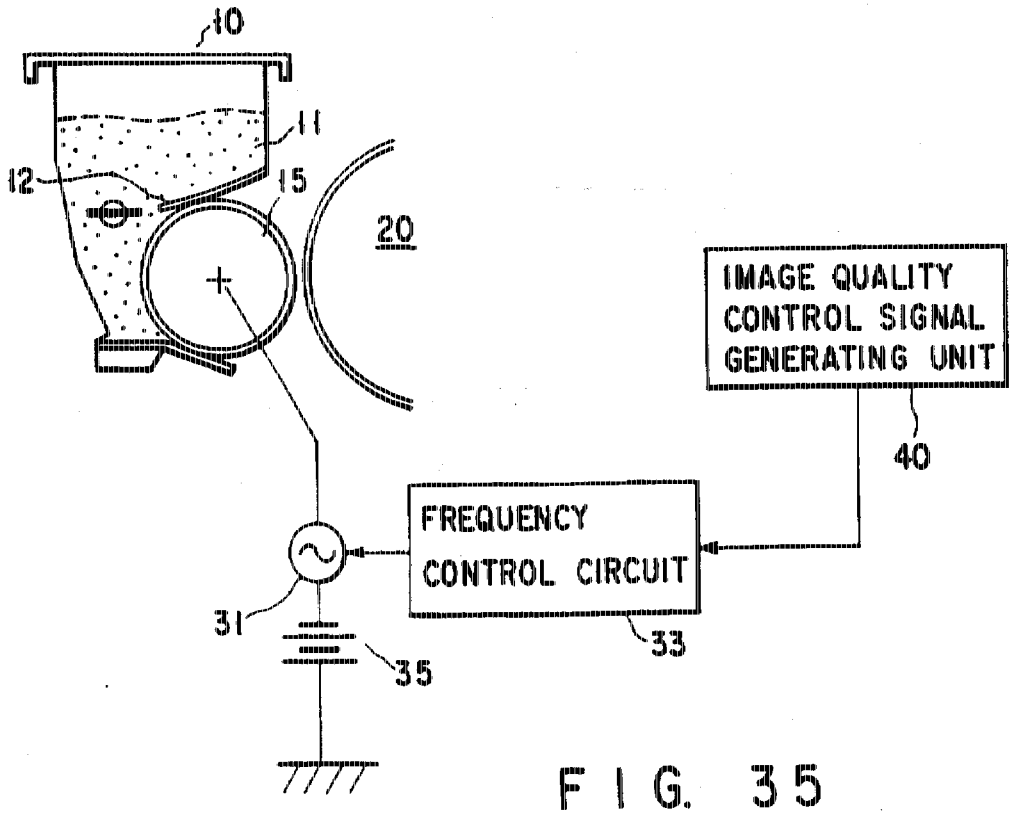
FIG. 35 is a view showing an example of controlling gamma characteristics by varying a frequency of the AC bias voltage.

The example in which gamma characteristics are controlled by altering the voltage of the AC bias voltage has been described. However, an example in which the frequency of the AC bias voltage is altered and gamma value of the developing characteristics is controlled will be described by referring to FIG. 35.

If the bias voltage of a frequency f is applied, flying distance L of the toner 11 between the development roller 15 and the recording drum 20 is given similarly to the formula (4).

$$L=(Q_t\times Vpp)^{1/2}/(2\times f) \quad (5)$$

In the formula (5), when the frequency f of the AC bias voltage is increased, the flying distance L of the toner 11 is reduced, while when the frequency f is decreased, the flying distance L of the toner 11 is raised. Thus, similarly to the above example, gamma characteristics of the development can be controlled by altering the frequency of the AC bias voltage.

A signal for controlling a picture quality is generated from an image quality control signal generating unit 40 for each image or color of a color image by a signal from a printer's user or a CPU (not shown) obtained by processing a scanner signal of a color digital copying machine. A frequency of the voltage of the AC bias power source 31 is controlled by a frequency controller 33 of the AC bias voltage in response to the image quality control signal. For example, the AC bias voltage applied by the voltage of 2.5 kVpp is controlled to a value of low frequency of 1.5 kHz when a control signal for the image near a binary recording is input. In the case of soft gradation recording, it is controlled to a frequency of 3 kHz. Gamma value for determining the developing characteristics as described above is freely controlled by externally controlling the frequency of the AC bias voltage.

Figure 36A:
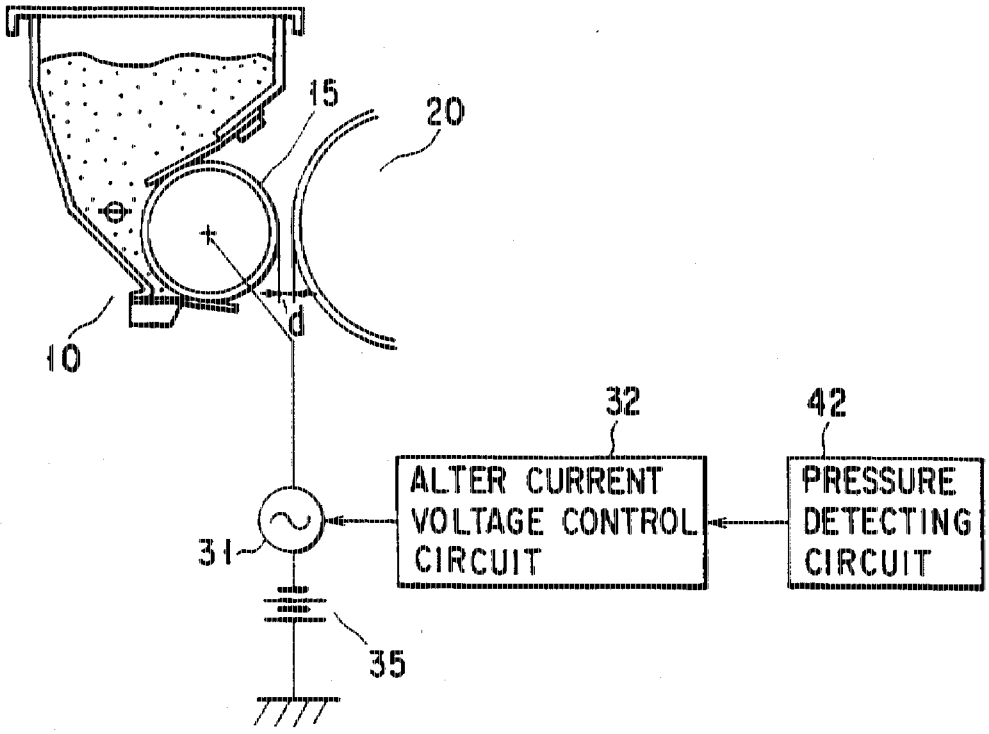
FIGS. 36A and 36B are views showing an operation of an electrostatic recording apparatus according to a fourteenth embodiment of the present invention.
Figure 36B:
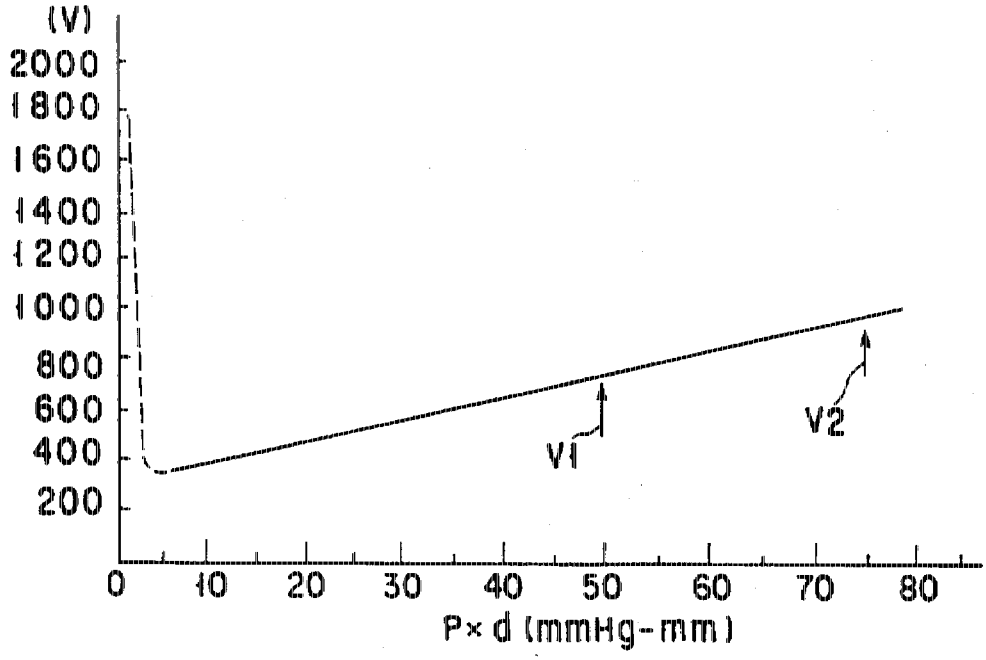

FIGS. 36A and 36B are views showing an operation of the electrostatic recording apparatus according to a fourteenth embodiment of the present invention. This embodiment shows an example of a non-contact development device 10 in which the AC bias voltage between the development roller 15 and the recording medium 20 is controlled by detecting the atmospheric pressure to prevent discharge. FIG. 36A is a control block diagram of the development device 10, and FIG. 36B is a Paschen's discharge curve.

As shown in FIG. 36A, the development roller 15 of the development device 10 is mounted at a distance d from the recording drum 20. A voltage of the AC bias power source 31 of the voltage Vpp and a voltage of the DC bias power source 35 are superposed to the development roller 15 to be applied. The AC bias voltage is controlled by the AC voltage controller 32 according to an output signal from an atmospheric pressure detector 42. In a range (a solid portion in FIG. 36B) in which a product of the atmospheric pressure P (mmHg) at a highland and a distance d (mm) is 6.0 or more, the Paschen's discharge curve is approximated by a straight line.

The sum of the AC bias voltage Vpp2 and the electrostatic contrast Vc is so controlled by the AC voltage controller 32 for the voltage of the AC bias power source 31 as to satisfy the following formula (6).

$$(Vpp/2+Vc)<8.33\times(P\times d)+325 \quad (6)$$

In the formula (6), for example, when the distance d between the development roller 15 and the recording medium is 0.1 mm, the atmospheric pressure is low to 500 mmHg in a highland city of 3,000m class, and the discharge critical voltage $V_1$ becomes 740 V. On the other hand, a discharge critical voltage $V_2$ of a low height of 750 mmHg becomes 950 V.

As described above, a discharge between the development roller 15 and the recording medium at a highland is prevented to always perform noncontact development.

An example in which gradation characteristics are altered by varying gamma characteristics in the fourteenth embodiment is now described.

The atmospheric pressure is low to 500 mmHg in a highland of 3,000m class. In this case, a Paschen's discharge curve for a metal electrode in a range that (P×d) is 6 or more is approximated by a straight line of equality of the following formula $$(Vpp/2+Vc)\leq 4150\times d+325 \quad (7)$$

When the development roller 15 and nonmagnetic one-component toner 11 shown in the eleventh embodiment are used, this discharge critical limit is shifted to a higher voltage. When a distance between the development roller 15 and the recording medium is set to 100 μm, the electrostatic contrast is set to 200 V, and the AC bias voltage Vpp is set to 1.5 kVpp, gamma characteristics can be altered arbitrarily by varying the AC bias voltage in a range of the above formula in which no discharge is generated.

Figure 37:
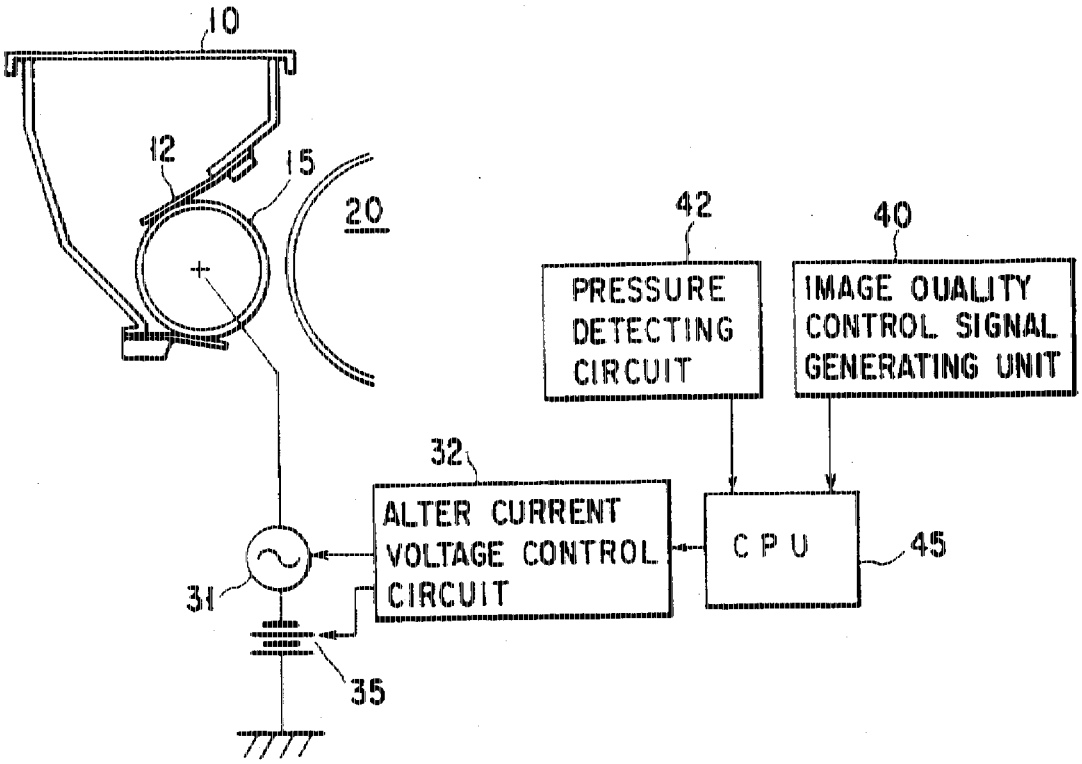
FIG. 37 is a view showing an operation of an electrostatic recording apparatus according to a fifteenth embodiment of the present invention.

FIG. 37 is a view showing an operation of the electrostatic recording apparatus according to a fifteenth embodiment of the present invention.

Signals from an atmospheric pressure detector 42 and an image quality control signal generating unit 40 are input to a CPU 45, which determines an optimum AC bias voltage for the atmospheric pressure detected by the atmospheric pressure detector 42. Further, the CPU 45 calculates the AC bias voltage of a voltage range for optimizing gradation characteristics according to the signal from an image quality control signal generating unit 40, and sets a voltage of the AC bias power source 31 through the AC voltage controller 32. At this time, the image contrast becomes a maximum, and a voltage of the DC bias power source 35 for forming an image having no fog is simultaneously set.

Setting of the voltage of the AC bias power source 31 of this embodiment may be controlled by altering the frequency f with the voltage being constant. The amplitude of the AC bias voltage or the frequency may be varied according to the particle size distribution of the toner 11 by considering the influence of the specific charge of the toner 11 according to the particle size distribution of the toner 1 to improve picture quality.

Figure 38:
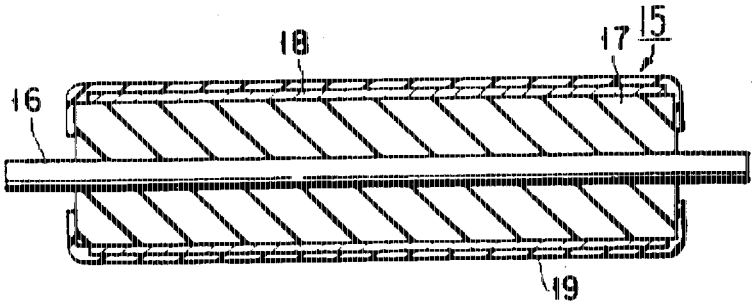
FIG. 38 is an explanatory view showing a development roller to be used for a nonmagnetic one-component development system unit of the present invention.

FIG. 38 is a front view showing a development roller 15 to be used for a nonmagnetic one-component development system unit of the present invention. The same reference numerals as those in FIG. 30C are used to indicate similar or corresponding components, and a detailed description thereof will be omitted.

A conductive rubber roller 17 made of a rubber material containing foamable rubber or conductive particles having conductive rubber at both ends is provided on the outer periphery of the driving shaft 16. A conductive resin layer 18 made of a material in which carbon powder is kneaded in polyester is formed on the conductive rubber roller 17. A resistive resin layer 19 (hereinafter referred to as "resistance layer 19") of the present invention is formed on the conductive resin layer 18. As the conductive resin layer 18, ion conductive fluorine resin having a work function of 8 eV or higher, secondary, electron emission rate of 4 or less, and volume resistance of $10^6$ to $10^8$ Ωcm is used. A thickness of the resistance layer 19 is 10 to 100 μm.

Figure 39:
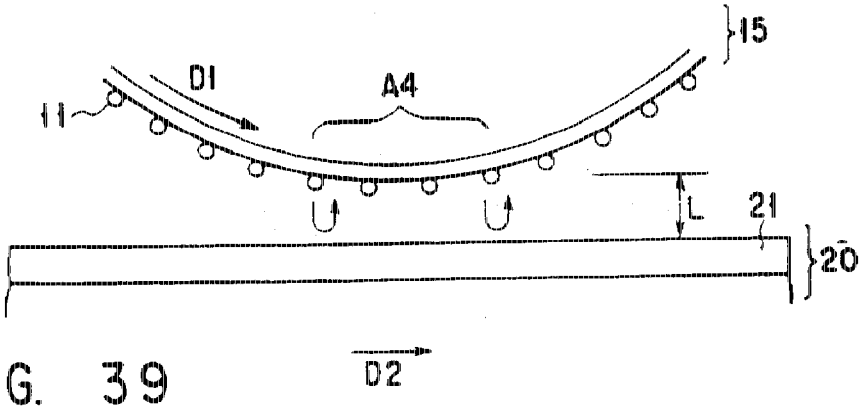
FIG. 39 is an explanatory view showing the relationship between a development roller and a recording drum of an image drum shown in FIG. 38.

FIG. 39 is an explanatory view showing the relationship between the development roller 15 and a recording drum 20 of an image drum shown in FIG. 38. The development roller 15 is rotated in a direction of D1, and the recording drum 20 is rotated in a direction of D2. The development roller 15 and the recording drum 20 are so disposed as to be separated at a distance L (about 100 μm). A photosensitive layer 21 having a thickness of 25 μm is formed on the recording drum 20. The toner layer made of nonmagnetic toner 11 is so formed on the surface of the development roller 15 that the coating rate is 1.0 or less, i.e., in one or less layer. The coating rate can be regulated by a charging blade (not shown) attached to a vessel for containing the toner 11.

A DC bias voltage Vd and an AC bias voltage Vpp are superposed to the development roller 15. This bias voltage is applied to reciprocate the toner 11 of the area A4 to be developed between the development roller 15 and the recording drum 20.

In the development described above, the resistance layer 19 having a work function of 4 eV or more is formed on the development roller 15, and hence emission of electrons due to a high electric field is eliminated, and even if it is used in a highland where the atmospheric pressure is low and dry, corona discharge is prevented. Even if a corona discharge is generated between the recording drum 20 and the development roller 15, the corona charge is stored on the development roller 15 and the recording drum 20, and potentials of both are equalized, thereby immediately stopping the corona discharge.

Figure 40A:
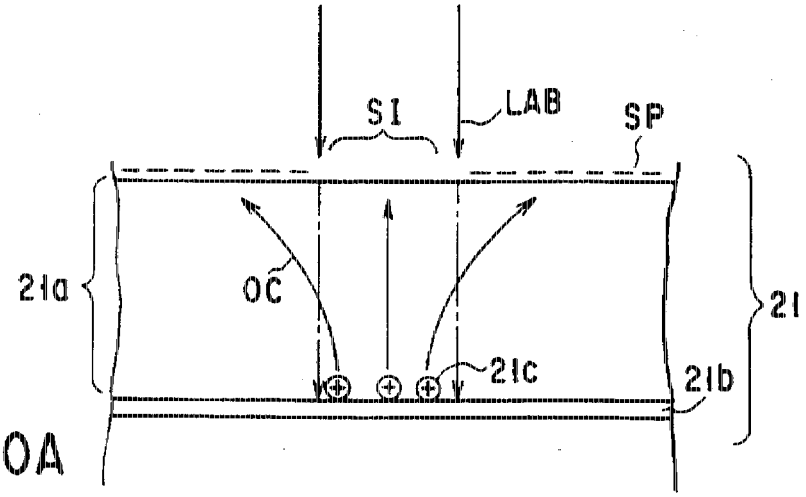
FIGS. 40A and 40B are explanatory views showing a structure of a photosensitive drum layer of a recording drum.
Figure 40B:
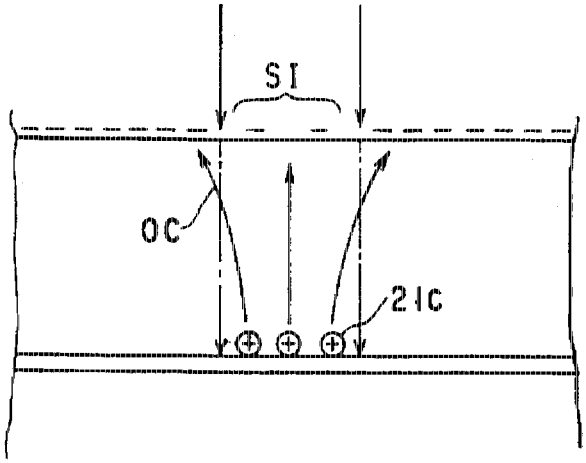

FIGS. 40A and 40B are explanatory views showing a structure of a photosensitive layer 21 of the recording drum 20.

In FIG. 40A, an organic photosensitive drum layer (hereinafter referred to "as an OPC") 21 has a carrier generating layer (hereinafter referred to as "CGL") **21*b* for generating carriers 21*c* by irradiating with a light LAB, and a transparent carrier transport layer (hereinafter referred to as "a CTL") 21*a***.

The irradiated light is passed through the CTL **21*a* of the OPC 21, carriers 21*c* are generated in response to the intensity of the light LAB arriving at the CGL 21*b*, surface charge SP on the OPC 21 is neutralized by the carrier 21*c* passed through the CTL 21*a* to form an electrostatic latent image SL At this time, the orbit OC of the carriers 21*c* is sent by a repelling force by the spatial charge of the carriers 21*c* themselves and a latent image electric field on the forced photosensitive layer 21, and a pixel of the electrostatic latent image to be formed is extended. In order to reduce mutual interference between the electrostatic latent image and the carrier orbit OC, and to decrease the pixel of the electrostatic latent image to be formed, as shown in FIG. 40B**, the contrast of the electrostatic latent image SI is set to 200 V or less at the maximum, it is effective. The contrast of the electrostatic latent image SI is set to 200 V at the maximum, it is effective. The nonmagnetic one-component development system having high gamma characteristic is adapted to obtain sufficient density image by developing the low electrostatic latent image.

Figure 41:
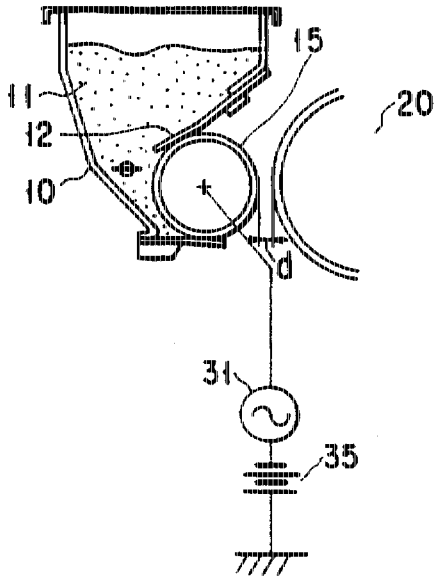
FIG. 41 is an explanatory view showing an example of a nonmagnetic one-component development system unit according to the present invention.

A method for developing the nonmagnetic one-component development system of the present invention will be described by referring to FIG. 41.

A development roller 15 is mounted under the development device 10. The development roller 15 and a charging blade 12 for contacting the end of the development roller are mounted on the development device 10. The development roller 15 is disposed at a distance d from the recording drum 20. The development roller 15 is connected to an AC power source 31 and a DC power source 35, and the DC bias and the AC bias are applied.

In the developing apparatus described above, in order to reduce the coating rate of the toner 11 on the development roller 15 to be smaller than 1.0 and to compensate a decrease in the image density, a peripheral speed ratio of the development roller 15 to the recording drum 20 is set to be larger than 1. For example, the coating rate of the toner 11 on the development roller 15 is set to 0.68, the peripheral speed of the development roller 15 is set to 15 cm/sec., the peripheral speed of the recording drum 20 is set to 10 cm/sec., (peripheral speed ratio is to 1.5). The charging amount of the toner 11 to be used for developing is set to 6 μC/g or less.

Then, the AC bias voltage of a frequency of 2 kHz and a voltage of 1.5 kVpp and the DC bias voltage of −550 V are superposed to the development roller 15.

At this time, a surface potential of the recording drum 20 is −600 V, and the electrostatic contrast of 200 V is formed, and developed.

In this development device, the toner 11 on the development roller 15 is formed in one or less layer, and hence repel of the charge of the toner 11 generated when the toner layer is forced in multilayers is eliminated, the toner 11 is adhered only by the image force of the development roller 15 and is not affected by the influence of the environment. Thus, even if it is used at a high dry place, an electrostatic latent image of low electrostatic contrast can be stably developed.

Figure 42:
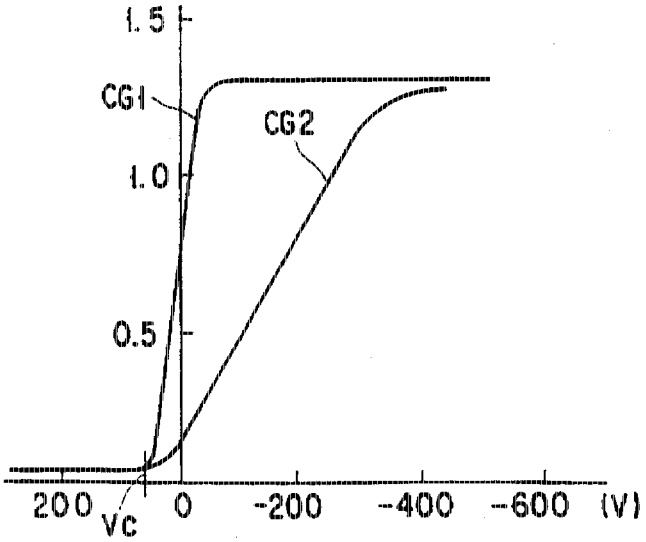
FIG. 42 is a graph showing gradation characteristics for an electrostatic contrast on a recording drum.

FIG. 42 is a graph showing gradation characteristics for the electrostatic contrast on the recording drum 20.

When the AC bias voltage is so regulated as to reciprocate the toner 11 at the proximity point of the recording drum 20 and the development roller 15, high gamma characteristics as indicated by a developing curve CG1 are obtained. The AC bias voltage at this time is 1.5 kVpp or less, the frequency is 2 kHz or less, and the electrostatic contrast is 200 V. The DC bias voltage is applied by −550 V lower than −600 V of the surface potential. Thus, the latent image of low electrostatic contrast with high gradation characteristics can be developed. When the AC bias voltage is increased from 500 Vpp to 1.5 kVpp, the toner 11 is flown to the area having a long distance between the development roller 15 and the recording drum 20, and developed, and irradiation characteristic indicated by a developing curve CG2 is obtained. Thus, the gradation characteristic can be controlled by altering the AC bias voltage. A potential difference between the surface potential of the recording drum 20 and the development roller 15 is reduced, and discharge between both can be suppressed even if it is used at a highland where the atmospheric pressure is low.

The method for developing the image is also effective for ion deposition recording for forming the electrostatic latent image by controlling ions at each pixel, an interference between an ion flow and the electrostatic latent image can be reduced to improve picture quality.

In order to stably develop by the nonmagnetic one-component development system of the above-described non-contact type, as the material of the resistance layer 19, a time constant longer than the time for passing the development roller 15 through the area to be developed, and larger than the period of the AC bias voltage. When the resistance layer 19 is so set as to satisfy these conditions, the resistance layer 19 is operated at the insulating layer for the AC bias voltage, an image force for indicating the adhering strength of the toner 11 having a small particle size to the development roller 15 is reduced, and the toner 11 having the small particle size is easily flown.

More particularly, when the radius of the toner 11 is R, the thickness of the resistance layer 19 of the development roller 15 is $D_d$, specific permittivity is $\epsilon_i$, charge of the toner 11 is $Q_0$, and the mean particle size of the toner 11 is $2\times R_0$, the image force F for operating the toner 11 is given by the following formula:

$$F=Q^2/\{\epsilon_0\epsilon_i\times(2R+2D_d)^2\}$$

$$Q=(4\pi R_0^3R_0/3)\times(R^2/R_0^2)$$

Figure 43:
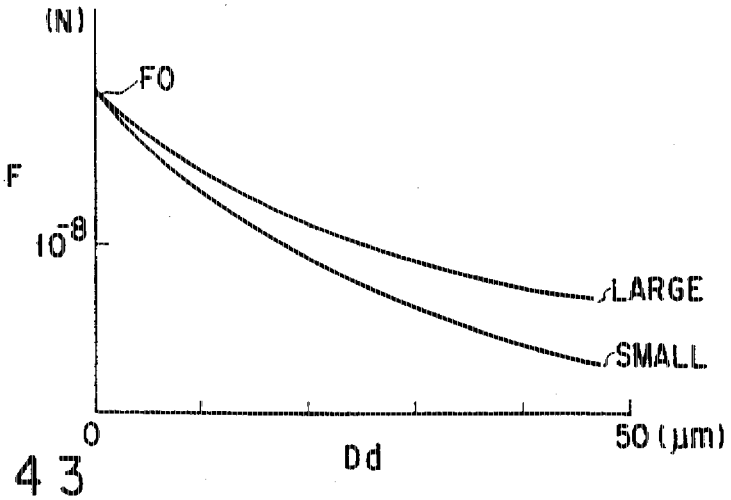
FIG. 43 is a graph showing the relationship between a thickness $D_d$ of a resistance layer of a development roller and an image mirror force F to be operated for the toner.

As shown in FIG. 43, the image force F is reduced together with the thickness $D_d$ of the resistance layer 19. In the case of $D_d=0$ where the resistance layer 19 does not exist, the image force of the toner 11 having different particle size becomes the same value F0. When the thickness of the resistance layer 19 is increased, the image force F of the toner 11 having a small particle size is reduced smaller than the toner 11. As a result, the toner 11 having the small particle size and small charge amount can be flown by the small electric field, thereby contributing to the development with small toner 11 with low electrostatic contrast. As a result, a smooth image is obtained on the low density area having small electrostatic contrast.

As described above, in order to operate the resistance layer 19 for the AC bias voltage as the insulating layer, a time constant T of the resistance layer 19, the period of the AC bias voltage 1/f and the time A/V for passing the area to be developed by the development roller 15 are so set as to satisfy $1/f<A/v<T$, where v is the peripheral speed of the development roller 15.

In order to eliminate the charge storage of the resistance layer 19 of the development roller 15 and to stably develop many times, it is necessary to vanish the storage charge at each one revolution of the resistance layer 19. To this end, the time constant of the resistance layer 19 and the rotating speed N (rpm) are so set as to satisfy $T<60/N$.

Figure 44:
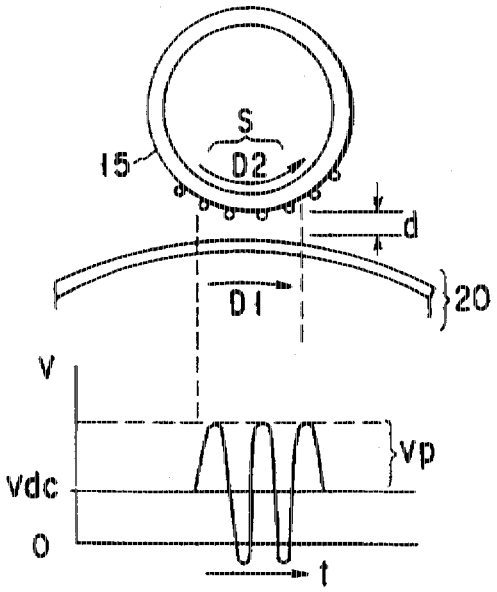
FIG. 44 is an explanatory view showing the relationship between the development roller and the recording medium.

An example in which the development is conducted by considering the above-described conditions by referring to FIG. 44 will be described.

The development roller 15 is covered with a resistance layer 19 having a specific permittivity of 2.3, a resistivity of $5\times10^{16}$ Ωcm or less and a thickness of 40 μm on a conductive resin layer 18 mixed with conductive particles. A distance between the development roller 15 and the recording drum 20 is set to 100 μm. A surface potential of the recording drum 20 by precharging is −600 V, an electrostatic contrast is 200 V, the DC bias voltage $V_{dc}$ to be applied to the development roller 15 is −550 V, the AC bias is set to a frequency of 2 kHz, and a peak voltage vp is 750 V. The time constant of the resistance layer 19 of the development roller 15 is 10 msec. or less. The peripheral speed of the recording drum 20 is 10 cm/sec., the peripheral speed of the development roller 15 is 20 cm/sec., and a peripheral speed ratio is 2. When the diameter of the development roller 15 is 3 cm, its rotating speed N is 120 rpm. When the area S to be developed of the development roller 15 is 1 mm, a time for passing the area to be developed is 5 msec. The period of the AC bias is 0.5 sec. The time for rotating the development roller 15 is 0.5 sec., and the above-described conditions are satisfied.

Under such conditions, the toner 11 having a small particle size of several μm or less contributes to the development on a low density area of the electrostatic contrast to obtain an image having smooth gradation characteristics.

Figure 45:
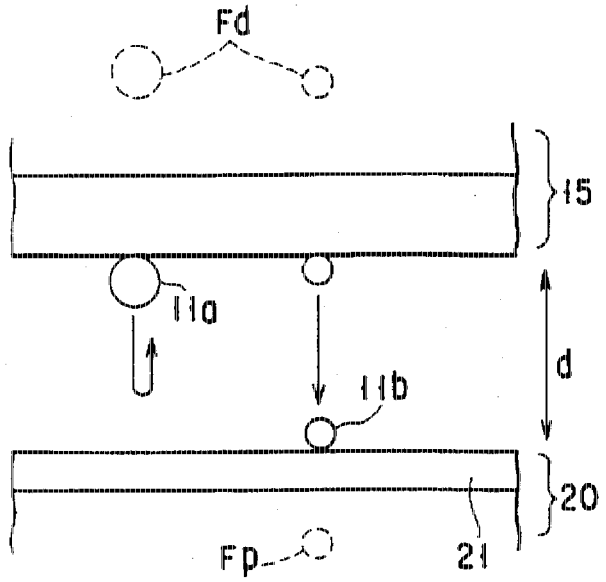
FIG. 45 is an explanatory view showing reciprocating motion of the toner between the development roller and the recording drum.

As shown in FIG. 45, when the toner 11 is reciprocated by the AC bias voltage between the development roller 15 and the recording drum 20, image force $F_p$ of the toner 11 generated on a photosensitive layer 21 of the recording drum 20 is increased to be larger than the image force $F_d$ of the development roller 15 as indicated by the following formula. Thus, the toner 11 flown to the photosensitive layer 20 is reliably adhered to perform the development of large density.

$$F_p>F_d$$

$$F_p=Q^2/\{\epsilon_0\times\epsilon_p\times(2D_p+2R)^2\}$$

$$F_d=Q^2/\{\epsilon_0\times\epsilon_d\times(2D_d+2R)^2\}$$

Thus, $$\epsilon_p\times(2D+2R)^2<\epsilon_d\times(2D_d+2R)^2$$

For example, when the thickness of the photosensitive layer 21 is 25 μm, the specific permittivity $\epsilon_p$ of the photosensitive layer 21 is 3.0, the specific permittivity $\epsilon_d$ of the resistance layer 19 is 2.3, and the mean particle size R of the toner 11 is 10 μm, the thickness $D_d$ of the resistance layer 19 is set to 28 μm or more, the above-described formulae can be satisfied.

The toner 11 adhered to the photosensitive layer 21 is generated by the electric field E for moving the toner 11 to the development roller 15 by the surface potential and the DC bias voltage of the recording drum 20 and the AC bias voltage of the reverse polarity for reversely flying the toner 11 in a direction of the development roller 15 between the development roller 15 and the recording drum 20. The force to be operated on the toner 11 is given by the following formula.

$$F=Q\cdot E-Q^2/\{\epsilon_0\times\epsilon_p\times(2D_p+2R)^2\}$$

Figure 46:
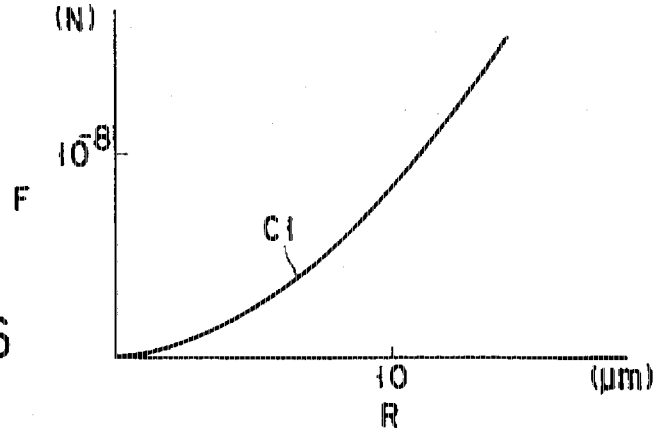
FIG. 46 is a graph showing the relationship between a particle size R of the toner and an image mirror force F to be operated for the toner.

The force F for reversely flying the toner 11 is indicated by a curve C1 in FIG. 46 for the particle size of the toner 11. That is, if the particle size is increased, the reverse flying force of the toner 11 is increased, the toner 11*a* having a large particle size is reversely flown to the development roller 15, and the toner 11*b* having a small particle size is adhered to the recording drum 20. Thus, the toner 11*b* having a small particle size is adhered to the photosensitive layer 21 to obtain a smooth image on a low density area. The electrostatic contrast to be used for the calculation is 150 V, and the other conditions are the same as those described above.

The foregoing description has been described with reference to the electrostatic developing apparatus. Next, an ion generator to be used for the recorder will be described. The general description of the ion generator according to the sixteenth to seventeenth embodiments of the present invention will be described below.

Figure 47:
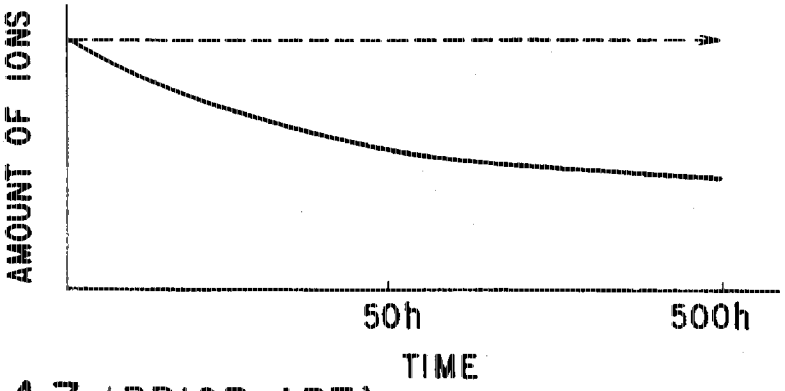
FIG. 47 (PRIOR ART)
FIG. 47 is a view showing attenuation of an ion generating amount as time goes.
Figure 48A:
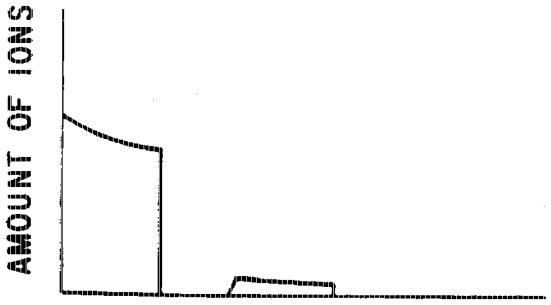
FIG. 48A (PRIOR ART)
FIGS. 48A and 48B are views for explaining rising characteristics of the ion generation as compared with prior art.

If the conventional ion generator is continuously used, the surface of the dielectric layer is deteriorated by product generated by discharging as time goes, and hence an ion generate amount in the ion generating hole is known to be attenuated as shown in FIG. 47. Since the physical values of the surface of the dielectric layer is varied by the product generated by discharging. Accordingly, as shown in FIG. 48A, there is problem that the AC voltage is applied after the discharge is stopped to eliminate discharging even if ions are intended to be again generated, and ions are not generated (deterioration of the rising characteristics).

The applicant has discovered against the problem that a first electrode and a second electrode having ion generating hole are provided through the dielectric layer, the AC voltage is applied between the first electrode and the second electrode, ions are generated in the atmospheric discharging in the ion generating hole to output only ions of the predetermined polarity as an ion flow in the ion generator and the area for causing deterioration of the stability and rise characteristics is generated in a range of several μm near the ion generating electrode.

Figure 48B:
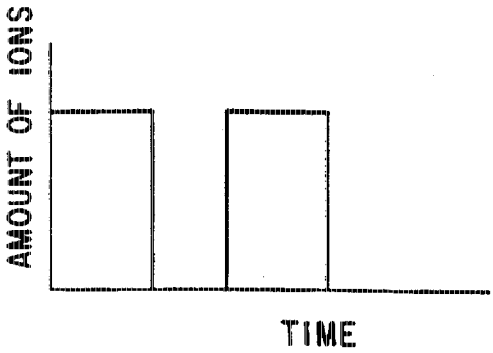

As a result, the dielectric electrode is so divided as to minimize the variation in the discharge of the area to the entirety, the ion generating hole is extended and the width of the dielectric electrode is reduced to be smaller than the width of the ion generating hole, thereby reducing the deterioration and to improve the rising characteristics as shown in FIG. 48B.

When the dielectric electrode is divided, an interval of the divided dielectric electrodes becomes an important parameter. This value is determined with respect to the thickness of the dielectric layer. When the interval between the electrodes is set to the thickness or more of the dielectric layer, an effect of dividing the dielectric electrode is exhibited.

When the ion generating hole is extended, the value of the width of the ion generating hole is determined with respect to the charging current amount. When the width of the ion generating hole is set to 150–300 μm, its effect is exhibited by the charging current amounts 1 to 10 μA/cm when it is used for the charging of an ordinary electrophotograph.

When the width of the dielectric electrode is narrowed as compared with that of the ion generating hole, it is necessary to isolate at least 10 μm between the dielectric electrode and the ion generating electrode in the direction of the surface of the dielectric layer as to eliminate overlapping between the dielectric electrode and the ion generating electrode.

More specifically, in the sixteenth embodiment, the dielectric electrode of the first electrode of an area for the ion generating hole is divided into a plurality to regulate the intensity of the electric field in the ion generating hole. For example, the electric field at the center of the ion generating hole which contributes to the charging current can be strengthened without increasing the electric field near the junction between the ion generating electrode and the surface of the dielectric element. Thus, discharging near the ion generating electrode can be suppressed without reducing the charging current amount to improve stability and rising characteristics of the ion generator.

As described above, since the discharging of the central portion can be strengthened, and hence the temperature of the center of the ion generating hole can be easily raised, and in the variation amount in electric physical values can be reduced. Thus, a time until the stability of the discharge is increased.

The discharge current for unit area of the ion generating hole and the variation of the electric physical value can be reduced by making the ion generating hole wider than a predetermined width. In this case, a time until the stability of the discharge is degraded is made longer.

Overlap between the ion generating electrode and the dielectric electrode is eliminated by reducing the width of the dielectric electrode to be smaller than the width of the ion generating hole, thereby weakening an electric field near the ion generating electrode. Thus, discharging near the ion generating electrode is suppressed to reduce deterioration of the ion generator.

The general description of the above-described embodiment will be described in detail with reference to the drawings.

Figure 49:
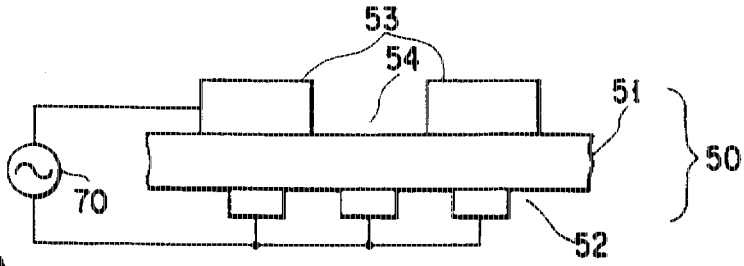
FIG. 49 is a view for explaining a sixteenth embodiment of the present invention.

FIG. 49 shows an ion generator 50 according to the sixteenth embodiment of the present invention. As shown in FIG. 49, first and second electrodes 52, 53 are provided through the dielectric element, an AC voltage 70 is applied between the two electrodes, the surface of the dielectric element of the slit-shaped ion generating slit 54 provided on the electrode 53 is discharged to generate ions.

The first electrode 52 is called "a dielectric electrode", and the second electrode 53 is called "an ion generating electrode 53". In this example, a thickness of the dielectric layer 51 is 30 μm, and the width of the ion generating slit 54 is set to 100 μm. The dielectric layer 51, the dielectric electrode 52 and the ion generating electrode 53 are formed by a thick film printing technique.

In this embodiment, the dielectric electrode is divided into three electrodes, and the widths of the respective electrodes are set to 50 μm, and an interval of the electrodes is set to 50 μm.

Figure 50:
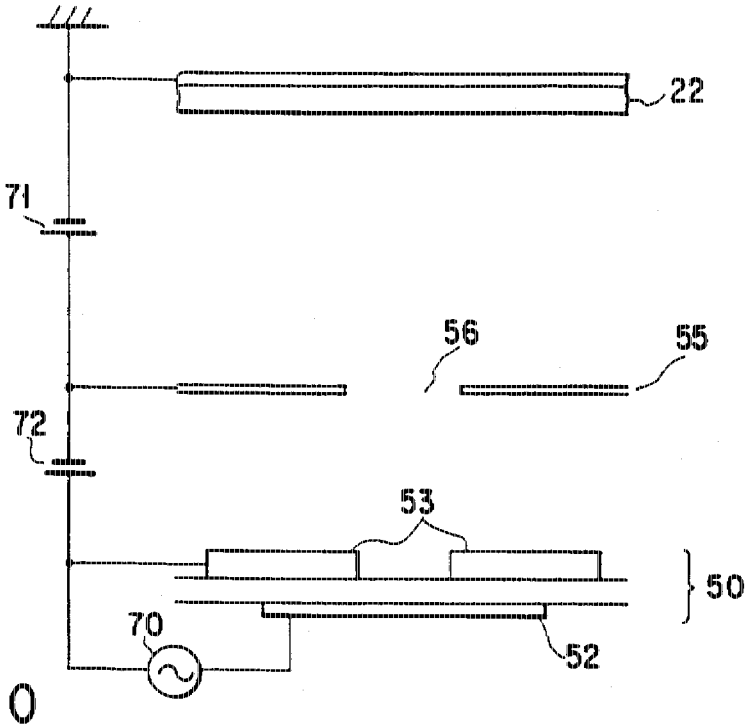
FIG. 50 is a view showing the use of the ion generator of the present invention.

FIG. 50 shows an example of a charger using the ion generator 50 of the present invention. The electrode 55 partitions the moving area for moving ions from the discharging area to the object 22 to be charged. A first DC voltage 71 for moving the ions to the object 22 to be charged is applied to the discharge area. A passage hole 56 for passing the ions is provided at the electrode 55. A diameter of the passage hole 56 is 250 μm. A second DC voltage 72 for guiding the ions generated from the discharge area to the hole 56 is applied between the ion generating electrode 53 and the electrode 55.

In this embodiment, 3.0 kVpp at 150 kHz is applied as the AC voltage 70, 600 V is applied as the first DC voltage 71, and 300 V is applied as the second DC voltage 72. In this embodiment, positive polarity ions are moved, and the object 22 to be charged is charged to the same voltage as the first DC voltage 71.

In this manner, the dielectric electrode is divided, and an electric field distribution of the ion generating hole can be altered by varying the width of the electrodes and the interval of the electrodes. Thus, an intensity of the electric field at the center of the ion generating hole is maintained, and an electric field near the connected portion of the dielectric layer 51 to the ion generating electrode 53 is weakened to improve stability of the ion generator 50.

Figure 51:
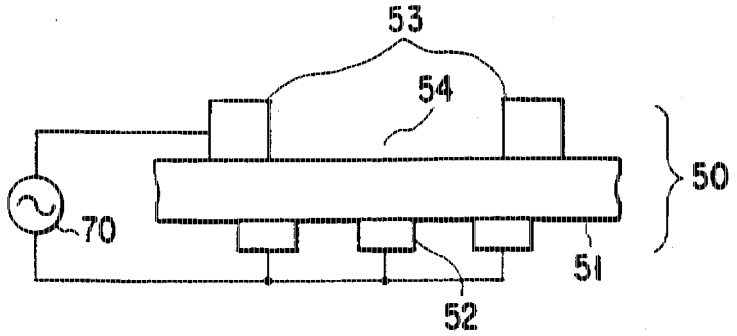
FIG. 51 is a view showing a seventeenth embodiment of the present invention.

Referring to FIG. 51, the seventeenth embodiment of the present invention will be described. In this embodiment, in order to stabilize the ion generator 50, the width of the ion generating slit 54 is increased. In this embodiment, the width of the ion generating hole is set to 200 μm, the width of the dielectric electrodes is set to 50 μm, and an interval of the divided dielectric electrodes is set to 50 μm. If the output charging current is made constant, when the ion generating hole is extended twice, physical value change amount on the surface of the dielectric layer 51 due to the product by discharging are reduced to substantially ½, and the period for stably using the ion generator 50 is increased to about twice.

As described above, the width of the ion generating hole is increased to suppress the variation on the physical value of the surface of the dielectric layer 51, thereby improving the stability of the ion generator 50.

Figure 52:
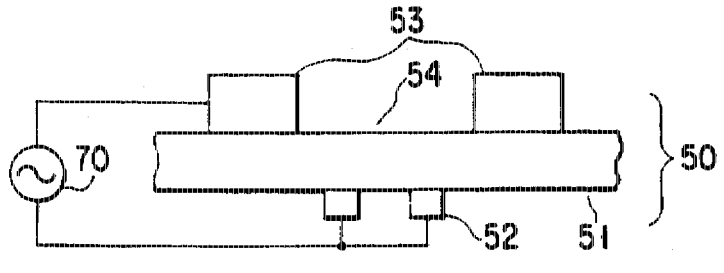
FIG. 52 is a view showing an eighteenth embodiment of the present invention.

The eighteenth embodiment of the present invention will be described by referring to FIG. 52. In this embodiment, in order to stabilize the ion generator 50, the dielectric electrode 52 is divided into a plurality of electrodes so that the dielectric electrodes 52 do not overlap the ion generating electrodes 53. The electrodes 52 and the ion generating electrode 53 are isolated 20 μm in a direction of the surface of the dielectric layer 51. The width of the dielectric electrodes is set to 50 μm, the interval of the electrodes is set to 60 μm, and the width of the ion generating hole is set to 200 μm.

As described above, an intensity of the electric field at the center of the ion generating hole is maintained, and an electric field near the ion generating electrode 53 is weakened to improve stability of the ion generator 50.

Figure 53:
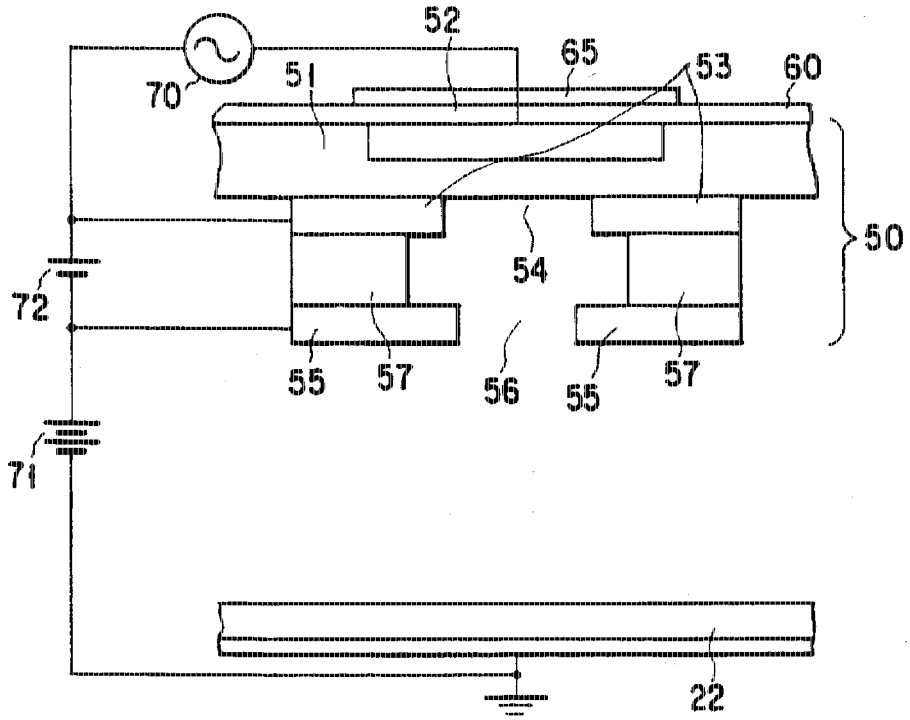
FIG. 53 is a view showing a schematic structure of an ion generator to be used for a recorder according to a nineteenth embodiment of the present invention.

FIG. 53 is a view showing a schematic structure of an ion generator 50 to be used for a recorder according to the nineteenth embodiment of the present invention.

Referring to FIG. 53, the ion generator 50 has dielectric electrode 52 and two ion generating electrodes 53 through a dielectric element 23. An AC bias voltage 70 is applied between the two electrodes to discharge the surface of the dielectric element 51 of the slit 54 provided on the ion generating electrode 53 thereby generating ions. In addition, in FIG. 53, the ion generator 50 is formed together with a heater 65 on one ceramic board 60. The dielectric element 57, the dielectric electrode 52, the ion generating electrode 53 and the heater 65 are formed by a thick film printing technique.

In FIG. 53, the electrode 55 partitions the discharge area and the moving area moving to the object 22 to be charged. A second DC voltage 72 is applied to guide ions generated in the discharge area to the passage hole 56 between the ion generating electrode 53 and the electrode 55. An insulator 57 is provided to insulate between the ion generating electrode 53 and the electrode 55. A first DC voltage 71 for moving the ions to the object 22 to be charged is applied to the electrode 55.

Ozone generated in the discharge area is not externally leaked except through the passage hole 56 by the insulator 57. Further, a decomposing reaction of the ozone is expedited as will be described later by the heater 65 provided to heat the ion generator 50 and to raise the temperature of the discharge area, thereby reducing the saturation density. That is, the present invention prevents the ozone generated in the discharge area from being externally diffused except through the vent hole 56, and the ozone is decomposed by heating the discharge area to decompose the ozone to reduce the ozone amount to be externally diffused.

As described above, the discharge area is heated by the heater 65 to provide an effect of reducing ozone concentration to be leaked from the passage hole 56 formed at the electrode 55. The heater 65 is formed of a heat generating resistor for raising the temperature by supplying a current to heat the ceramic board 60 to 40°–150° C., thereby obtaining its effect.

Figure 54:
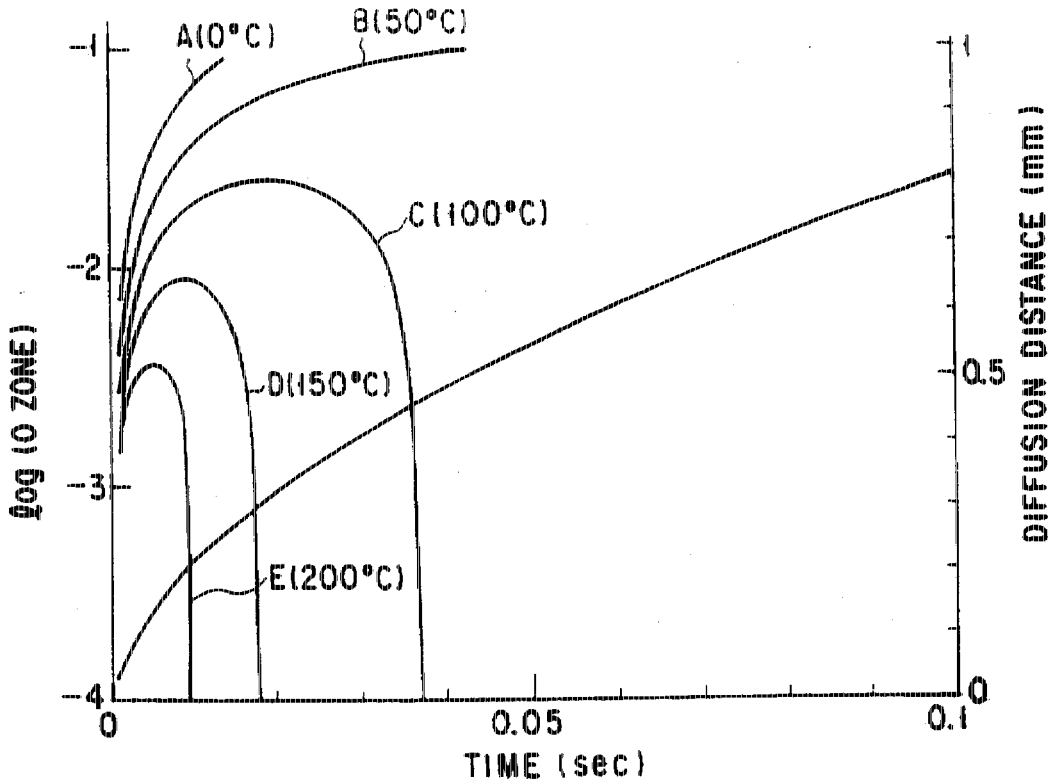
FIG. 54 is a view showing the relationship between ozone generating amount and ozone amount according to a diffusing distance and a state of banishment of ozone due to generating amount and temperatures of the ozone.

The reason why the ozone concentration can be reduced by heating the discharge area will be described by referring to FIG. 54. FIG. 54 is a view showing the relationship between an ozone generating amount and an ozone amount due to its diffusing distance and the ozone generating amount and a state of vanishing the ozone by the temperature. Generation, decomposing reaction of the ozone are represented by the following formulae.

$O_2+e \rightarrow O+O^-$: generation of ions by an electric field $O+O_2+M(O_2) \rightarrow O_2+M(O_2)$ : generation of ozone by temperature $O_3+O \rightarrow O_2+O_2$: decomposition of ozone by temperature The chemical reaction velocity of decomposing and generating reactions of the ozone in the above chemical reaction formulae are represented by the following formulas with the reaction speed constants being Kg, and Kd.

$$d[O_3]/dt=Kg[O][O_2]^2 Kg[O]\{[O_2]-[O]-[O_3]\}^2-d[O_3]/dt=Kd[O][O_3]$$

(where, [ ]=$cm^{-3}$ where the reaction speed constants Kg and Kd are constants depending upon a temperature, and given by the following formulae.

$$Kg=2.5\times10^{-35}\exp(970/T)\ (cm^3/sec.)$$

$$Kd=1.5\times10^{-22}\exp(-2240/T)\ (cm^3/sec.)$$

Accordingly, Kg, Kd depend upon the temperature. The relationship between the generation and decomposition of the ozone at the respective temperatures (0° to 200° C.) is analyzed by numerical analysis based on the above reaction, and is shown by curves A to E in FIG. 54.

In FIG. 54, the higher the temperature is, the faster the decomposing speed of the ozone. That is, there is an effect of preventing diffusion of the ozone by limiting the size of the vent hole at the ambient temperature (e.g., a room temperature). In addition, the ion generator 50 is heated to the predetermined temperature (e.g., 100° C.), thereby decomposing the ozone at a diffusing distance of 0.5 mm, and hence if the temperature is 100° C., the diffusing distance is set to 0.5 mm, thereby eliminating leakage of the ozone.

In the apparatus of this embodiment constructed as described above, the vent hole 56 will be first considered. Normally, the width of the slit 54 is 100 μm, the diameter of the vent hole 56 is 80 μm. 3.0 kVpp, 150 kHz is applied as the AC bias voltage 70, 600 V is applied as the first DC voltage 71, and 300 V is applied as the second DC voltage 72. In this embodiment, positive polarity ions are moved, the object 22 to be charged is charged to the same voltage as the first DC voltage 71. When the discharge area is reduced as in this embodiment, the vent hole provided at the electrode 55 can be reduced, thereby reducing leakage of the ozone from the vent hole.

Therefore, according to the apparatus of this embodiment, the discharge area is heated, and the distance from the generating portion of the ions to the passage hole 56 is suitably set to suppress leakage of ozone from the passage hole 56 substantially to zero. In addition, the passage hole 56 is also reduced to decrease the ozone to be leaked from the passage hole 56 to reduce the leakage of the ozone and hence leakage of the ozone can be prevented.

A method for manufacturing the electrode 55 provided with the passage hole 56 will be described. When the electrode 55 is integrally provided with the insulator 57, it is easily handled in the case of assembling. For example, the discharge area and the passage hole are formed by etching using a copper-plated polyamide sheet. When the passage hole 56 is reduced to be slenderized, the manufacturing method becomes difficult, but if the ion can be passed in shape, the shape is not limited.

As described above, the passage hole 56 for diffusing the ozone from the region to be discharged is narrowed in the foregoing description, and the discharge area is heated. However, the structure of the electrode may be formed as shown in FIG. 55.

Figure 55:
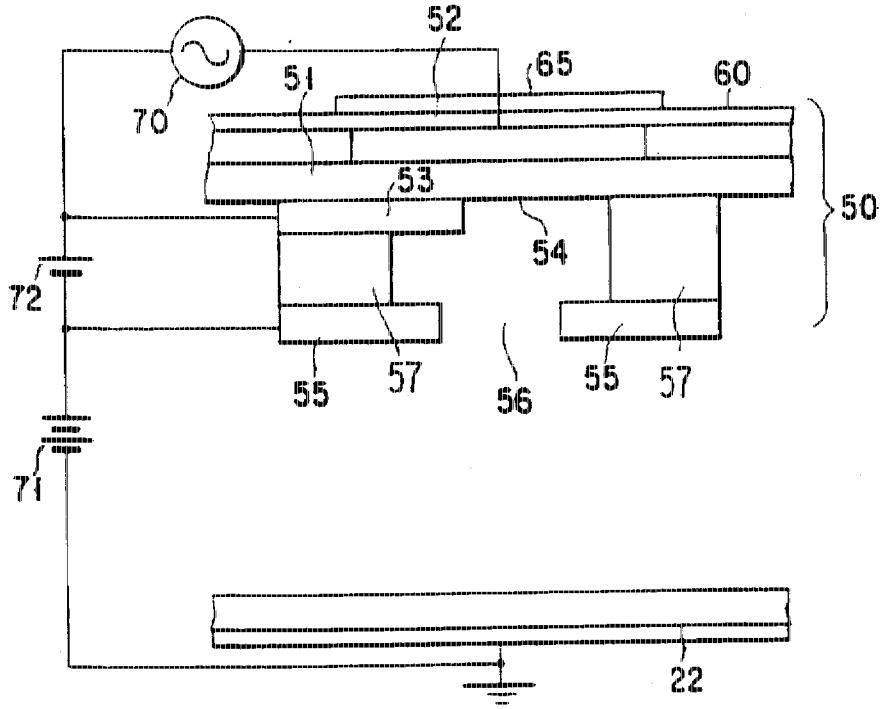
FIG. 55 is a view showing a schematic structure of an ion generator to be used for a recorder according to a twentieth embodiment of the present invention.

FIG. 55 shows a twentieth embodiment in which the ion generating electrode 53 is provided only at one side in FIG. 53. In FIG. 55, the same reference numerals as those in FIG. 53 are used to indicate similar or corresponding component, and a detailed description thereof will be omitted.

With the structure as shown in FIG. 55, ions which do not pass the passage hole 56 are increased, and charging efficiency is wrong. However, alignment of the dielectric electrode 53 and the ion generating electrode 52 is facilitated, and the manufacturing cost can be reduced. In order to raise the charging efficiency, the passage hole 56 is increased to increase the ion amount to be passed, but at this time if the passage hole 56 is increased, leakage of the ions out of the ion generator 50 is increased, and hence it is necessary to form the hole of a suitable size.

Figure 56:
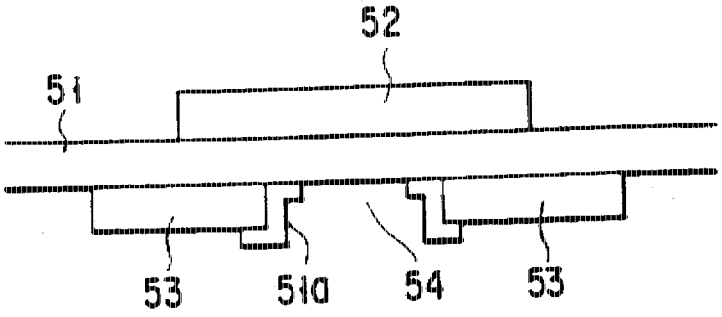
FIG. 56 is a view showing a schematic structure according to a twenty-first embodiment of the present invention.

In the ion generator 50 described by referring to the nineteenth embodiment, an example in which saturation density is reduced by suppressing the generating reaction of the ozone is shown in FIG. 56. FIG. 56 is a view showing a schematic structure of the ion generator 50 to be used for a recorder according to the twenty-first embodiment of the present invention. In FIG. 56, the same numerals as those in FIG. 53 are used to indicate the similar or corresponding components, and a detailed description thereof will be omitted. This embodiment has a heater 65 similar to that in FIG. 53, but omitted.

Normally, the connector of the ion generator generates a strong electric field, thereby generating ozone. However, the ions generated in this connector are fed to the ion generating electrode 53, and the ions directed toward the connector are small, and provide only a small contribution to charging. This connector is covered with a dielectric element 51 to eliminate discharging. Then, it has an effect of suppressing ozone density. In the twenty-first embodiment of FIG. 56, a dielectric layer 51*a* is formed at the connector of the ion generating electrode 53 to the element 51, thereby controlling discharging of the portion. Thus, an ozone generating amount can be suppressed, thereby effectively preventing leakage of the ozone.

Figure 57:
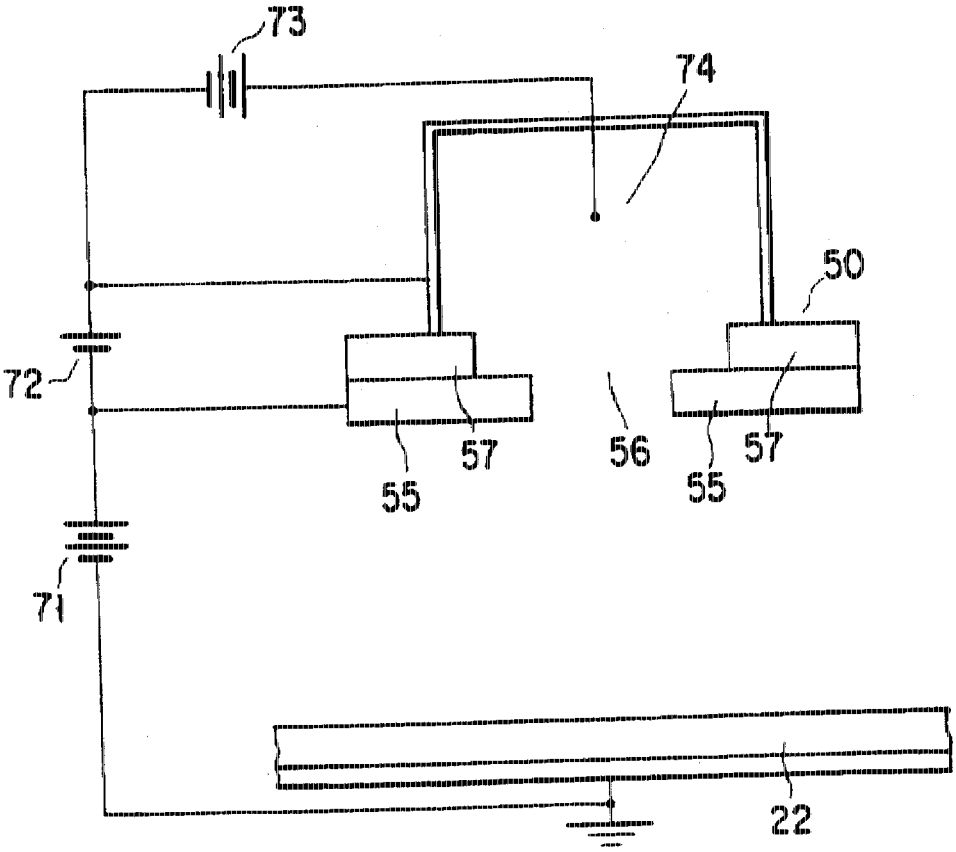
FIG. 57 is a view showing a schematic structure of an ion generator to be used for a recorder according to a twenty-second embodiment of the present invention.

FIG. 57 is a view showing a schematic structure of the ion generator 50 to be used for a recorder according to a twenty-second embodiment of the present invention. In FIG. 57, the same reference numerals as those in FIG. 53 are used to indicate similar or corresponding components, and a detailed description thereof will be omitted. This embodiment is application of this invention to the ion generator 50 used heretofore for a corotron or a scorotron.

In FIG. 57, a DC high voltage 73 is applied to a wire 74. An electrode 55 partitions a discharge area and a moving area. The ion generator 50 using the wire 74 has small ion current density at the electrode 55, and hence charging efficiency is deteriorated evenby a small vent hole as described with respect to the twentieth embodiment. When the vent hole 56 is increased, the charging efficiency is raised, but leakage ozone is also increased, and it is necessary to set the passage hole to a suitable size. Even in the twenty-second embodiment, a heater (not shown) similarly to the previous embodiment is provided, and it can effectively prevent leakage of the ozone from the ion generator 50.

Obviously, numerous (additional) modifications and variations of the present invention are possible in light of the above teachings. It is therefore to be understood that within the scope of the appended claims, the invention may be practiced otherwise than as specifically described herein.

What is claimed is:

1. An electrostatic recording apparatus for forming a latent image of a recording picture on a recording medium, comprising:

charging means for uniformly charging said recording medium;

electrostatic latent image forming means for forming the latent image onto said uniformly charged recording medium;

development means having development roller for developing the electrostatic latent image formed on said recording medium and forming the recording picture, said development roller including a first electrode and second electrode arranged on said development roller via an insulator for said first electrode; and electric field generating means for applying a predetermined bias voltage to said first and second electrodes and generating an electric field parallel to said recording medium.

2. An apparatus according to claim 1, wherein said electric field generating means includes voltage applying means for applying different AC bias voltages to said first and second electrodes.

3. An apparatus according to claim 1, wherein a distance between said development roller and said recording medium is smaller than a distance between said first and second electrodes.

4. An apparatus according to claim 1, wherein the following relationship is set among a moving velocity v of said recording medium, a development area L, a peripheral speed $v_r$ of the development roller, and a period $L_f$ between the first and second electrodes for applying a same bias voltage on the development roller and one of the first and second electrodes:

$(L/v)<(L_f/v_r)$.

5. An apparatus according to claim 1 or claim 4, further comprising:

voltage applying means for applying a DC bias voltage to said development roller;

detecting means for detecting an atmospheric pressure; and control means for controlling the DC bias voltage of said voltage applying means according to the atmospheric pressure detected said detecting means.

6. An apparatus according to claim 5, wherein said control means includes means for controlling the DC bias voltage to satisfy the following equation:

$$(Vpp/2+vc)<8.33\times(P\times d)+325$$

where Vc is a electrostatic contrast, P is a atmospheric pressure and d is a distance between said recording medium and said development roller.

7. An apparatus according to claim 1 or claim 4, wherein said charging means comprises:

a discharge area for generating an ion;

heating means for heating said discharge area to a predetermined temperature;

a moving area for moving the ion to a charging object;

a passage hole arranged near the ion generating area in said discharge area and having a predetermined distance for moving the ion generated in the discharge area from said discharge area to said moving area.

* * * * *